United States Patent [19]

Waki et al.

[11] Patent Number: 5,057,404

[45] **Date of Patent: * Oct. 15, 1991**

[54] SILVER HALIDE COLOR PHOTOGRAPHIC MATERIAL CONTAINING A CYAN COUPLER, A POLYMER, AND AN OXONOL DYE

[75] Inventors: Kokichi Waki; Tsumoru Hirano, both of Kanagawa, Japan

[73] Assignee: Fuji Photo Film Co., Ltd., Kanagawa, Japan

[ * ] Notice: The portion of the term of this patent subsequent to Aug. 15, 2006 has been disclaimed.

[21] Appl. No.: 296,173

[22] Filed: Jan. 12, 1989

[30] Foreign Application Priority Data

Jan. 13, 1988 [JP] Japan ..... 63-3759

[51] Int. Cl.[5] ..... G03C 1/46; G03C 7/32

[52] U.S. Cl. ..... 430/503; 430/512; 430/522; 430/546; 430/551; 430/553; 430/595

[58] Field of Search ..... 430/505, 512, 522, 546, 430/551, 553, 595, 503

[56] References Cited

U.S. PATENT DOCUMENTS

| | | | |
|---|---|---|---|
| 4,199,363 | 4/1980 | Chen | 430/512 |
| 4,746,598 | 5/1988 | Kurematsu et al. | 430/372 |
| 4,801,521 | 1/1989 | Ohki et al. | 430/380 |
| 4,833,246 | 5/1989 | Adachi et al. | 430/522 X |
| 4,857,449 | 8/1989 | Ogawa et al. | 430/546 |

*Primary Examiner*—Charles L. Bowers, Jr.
*Assistant Examiner*—Janet C. Baxter
*Attorney, Agent, or Firm*—Sughrue, Mion, Zinn, Macpeak & Seas

[57] ABSTRACT

A silver halide color photographic material is disclosed having blue-sensitive, green-sensitive, and red-sensitive silver halide emulsion layers on a support, wherein said red-sensitive silver halide emulsion layer contains a dispersion of fine oleophilic grains formed by dispersing by emulsification a mixture comprising a water-insoluble and organic solvent-soluble homopolymer or copolymer and at least one coupler represented by formula (I) or formula (II), and the silver halide emulsion layer or non-light-sensitive layer of the material contains a dye represented by formula (III);

wherein formula (I) is represented by (I)

wherein $R_{11}$ represents an alkyl group, a cycloalkyl group, an aryl group or a heterocyclic group; $R_{12}$ represents an acylamino group or an alkyl group; $R_{13}$ represents a hydrogen atom, a halogen atom, an alkyl group or an alkoxy group, or $R_{12}$ and $R_{13}$ are bonded together to form a nitrogen-containing heterocyclic ring; $Z_{11}$ represents a hydrogen atom, an alkyl group, an aryloxy group, an alkylthio group or an arylthio group;

formula (II) is represented by (II)

wherein $R_{21}$ and $R_{22}$ each represents a hydrogen atom, an alkyl group, a cycloalkyl group or an aryl group, provided that at least one of $R_{21}$ and $R_{22}$ is a substituent other than a hydrogen atom; $R_{23}$ represents a hydrogen atom, a carbamoyl group, a sulfamyl group, an alkoxycarbonyl group or an aryloxycrbonyl group; $Z_{21}$ represents a hydrogen atom, an alkoxy group, an aryloxy group, an alkylthio group or an arylthio group; X represents —CO— or —$SO_2$—; and formula (III) is represented by (III)

wherein $R_1$ and $R_2$ each represents —$COOR_5$ or

;

$R_3$ and $R_4$ each represents a hydrogen atom or an alkyl group; $R_5$ and $R_6$ each represents a hydrogen atom, an alkyl group or an aryl group; $Q_1$ and $Q_2$ each represents an aryl group; $X_1$ and $X_2$ each represents a divalent linking group; $Y_1$ and $Y_2$ each represents a sulfo group or a carboxyl group; $L_1$, $L_2$ and $L_3$ each represents a methine group; $m_1$ and $m_2$ each represents 1 or 2; n represents 0, 1 or 2; $P_1$ and $P_2$ each represents 0, 1, 2, 3 or 4; and $s_1$ and $s_2$ each represents 1 or 2.

The material forms a color image with less stain, which is stable for a long period of time; it contains a novel dye which may easily be discolored or dissolved out by photographic processing without having any bad influence on the photographic characteristics of the material; and it is excellent in the time-dependent storability.

16 Claims, No Drawings

SILVER HALIDE COLOR PHOTOGRAPHIC MATERIAL CONTAINING A CYAN COUPLER, A POLYMER, AND AN OXONOL DYE

FIELD OF THE INVENTION

The present invention relates to silver halide color photographic materials, and, in particular, to such material providing color images with less stain, the color images formed being stable for a long period of time, and which are excellent in the raw film material storability.

BACKGROUND OF THE INVENTION

In general silver halide color photographic materials are spectrally sensitized with silver halides and sensitizing dyes in accordance with the three color separation process, and a yellow coloring coupler is incorporated into the blue-sensitive silver halide emulsion, a magenta coloring coupler into the green-sensitive silver halide emulsion, and a cyan coloring coupler into the red-sensitive silver halide emulsion. After imagewise exposed, the materials are processed with a color developer containing a p-phenylenediamine derivative as a color developing agent and then bleach-fixed to provide color images.

The color images thus-formed in such silver halide color photographic materials are often stored under exposure to light for a long period of time, or are sometimes stored in the dark also for a long period of time, though the time for exposure to light may be short in the latter case. It is well known that such color images often become seriously faded depending upon the conditions during storage. In general, the color fading in the former case is called "light fading", and that in the latter case "dark fading". When color photographic materials after processing are to be stored as recording media semipermanently for a long period of time, it is desired that the degree of such light fading or dark fading is minimized, at least so that the systematic three color fading balance of the respective yellow, magenta and cyan color images may be maintained to correspond to the original color balance therebetween. However, there is known a disadvantageous phenomenon that the respective colors of yellow, magenta and cyan of photographic color images differ from one another in the degree of the light fading and the dark fading of the respective colors, so that, after the color images have been stored for a long period of time, the systematic three color fading balance is often lost, and the image quality of the color images formed is thereby deteriorated.

In general, the degrees of light fading and dark fading naturally differ, depending upon the couplers used as well as other various factors. However, with respect to the dark fading for dyes in many color photographic materials, the color fading is more noticeable in a cyan color image, a yellow color image, and a magenta color image, in the order listed, and, particularly, the degree of the dark fading of a cyan color image is the most noticeable as compared with the other color images. With respect to the light fading of color images formed, the color fading is apt to be more noticeable in a cyan color image, a yellow color image, and a magenta color image, in the order listed, with respect to a light source strong in ultraviolet radiation.

Under these circumstances, it is believed necessary to suppress the dark fading of the cyan color image as much as possible, so as to maintain a well-balanced color fading balance of the three colors of yellow, magenta, and cyan in color images for a long period of time, and, therefore, various studies have hitherto been made for improvement of the light fading and dark fading properties of color images. The studies may be grouped into two types; one has been to develop new couplers capable of forming color images which are hardly faded, and the other has been to develop new additives capable of effectively inhibiting fading of color images formed.

Many phenolic cyan couplers capable of forming cyan dyes are known. For example, 2-[α-2,4-di-tert-amylphenoxybutanamido]-4,6-dichloro-5-methylphenol described in U.S. Patent 2,801,171 can form a color image with a good light fastness, which, however, is known to have a defect in that its heat resistance is poor.

Phenolic cyan couplers where the 3- or 5-position of the phenol nucleus is substituted by an alkyl group having 2 or more carbon atoms are described in, for example, JP-B-49-11572 and JP-A-60-209735 and JP-A-60-205447 (the term "JP-B" and "JP-A" as used herein means an "examined Japanese patent publication" and an "unexamined published Japanese patent application", respectively). Although the cyan images to be formed from these couplers have been improved in the heat resistance in some degree, the improvement is still not totally sufficient.

2,5-Diacylaminophenol cyan couplers where the 2- and 5-positions of the phenol nucleus are substituted by acylamino groups are described in, for example, U.S. Pat. Nos. 2,369,929, 2,772,162 and 2,895,826, and JP-A-50-112038, JP-A-53-109630 and JP-A-55-163537.

These 2,5-diacylaminophenol couplers may form cyan images with good heat resistance. However, these still have some drawbacks in that the coloring property of the couplers is poor, the light fastness of the cyan images to be formed therefrom is poor, and the non-reacted cyan couplers cause yellowing under light. In addition, further improvement of the heat resistance of the couplers is desired.

1-Hydroxy-2-naphthamide cyan couplers are generally insufficient in both light fastness and dark fastness properties.

The 1-hydroxy-2-acylaminocarbostyryl cyan couplers described in JP-A-56-104333 can form color images having good fastness to light and heat, but have problems in that the spectral absorption characteristics of the color images formed is unfavorable for color reproduction of color photographs and the color images formed form pink stains after exposure to light.

The cyan polymeric couplers described in U.S. Pat. No. 3,767,412 and JP-A-59-65844 and JP-A-61-39044 are surely excellent in heat resistance under dry conditions, but are defective in that the heat resistance under high moisture conditions is poor, and the coloring property is insufficient.

U.S. Pat. No. 4,203,716 describes a method of dissolving a hydrophobic substance such as oil-soluble coupler in a water-miscible organic solvent and blending the resulting solution with a loadable polymer latex so as to load the hydrophobic substance onto the polymer. However, there is a problem in that such method of using a loadable polymer latex is inferior to the case of using a water-immiscible high boiling point organic solvent with respect to the light fastness of the cyan image to be formed. Moreover, there is another problem in that a large amount of a polymer would be required to be used in order that the coupler could be sufficiently loaded to obtain a sufficient maximum color density.

JP-B-48-30494 describes that photographic materials containing an emulsified dispersion of a coupler formed by the use of a homopolymer of organic solvent-soluble hydrophobic monomers having a particular structure or a copolymer of the said monomers with hydrophilic monomers having a particular structure, in place of using any high boiling point coupler solvents, the grain size of the grains dispersed in the emulsified dispersion being in the range of from about 0.5 μm to about 5 μm have been improved with respect to the film quality, recoloration failure and light fastness as well as the storability before processing.

However, we the present inventors have found that the use of such homopolymer of hydrophobic monomers described in the aforesaid JP-B-48-30494 in place of coupler solvents involves various problems such as that the coloring property of the couplers is poor, and the stability of the emulsified dispersion is poor. In particular, the poor coloring property was found noticeable when the emulsified dispersion-containing photographic materials were processed with a developer not containing any development accelerator, such as benzyl alcohol, which was added to the developers used in examples of the said JP-B-48-30494. On the other hand, the copolymers with hydrophilic monomers such as acrylic acid could surely be effective for somewhat improving the stability and coloring property of the resulting emulsified dispersions, but the improvement is considered still insufficient. In addition, there would occur another problem that the fading resistance (especially fading resistance under high heat and moisture conditions) is to be worsened if the proportion of hydrophilic monomers in the copolymer is increased so as to improve the coloring property of the resulting emulsified dispersion. Any way, since all the homopolymers and copolymers are poor in the ability of preventing crystallization of couplers, there is an additional disadvantageous problem that the coupler in the emulsified dispersion would form crystals during storage thereof.

When the technique as illustrated in JP-B-48-30494 is applied especially to cyan couplers, there is a significant problem in that the light fastness is extremely worsened (reduction of from 1.5 to 3 times) as compared with the case of dispersing the couplers in a conventional high boiling point solvent (so-called "oil dispersion").

In addition, the technique of JP-B-48-30494 has another problem, in that although the hue of the cyan image formed is in a long wavelength range immediately after developed, this tends to easily shift into a short wavelength range, especially after storage under high temperature conditions. The problem means that the hue of the image formed would change time-dependently.

As mentioned above, the couplers whose dark fastness has been improved by variation of the coupler structures of themselves by the prior art techniques (dark fastness-improved couplers) are noted to be frequently insufficient in the points of the color hue, coloring capacity, generation of stains and light fastness. Accordingly, a novel technique capable of overcoming the foregoing prior art problems and satisfying the necessary points mentioned above is being desired. On the other hand, effective and harmless dark fastness-improving means have not been found up to the present, from the aspect of the means of using couplers, by improvement of the additives to be used, as well as by the means of dispersing couplers.

Coloring of photographic emulsion layers and other layers is often conducted for the purpose of absorbing a light with a particular wavelength range in silver halide color photographic materials.

For the purpose of preventing blurring of an image formed on a photographic material, which can be caused by the phenomenon that the light passing through the photographic emulsion or after passed therethrough is scattered and is reflected on the interface between the emulsion layer and the support or on the surface of the photographic material opposite to the emulsion layer and thereafter is again introduced into the photographic emulsion layer, or that is, for the purpose of preventing a so-called halation, a colored layer may be provided between the photographic emulsion layer and the support or on the surface of the support opposite to the photographic emulsion layer. Such colored layer is called an antihalation layer. In the case of multilayered color photographic materials, such antihalation layer may be provided between the multiple layers.

In order to prevent the lowering of the image sharpness because of the light scattering in photographic emulsion layers (the phenomenon is generally called irradiation), the photographic emulsion layers may be colored.

The layers to be colored often contain a hydrophilic colloid in many cases, so that a water-soluble dye may be incorporated into the layers for coloration thereof. The dyes to be used for this purpose are required to satisfy the following conditions.

(1) They have a proper spectral absorption in accordance with the intended use thereof.

(2) They are photochemically inactive. That is, they do not have any chemically harmful influences, such as lowering of sensitivity, fading of latent images, or fogging, on the properties of silver halide photographic emulsions.

(3) They are decolored or dissolved out by photographic processing, so that they do not give any harmful coloration on the photographic materials processed.

Those skilled in the art have variously studied so as to find out dyes which satisfy the said conditions, and, as a result, a number of dyes have been known. Examples include oxonol dyes having pyrazolone and barbituric acid nuclei, as described in British Patents 506,385, 1,177,429, 1,311,884, 1,338,799, 1,385,371, 1,467,214, 1,433,102 and 1,553,516, JP-A-48-85130, JP-A-49-114420, JP-A-55-161233 and JP-A-59-111640 and U.S. Pat. Nos. 3,247,127, 3,469,985 and 4,078,933; and other oxonol dyes as described in U.S. Pat. Nos. 2,533,472 and 3,379,533 and British Patent 1,278,621.

Among them, oxonol dyes having two pyrazolone nuclei have been used as useful dyes for dyeing photographic materials, as these are easily decolored in a sulfite-containing developer, and thus have hardly any adverse influence on photographic emulsions.

However, some dyes of this type have drawbacks, in that although they have little influence on the photographic emulsions themselves, that these would cause spectral sensitization in an undesired range for spectrally sensitized emulsions or would cause lowering of sensitivity of such emulsions, the latter being considered to result from desorption of the sensitizing dye from the emulsion.

In addition, some of said dyes would remain in the photographic materials processed, depending upon the rapid processing, which is frequently carried out these days. In order to overcome the problem, it has been proposed to use dyes having a high reactivity with sulfite ion. In this case, however, the stability of the dyes used is insufficient in the photographic film, with the result that the concentration of the dyes is lowered after storage, and the intended photographic effect is not attained thereby.

SUMMARY OF THE INVENTION

Accordingly, a first object of the present invention is to provide a silver halide photographic material which has been improved to have a well-balanced light fading-dark fading property, and, in particular, that capable of forming color images with less stain which may display an excellent image storability even under high temperature and high moisture conditions.

A second object of the present invention is to provide a silver halide photographic materials which has been improved in the systematic fading color balance of the three colors yellow, magenta, and cyan because of the possibility of adjustment of the color fading degree, so that the color image formed may be kept stable even after being stored for a long period of time.

A third object of the present invention is to provide a silver halide photographic material capable of forming a color image which has been improved in the image storability without adversely affecting the various photographic characteristics of the material.

A fourth object of the present invention is to provide a silver halide photographic material in which the hydrophilic colloid layer is dyed with a novel water-soluble dye not having any harmful influences on the photographic characteristics of the silver halide emulsion layers in the material.

A fifth object of the present invention is to provide a silver halide photographic material containing a novel water-soluble dye which is still stable even after the hydrophilic colloid layer dyed with the dye has been stored for a long period of time.

It has now been found that these objects can be attained by a silver halide color photographic material having blue-sensitive, green-sensitive, and red-sensitive silver halide emulsion layers on a support, wherein said red-sensitive silver halide emulsion layer contains a dispersion of fine oleophilic grains formed by dispersing by emulsification a mixture comprising a water-insoluble and organic solvent-soluble homopolymer or copolymer and at least one coupler represented by formula (I) or formula (II), and a silver halide emulsion layer or non-light-sensitive layer of the material contains a dye represented by formula (III);

wherein formula (I) is represented by

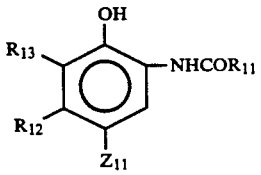

(I)

wherein $R_{11}$ represents an alkyl group, a cycloalkyl group, an aryl group, or a heterocyclic group; $R_{12}$ represents an acylamino group or an alkyl group; $R_{13}$ represents a hydrogen atom, a halogen atom, an alkyl group or an alkoxy group, or $R_{12}$ and $R_{13}$ are bonded together to form a nitrogen-containing heterocyclic ring; $Z_{11}$ represents a hydrogen atom or a coupling releasable group, an alkoxy group;

formula (II) is represented by

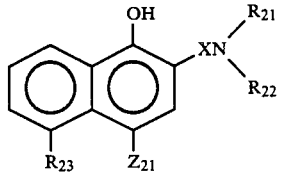

(II)

wherein $R_{21}$ and $R_{22}$ each represents a hydrogen atom, an alkyl group, a cycloalkyl group, or an aryl group, provided that at least one of $R_{21}$ and $R_{22}$ is a substituent other than a hydrogen atom; $R_{23}$ represents a hydrogen atom, a carbamoyl group, a sulfamyl group, an alkoxycarbonyl group, or an aryloxycarbonyl group; $Z_{21}$ represents a hydrogen atom, an alkoxy group, an aryloxy group, an alkylthio group, or an arylthio group; X represents a —CO— or —$SO_2$—; and formula (III) is represented by

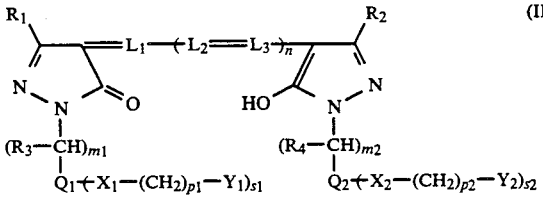

(III)

wherein $R_1$ and $R_2$ each represents —$COOR_5$ or

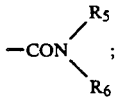

;

$R_3$ and $R_4$ each represents a hydrogen atom or an alkyl group; $R_5$ and $R_6$ each represents a hydrogen atom, an alkyl group, or an aryl group; $Q_1$ and $Q_2$ each represents an aryl group; $X_1$ and $X_2$ each represents a divalent linking group; $Y_1$ and $Y_2$ each represents a sulfo group or a carboxyl group; $L_1$, $L_2$, and $L_3$ each represents a methine group; $m_1$ and $m_2$ each represents 1 or 2; n represents 0, 1, or 2; pl and p2 each represents 0, 1, 2, 3 or 4 and $s_1$ and $s_2$ each represents 1 or 2.

DETAILED DESCRIPTION OF THE INVENTION

Examples of $R_{11}$ in formula (I) include, as an alkyl group or a cycloalkyl group, a methyl group, a butyl group, a dodecyl group, a cyclohexyl group, and an allyl group; as an aryl group, a phenyl group, and a naphthyl group; and, as a heterocyclic group, a 2-pyridyl group and a 2-furyl group.

$R_{11}$ may further be substituted with a substituent selected from the group consisting of an alkyl group, an aryl group, an alkyloxy or aryloxy group (e.g., methoxy, dodecyloxy, methoxyethoxy, phenyloxy, 2,4-di-tert-amylphenoxy, 3-tert-butyl-4-hydroxyphenyloxy, naphthyloxy), a carboxyl group, an alkylcarbonyl or arylcarbonyl group (e.g., acetyl, tetradecanoyl, benzoyl), an alkyloxycarbonyl or aryloxycarbonyl group (e.g., methoxycarbonyl, phenyloxycarbonyl), an acyloxyl group (e.g., acetyloxy, benzoyloxy), a sulfamoyl group (e.g., N-ethylsulfamoyl, N-octadecylsulfamoyl), a carbamoyl group (e.g., N-ethylcarbamoyl, N-methyldodec-ylcarbamoyl), a sulfonamido group (e.g., methanesulfonamido, benzenesulfonamido), an acylamino group (e.g., acetylamino, benzamido, ethoxycarbonylamino, phenylaminocarbonylamino), an imido group (e.g., succinimido, hydantoinyl), a sulfonyl group (e.g., methanesulfonyl), a hydroxyl group, a cyano group, a nitro group, and a halogen atom.

$Z_{11}$ in formula (I) represents a hydrogen atom or a coupling releasable group. Examples of $Z_{11}$ include a halogen atom (e.g., fluorine, chlorine, bromine), an alkoxy group (e.g., dodecyloxy, methoxycarbamoylmethoxy, carboxypropyloxy, methylsulfonylethoxy), an aryloxy group (e.g., 4-chlorophenoxy, 4-methoxyphenoxy), an acyloxy group (e.g., acetoxy, tetradecanoyloxy, benzoyloxy), a sulfonyloxy group (e.g., methanesulfonyloxy, toluenesulfonyloxy), an amido group (e.g., dichloroacetylamino, methanesulfonylamino, toluenesulfonylamino), an alkoxycarbonyloxy group (e.g., ethoxycarbonyloxy, benzyloxycarbonyloxy), an aryloxycarbonyloxy group (e.g., phenoxycarbonyloxy), an aliphatic- or aromatic-thio group (e.g., phenylthio, 2-butoxy-5-tert-octylphenylthio, tetrazolylthio), an imido group (e.g., succinimido, hydantoinyl), an N-heterocyclic ring (e.g., 1-pyrazolyl, 1-benzotriazolyl), and an aromatic azo group (e.g., phenylazo). These releasable groups may contain photographically useful groups.

Examples of the acylamino group represented by $R_{12}$ in formula (I) include acetylamino, benzamido, 2,4-di-tert-aminophenoxyacetamido, o-(2,4-di-tert-amylphenoxy)butylamido, α-(2,4-di-tert-amylphenoxy)-β-methylbutylamido, α-(2-chloro-4-tert-amylphenoxy)octanamido, α-(2-chlorophenoxy)tetradecanamido, and α-(3-pentadecylphenoxy)butylamido.

Examples of the alkyl group represented by $R_{12}$ and having at least one carbon atom include methyl, ethyl, propyl, tert-butyl, pentadecyl, and benzyl, an alkyl group having 2 or more carbon atoms being preferred.

$R_{13}$ in formula (I) represents a hydrogen atom, a halogen atom (e.g., fluorine, chlorine, bromine), an alkyl group (e.g., methyl, ethyl, n-butyl, tert-butyl, n-octyl, n-tetradecyl), or an alkoxy group (e.g., methoxy, 2-ethylhexyloxy, n-octyloxy, n-dodecyloxy).

$R_{11}$ or $R_{12}$ in formula (I) may form a dimer or a higher polymer. $R_{12}$ and $R_{13}$ may also condense to form a nitrogen-containing heterocyclic ring (preferably a 5- to 7-membered ring).

To specific examples of groups or atoms represented b $R_{21}$ to $R_{23}$ and $Z_{21}$ in formula (II) are applicable those described for formula (I).

Specific examples of the compounds of formula (I) for use in the present invention are set forth below, which, however, are not intended to restrict the scope of the invention.

(C-1)

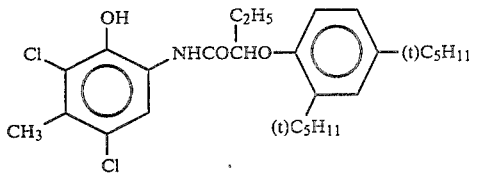

(C-2)

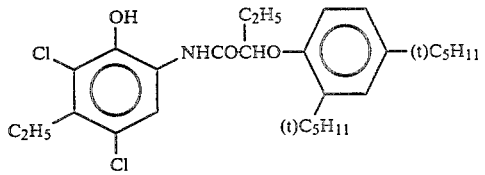

(C-3)

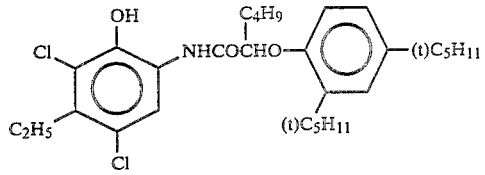

(C-4)

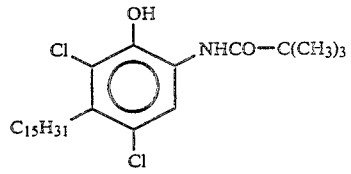

(C-5)

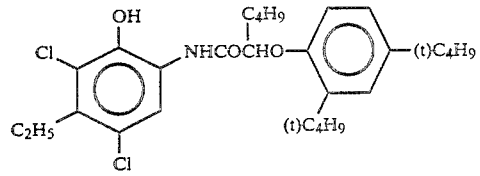

-continued
(C-6)
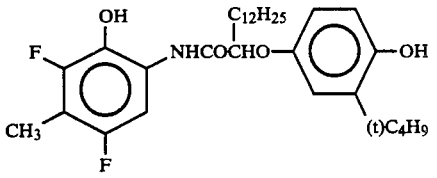
(C-7)
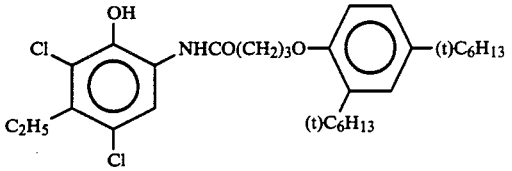
(C-8)
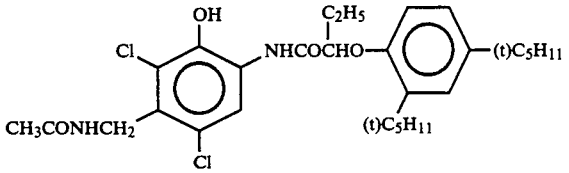
(C-9)
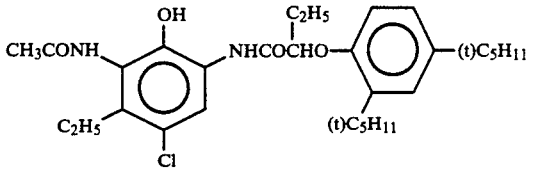
(C-10)
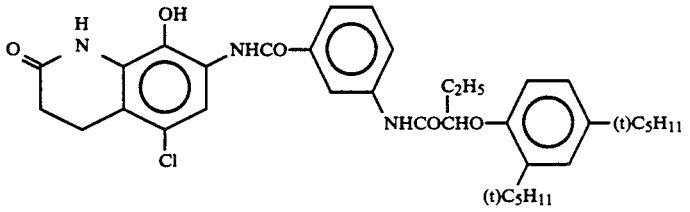
(C-11)
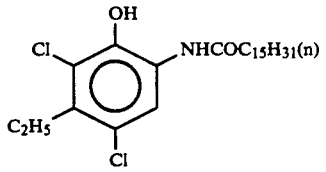
(C-12)
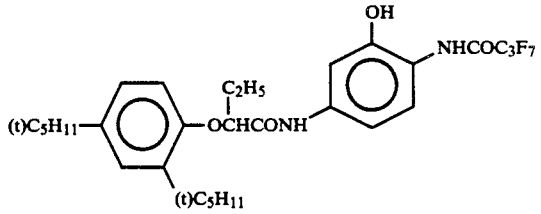
(C-13)
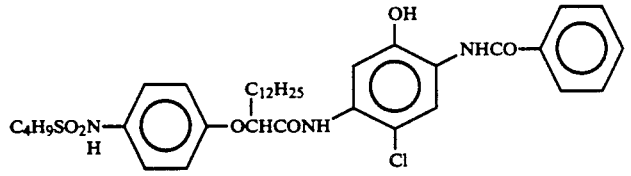

-continued
(C-14)
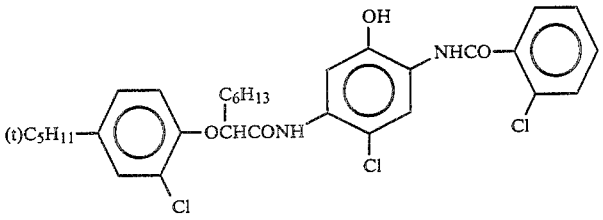
(C-15)
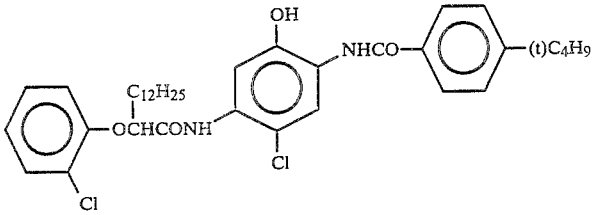
(C-16)
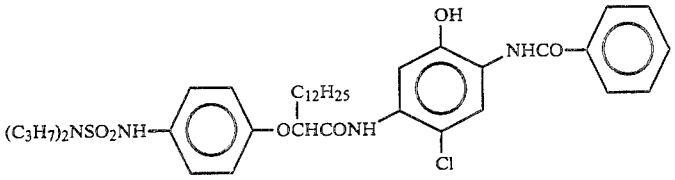
(C-17)
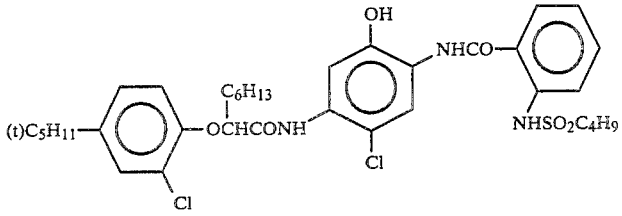
(C-18)
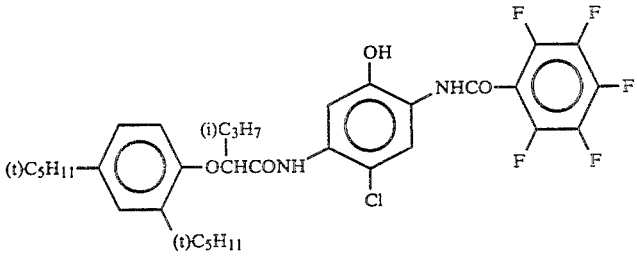
(C-19)
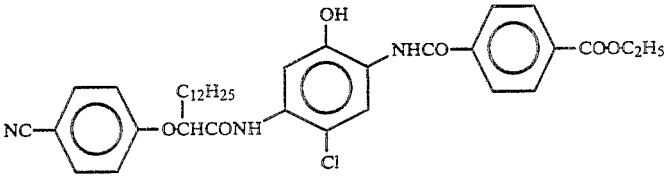
(C-20)
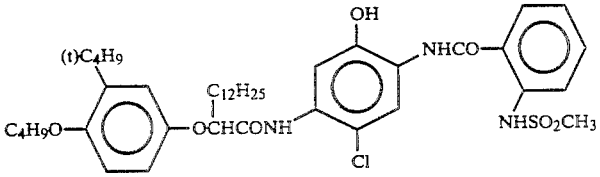

-continued
(C-21)
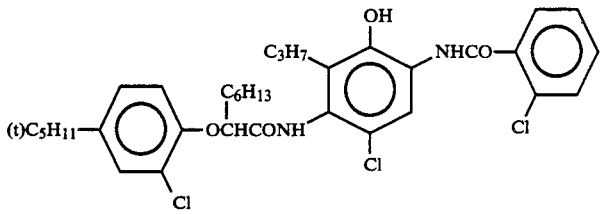
(C-22)
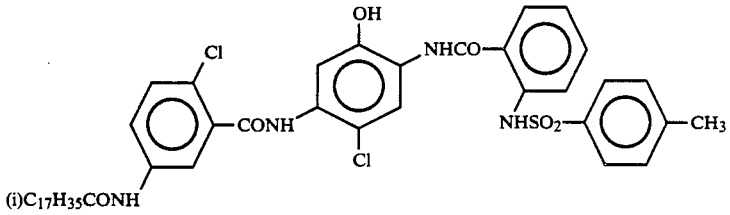
(C-23)
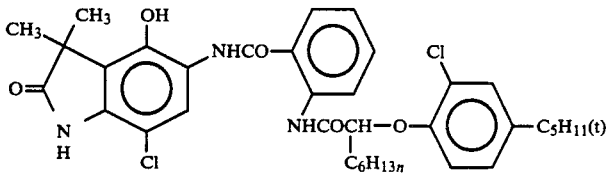
(C-24)
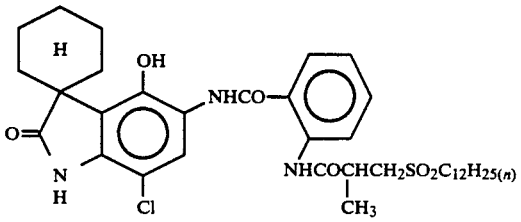
(C-25)
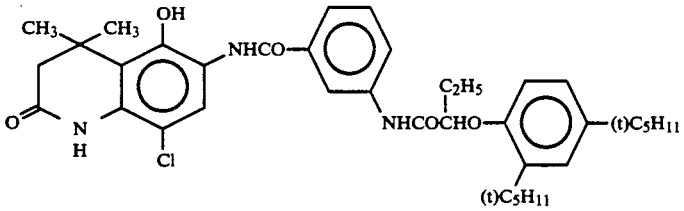
(C-26)
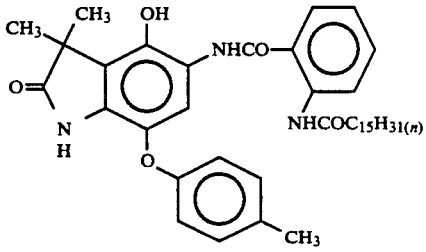

-continued
(C-27)
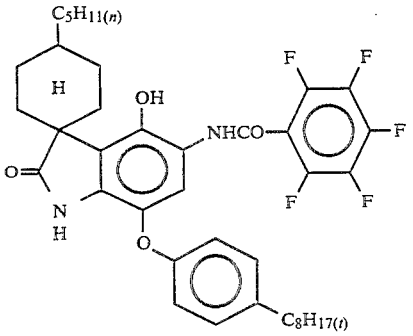
(C-28)
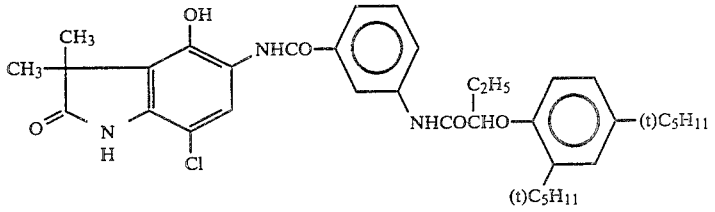
(C-29)
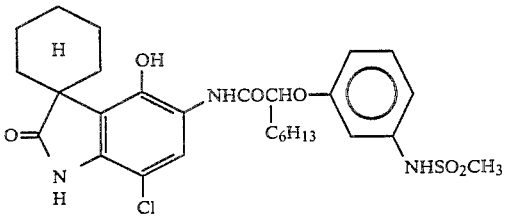
(C-30)
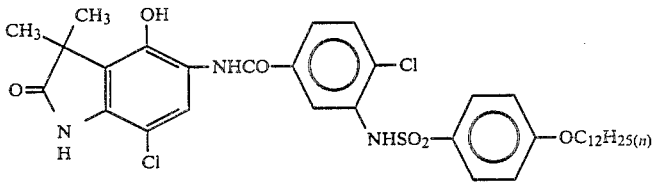
(C-31)
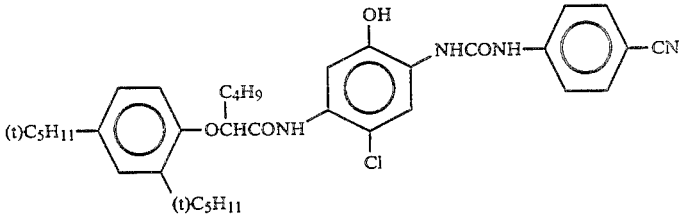
(C-32)
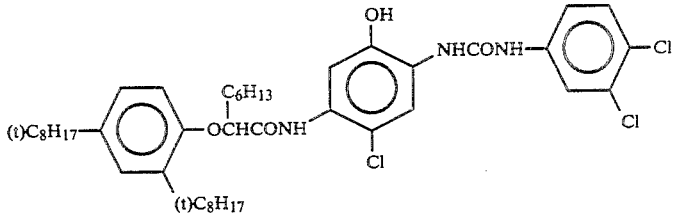
(C-33)
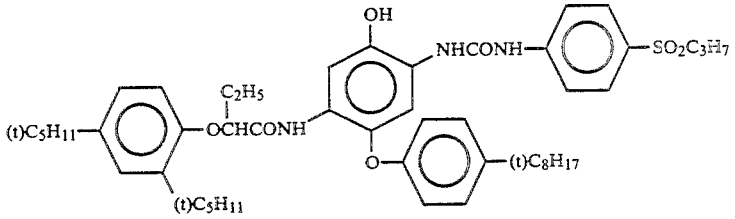

-continued
(C-34)
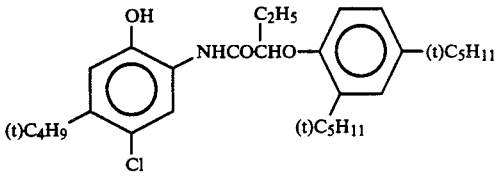
(C-35)
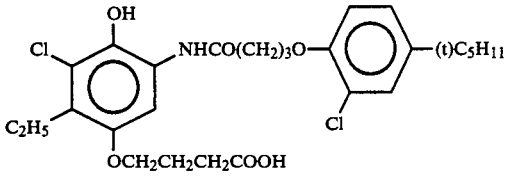
(C-36)
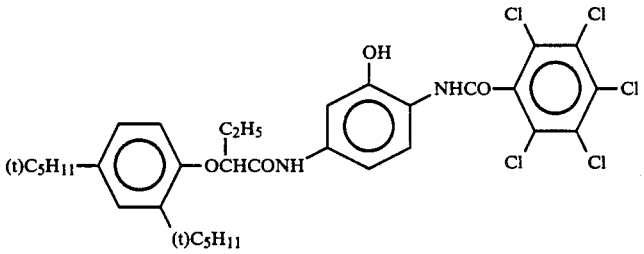
(C-37)
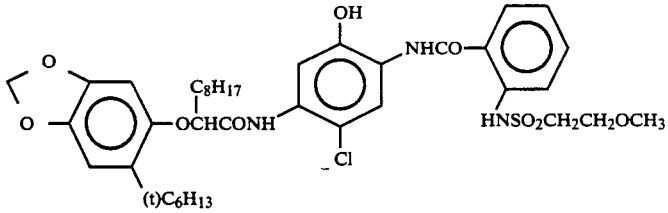
(C-38)
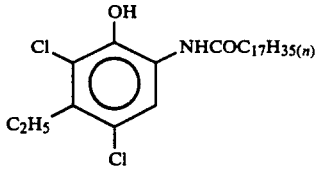
(C-39)
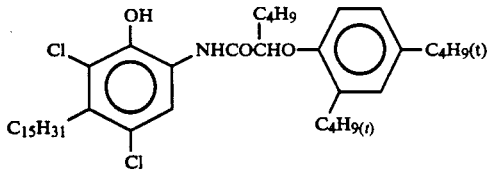
(C-40)
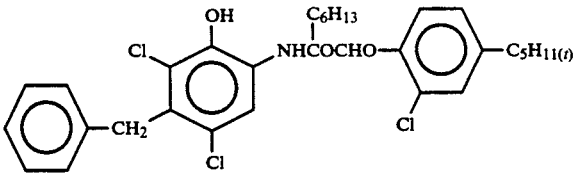
(C-41)
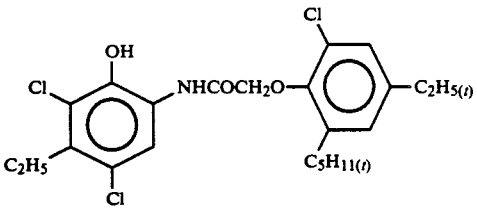

-continued
(C-42)
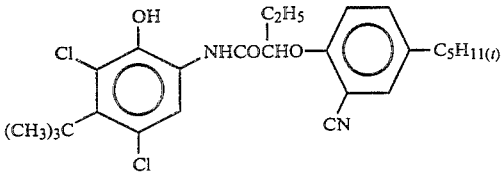
(C-43)
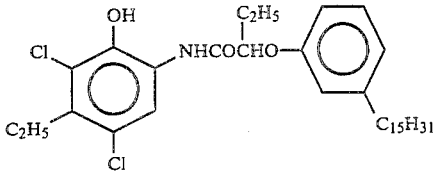
(C-44)
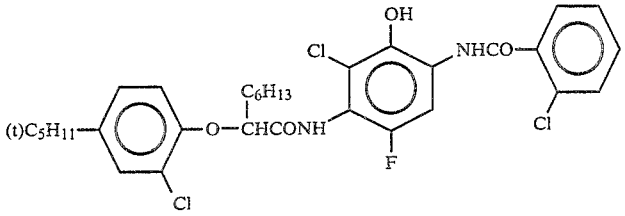
(C-45)
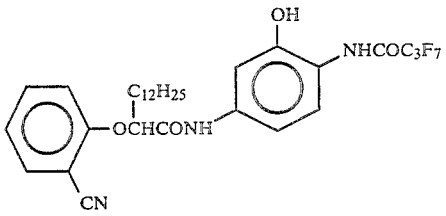
(C-46)
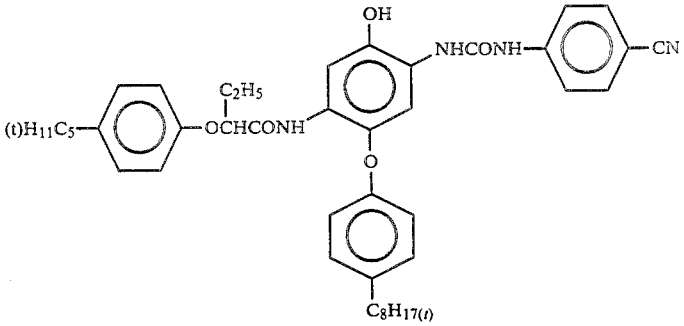
Specific examples of the compounds of the formula (II) for use in the present invention are set forth below, which, however, are not intended to restrict the scope of the invention.
(C-47)
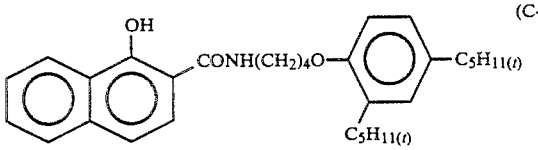
(C-48)
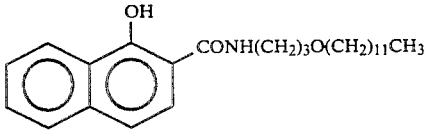
-continued
(C-49)
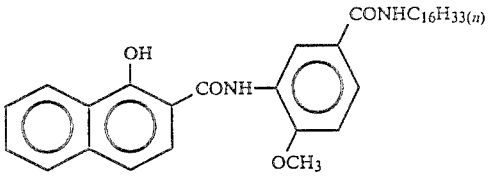
(C-50)
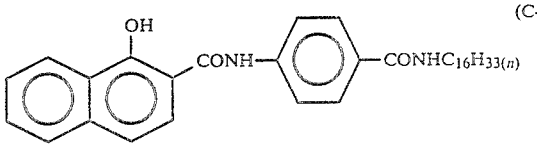

-continued
(C-51)
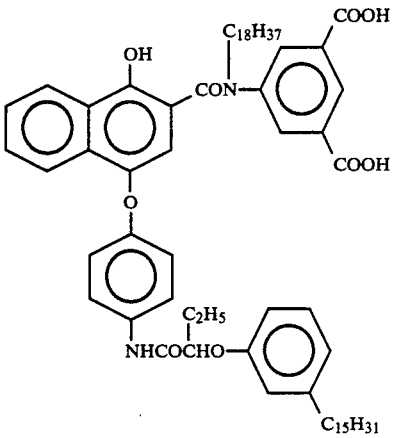
(C-52)
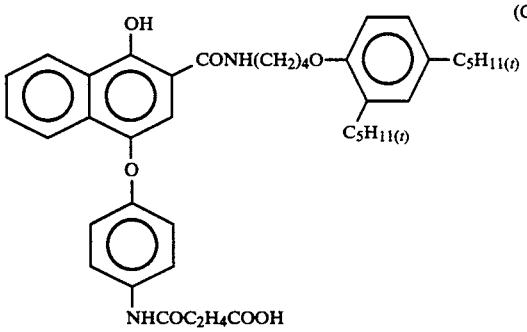
(C-53)
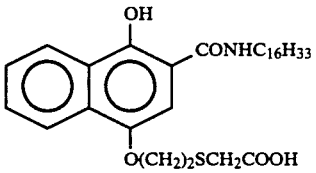
(C-54)
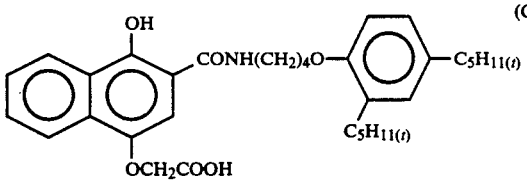
(C-55)
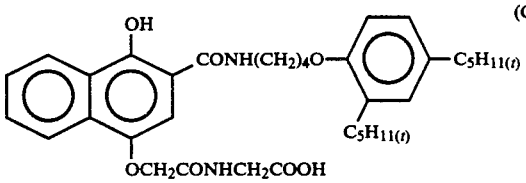
(C-56)
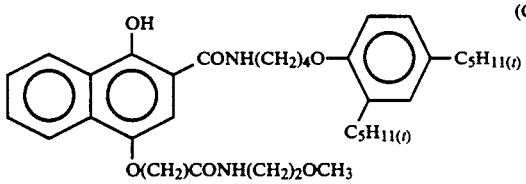
-continued
(C-57)
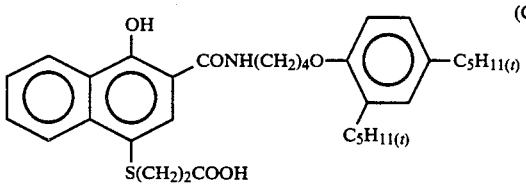
(C-58)
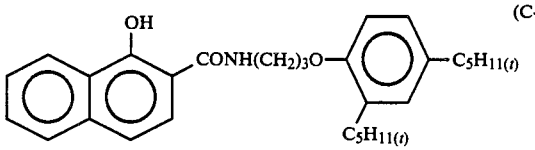
(C-59)
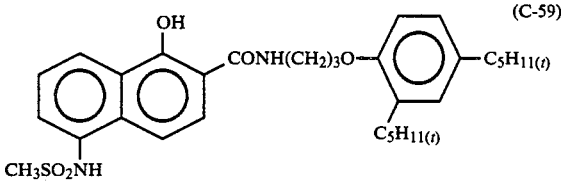
(C-60)
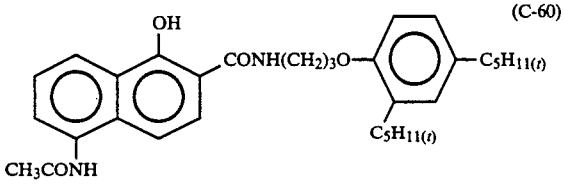
(C-61)
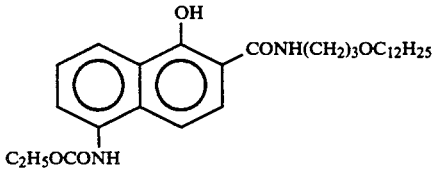
(C-62)
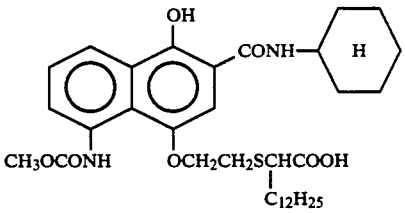
(C-63)
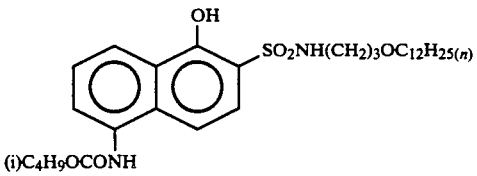
(C-64)
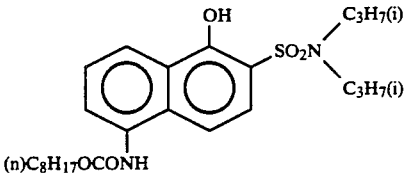

-continued (C-65)

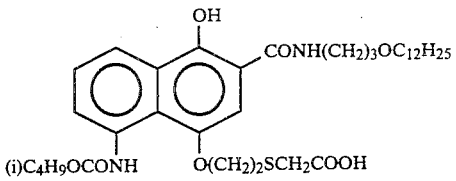

(C-66)

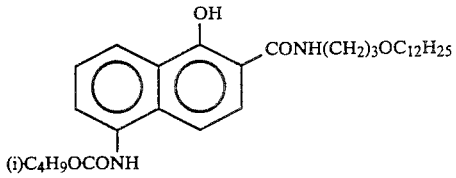

Water-insoluble and organic solvent-soluble polymers which are preferably used in the present invention are non-color-forming couplers and more preferably those having a glass transition temperature of 60° C. or higher, and especially preferably 90° C. or higher. Preferred polymers are those having relative fluorescence quantum yield, K-value, of 0.2 or more, preferably 0.25 or more, and more preferably 0.3 or more. The polymers having higher K-value are more preferred.

The K-value is a relative fluorescence quantum yield, in polymers, of Compound A having the following structure, Compound A being one of the dyes which are often used as fluorescent probes. The K-value is defined by the following equation.

Compound A

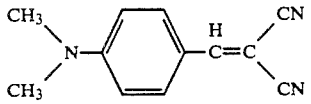

$$K = \phi_a/\phi_b$$

wherein $\phi_a$ and $\phi_b$ are the fluorescence quantum yields of Compound A in polymers a and b, respectively, and determined in accordance with the method described, for example, in *Macromolecules,* 14, 587 (1981).

Specifically, the K-value was calculated using $\phi_a$ and $\phi_b$, which were obtained by measuring at room temperature using thin films of polymers containing Compound A at a concentration of 0.5 mmol/kg (note: the thin films were spin-coated on a slide glass in such a thickness that the absorbance of Compound A at λmax was from 0.05 to 0.1). In the present invention, the K-value specified above was that obtained when poly(-methyl methacrylate) with a number average molecular weight of 20,000 was used as polymer b.

Preferred examples of the polymers are those having the structures described below.

(1) Water-insoluble and organic solvent-soluble homopolymers or copolymers composed of constitutional repeating units having

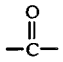

bond in the main chain or side chain thereof.

More preferably the polymer has the structure of 2) water-insoluble and organic solvent-soluble homopolymers or copolymers composed of constitutional repeating units having

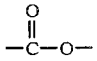

bond in the main chain or side chain thereof; or (3) water-insoluble and organic solvent-soluble homopolymers or copolymers composed of constitutional repeating units having

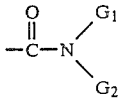

group wherein $G_1$ and $G_2$ each represents a hydrogen atom, or a substituted or unsubstituted alkyl or aryl group, provided that at least one of $G_1$ and $G_2$ is other than a hydrogen atom, in the main chain or side chain thereof.

Among the polymers (3), those in which one of $G_1$ and $G_2$ is a hydrogen atom and the other is a substituted or unsubstituted alkyl or aryl group having from 3 to 12 carbon atoms are especially preferred.

Specific examples of the polymers which may be used in the present invention are described below, which, however, are not limitative.

(A) Vinyl Polymers

As monomers for forming the vinyl polymers for use in the present invention, there are, for example, acrylic acid esters such as methyl acrylate, ethyl acrylate, n-propyl acrylate, isopropyl acrylate, n-butyl acrylate, isobutyl acrylate, sec-butyl acrylate, tert-butyl acrylate, amyl acrylate, hexyl acrylate, 2-ethylhexyl acrylate, octyl acrylate, tert-octyl acrylate, 2-chloroethyl acrylate, 2-bromoethyl acrylate, 4-chlorobutyl acrylate, cyanoethyl acrylate, 2-acetoxyethyl acrylate, dimethylaminoethyl acrylate, benzyl acrylate, methoxybenzyl acrylate, 2-chlorocyclohexyl acrylate, cyclohexyl acrylate, furfuryl acrylate, tetrahydrofurfuryl acrylate, phenyl acrylate, 5-hydroxypentyl acrylate, 2,2-dimethyl-3-hydroxypropyl acrylate, 2-methoxyethyl acrylate, 3-methoxybutyl acrylate, 2-ethoxyethyl acrylate, 2-isopropoxyethyl acrylate, 2-butoxyethyl acrylate, 2-(2-methoxyethoxy)ethyl acrylate, 2-(2-butoxyethoxy)ethyl acrylate, ω-methoxypolyethylene glycol acrylate (number of mols added, n=9), 1-bromo-2-methoxyethyl acrylate and 1,1-dichloro-2-ethoxyethyl acrylate. In addition, the following monomers may also be used.

Methacrylic acid esters, specific examples of which include methyl methacrylate, ethyl methacrylate, n-propyl methacrylate, isopropyl methacrylate, n-butyl methacrylate, isobutyl methacrylate, sec-butyl methacrylate, tert-butyl methacrylate, amyl methacrylate, hexyl methacrylate, cyclohexyl methacrylate, benzyl methacrylate, chlorobenzyl methacrylate, octyl methacrylate, stearyl methacrylate, sulfopropyl methacrylate, N-ethyl-N-phenylaminoethyl methacrylate, 2-(3-phenylpropyloxy)ethyl methacrylate, dimethylaminophenoxyethyl methacrylate, furfuryl methacrylate, tetrahydrofurfuryl methacrylate, phenyl methacrylate, cresyl methacrylate, naphthyl methacrylate, 2-hydroxyethyl methacrylate, 4-hydroxybutyl methacrylate, triethylene glycol monomethacrylate, dipropylene glycol monomethacrylate, 2-methoxyethyl methacrylate, 3-methoxybutyl methacrylate, 2-acetoxyethyl methacrylate, 2-acetacetoxyethyl methacrylate, 2-ethoxyethyl methacrylate, 2-isopropoxyethyl methacrylate, 2-butoxyethyl methacrylate, 2-(2-methoxyethoxy)ethyl methacrylate, 2-(2-ethoxyethoxy)ethyl methacrylate, 2-(2-butoxyethoxy)ethyl methacrylate, ω-methoxypolyethylene glycol methacrylate (number of mols added, n=6), allyl methacrylate and dimethylaminoethyl methacrylate methyl chloride salt.

Vinyl esters, specific examples of which include vinyl acetate, vinyl propionate, vinyl butyrate, vinyl isobutyrate, vinyl caproate, vinyl chloroacetate, vinyl methoxyacetate, vinyl phenylacetate, vinyl benzoate and vinyl salicylate.

Acrylamides, for example, acrylamide, methylacrylamide, ethylacrylamide, propylacrylamide, butylacrylamide, tert-butylacrylamide, cyclohexylacrylamide, benzylacrylamide, hydroxymethylacrylamide, methoxyethylacrylamide, dimethylaminoethylacrylamide, phenylacrylamide, dimethylacrylamide, diethylacrylamide, β-cyanoethylacrylamide, N-(2-acetacetoxyethyl-)acrylamide, diacetoneacrylamide and tert-octylacrylamide.

Methacrylamides, for example, methacrylamide, methyl methacrylamide, ethyl methacrylamide, propyl methacrylamide, butyl methacrylamide, tert-butyl methacrylamide, cyclohexyl methacrylamide, benzyl methacrylamide, hydroxymethyl methacrylamide, methoxyethyl methacrylamide, dimethylaminoethyl methacrylamide, phenyl methacrylamide, dimethyl methacrylamide, diethyl methacrylamide, β-cyanoethyl methacrylamide and N-(2-acetacetoxyethyl) methacrylamide.

Olefins, for example, dicyclopentadiene, ethylene, propylene, 1-butene, 1-pentene, vinyl chloride, vinylidene chloride, isoprene, chloroprene, butadiene and 2,3-dimethylbutadiene.

Styrenes, for example, styrene, methylstyrene, dimethylstyrene, trimethylstyrene, ethylstyrene, isopropylstyrene, chloromethylstyrene, methoxystyrene, acetoxystyrene, chlorostyrene, dichlorostyrene, bromostyrene and methylvinylbenzoate.

Vinyl ethers, for example, methyl vinyl ether, butyl vinyl ether, hexyl vinyl ether, methoxyethyl vinyl ether and dimethylaminoethyl vinyl ether.

In addition, there are butyl crotonate, hexyl crotonate, dimethyl itaconate, dibutyl itaconate, diethyl maleate, dimethyl maleate, dibutyl maleate, diethyl fumarate, dimethyl fumarate, dibutyl fumarate, methyl vinyl ketone, phenyl vinyl ketone, methoxyethyl vinyl ketone, glycidyl acrylate, glycidyl methacrylate, N-vinyloxazolidone, N-vinylpyrrolidone, acrylonitrile, methacrylonitrile, methylene malonenitrile, and vinylidene.

Monomers to be used for preparation of the polymers for use in the present invention (for example, the above-mentioned monomers) may be used in the form of a mixture of two or more monomers as comonomers, in order to achieve the various objects (for example, improvement of solubility of monomers). In addition, for the purpose of adjusting the coloring capacity or solubility of the polymers to be formed, acid group-containing monomers, for example, those mentioned below, can be used as comonomers, provided that the copolymers formed may not be soluble in water.

Such comonomers include acrylic acid; methacrylic acid; itaconic acid; maleic acid; monoalkyl itaconates, such as monomethyl itaconate, monoethyl itaconate, monobutyl itaconate; monoalkyl maleates, such as monomethyl maleate, monoethyl maleate, monobutyl maleate; citraconic acid; styrenesulfonic acid; vinylbenzylsulfonic acid; vinylsulfonic acid; acryloyloxyalkylsulfonic acids, such as acryloyloxymethylsulfonic acid, acryloyloxyethylsulfonic acid, acryloyloxypropylsulfonic acid; methacryloyloxyalkylsulfonic acids, such as methacryloyloxymethylsulfonic acid, methacryloyloxyethylsulfonic acid, methacryloyloxypropylsulfonic acid; acrylamidoalkylsulfonic acid, such as 2-acrylamido-2-methylethanesulfonic acid, 2-acrylamido-2-methylpropanesulfonic acid, 2-acrylamido-2-methylbutanesulfonic acid; and methacrylamidoalkylsulfonic acids, such as 2-methacrylamido-2-methylethanesulfonic acid, 2-methacrylamido-2-methylpropanesulfonic acid, 2-methacrylamido-2-methylbutanesulfonic acid.

These acids may be in the form of a salt with an alkali metal (e.g., Na, K) or an ammonium ion.

When hydrophilic monomers (which are meant to form water-soluble homopolymers) among the above-mentioned vinyl monomers and other vinyl monomers which may be used in the present invention are used as comonomers, the proportion of the hydrophilic monomers in the resulting copolymers is not specifically limited, provided that the copolymers formed are water-insoluble, but, in general, the said proportion is preferably 40 mol% or less, more preferably 20 mol% or less, especially preferably 10 mol% or less. When the hydrophilic comonomers to be copolymerized with the monomers of the invention have an acid group, the proportion of the acid group-containing comonomers in the copolymers formed is generally 20 mol% or less, preferably 10 mol% or less, and most preferably zero (that is, the copolymers formed do not contain such acid group-containing comonomer), from the viewpoint of the aforesaid image storability of photographic materials having the copolymers.

Preferred monomers of forming the polymers for use in the present invention are methacrylate, acrylamide and methacrylamide monomers. Especially preferably these are acrylamide and methacrylamide monomers.

(B) Polymers Formed by Polycondensation and Addition Polymerization

As polymers obtainable by polycondensation, polyesters obtained from polyhydric alcohols and polybasic acids as well as polyamides obtained from diamines, and dibasic acids and ω-amino-ω'-carboxylic acids are generally known. As polymers obtainable by addition polymerization, polyurethanes obtained from diisocyanates and dihydric alcohols are generally known.

As polyhydric alcohols, glycols having a structure of $HO—R_1—OH$, wherein $R_1$ is a hydrocarbon chain, especially an aliphatic hydrocarbon chain, having from 2 to about 12 carbon atoms, or polyalkylene glycols are effective. As polybasic acids, compounds having a structure of $HOOC—R_2—COOH$, wherein $R_2$ is a chemical bond or a hydrocarbon chain having from 1 to about 12 carbon atoms, are effective.

Specific examples of polyhydric alcohols include ethylene glycol, diethylene glycol, triethylene glycol, 1,2-propylene glycol, 1,3-propylene glycol, trimethylolpropane, 1,4-butanediol, isobutylenediol, 1,5-pentanediol, neopentyl glycol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, glycerin, diglycerin, triglycerin, 1-methylglycerin, erythritol, mannitol and sorbitol.

As specific examples of polybasic acids, there are oxalic acid, succinic acid, glutaric acid, adipic acid,.pimelic acid, cork acid, azelaic acid, sebacic acid, nonanedicarboxylic acid, decanedicarboxylic acid, undecanedicarboxylic acid, dodecanedicarboxylic acid, fumaric acid, maleic acid, itaconic acid, citraconic acid, phthalic acid, isophthalic acid, terephthalic acid, tetrachlorophthalic acid, mesaconic acid, isopimelic acid, cyclopentadiene-maleic anhydride adduct, and rosin-maleic anhydride adduct.

Examples of diamines include hydrazine, methylenediamine, ethylenediamine, trimethylenediamine, tetramethylenediamine, hexamethylenediamine, dodecylmethylenediamine, 1,4-diaminocyclohexane, 1,4-diaminomethylcyclohexane, o-aminoaniline, p-aminoaniline, 1,4-diaminomethylbenzene and (4-aminophenyl)ether.

Examples of ω-amino-ω'-carboxylic acids include glycine, β-alanine, 3-aminopropanoic acid, 4-aminobutanoic acid, 5-aminopentanoic acid, 11-aminododecanoic acid, 4-aminobenzoic acid, 4-(2-aminoethyl)benzoic acid and 4-(4-aminophenyl)-butanoic acid.

Diisocyanates include ethylene diisocyanate, hexamethylene diisocyanate, m-phenylene diisocyanate, p-xylene diisocyanate, and 1,5-naphthyl diisocyanate.

(C) Other Polymers

Other polymers which may be used in the present invention include polyesters and polyamides obtained by ring opening polymerization are set forth below. For instance, there is

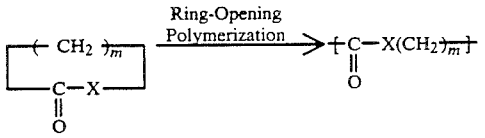

wherein X represents —O— or —NH—; m represents an integer of from 4 to 7; and $-(CH_2)_m-$ may be branched.

Examples of such monomers include β-propiolactone, ω-caprolactone, dimethylpropiolactone, α-pyrrolidone, α-piperidone, ω-caprolactam, and α-methyl-ω-caprolactam.

The above-mentioned polymers for use in the present invention may be used in the form of a free combination of two or more thereof, in accordance with the present invention.

The molecular weight and the polymerization degree of the polymers of the present invention does not have an substantially meaningful influence on the effects attainable by the invention. However, if the molecular weight of the polymer used is too large, there would be some problems in that a longer time would be necessary to dissolve the polymer in an auxiliary solvent and the polymer might be insufficiently emulsified and dispersed because of the high viscosity of the polymer-containing solution so that coarse grains would often be formed in the resulting dispersion. As a result, the coloring capacity of the photographic material containing such dispersion would be poor or the coatability of such dispersion-containing composition on a support would also be poor. If a large amount of an auxiliary solvent is used to lower the viscosity of the solution for the purpose of overcoming the said problems, there would occur another problem in the manufacturing step of photographic materials. On these grounds, the viscosity of the polymers for use in the present invention would be preferably 5,000 cps or less, more preferably 2,000 cps or less, when 30 g of a polymer is dissolved in 100 cc of an auxiliary solvent. In this connection, the molecular weight of the polymers for use in the present invention is preferably 150,000 or less, and more preferably 100,000 or less.

The water-insoluble polymers as referred to in the present invention are those having a solubility of 3 g or less, preferably 1 g or less, to 100 g of a distilled water.

The proportion of the polymer to the auxiliary solvent to be used therefor in accordance with the present invention varies depending upon the kind of the polymer used. Further, it varies in a broad range also depending upon the solubility of the polymer to the auxiliary solvent used, the polymerization degree of the polymer as well as the solubility of couplers into the polymer. In general, the auxiliary solvent is used in a necessary amount such that the solution obtained by dissolving at least three of couplers, high boiling point coupler solvent and polymer in the auxiliary solvent, may be sufficiently low viscous so that this may easily be dispersed in water or in an aqueous hydrophilic colloid solution. Since the viscosity of the solution would become higher with increase of the polymerization degree of the polymer used, it would be difficult to indiscriminately determine the proportion of the polymer to the auxiliary solvent irrespective of the kind of the polymer, but, in general, the proportion is desirably from about 1/1 to about 1/50 (by weight). The proportion of the polymer of the invention to the coupler to be used is preferably from 1/20 to 20/1, more preferably from 1/10 to 10/1, by weight.

Some of specific examples of the polymers which may be used in the present invention are set forth below, which, however, are not limitative.

(P- 1) Polyvinyl Acetate
(P- 2) Polyvinyl Propionate
(P- 3) Polymethyl Methacrylate
(P- 4) Polyethylene Methacrylate
(P- 5) Polyethyl Acrylate
(P- 6) Vinyl Acetate-Vinyl Alcohol Copolymer (95/5)
(P- 7) Poly-n-butyl Acrylate
(P- 8) Poly-n-butyl Methacrylate
(P- 9) Polyisobutyl Methacrylate
(P- 10) Polyisopropyl Methacrylate
(P- 11) Polydecyl Methacrylate
(P- 12) Acrylate-Acrylamide Copolymer (95/5)
(P- 13) Polymethyl Chloroacrylate
(P- 14) 1,4-Butanediol-Adipic Acid Polyester
(P- 15) Ethylene Glycol-Sebacic Acid Polyester
(P- 16) Polycaprolactone
(P- 17) Poly(2-tert-butylphenyl Acrylate)
(P- 18) Poly(4-tert-butylphenyl Acrylate)
(P- 19) n-Butyl Methacrylate-N-Vinyl-2-pyrrolidone Copolymer (90/10)
(P- 20) Methyl Methacrylate-Vinyl Chloride Copolymer (70/30)
(P- 21) Methyl Methacrylate-Styrene Copolymer (90/10) (P- 22) Methyl Methacrylate-Ethyl Acrylate Copolymer (50/50)
(P- 23) n-Butyl Methacrylate-Methyl Methacrylate-Styrene Copolymer (50/30/20)
(P- 24) Vinyl Acetate-Acrylamide Copolymer (85/15)
(P- 25) Vinyl Chloride-Vinyl Acetate Copolymer (65/35)

(P- 26) Methyl Methacrylate-Acrylonitrile Copolymer (65/35)
(P- 27) Diacetoneacrylamide-Methyl Methacrylate Copolymer (50/50)
(P- 28) Vinyl Methyl Ketone-Isobutyl Methacrylate Copolymer (55/45)
(P- 29) Ethyl Methacrylate-n-Butyl Acrylate Copolymer (70/30)
(P- 30) Diacetoneacrylamide-n-Butyl Acrylate Copolymer (60/40)
(P- 31) Methyl Methacrylate-Cyclohexyl Methacrylate Copolymer (50/50)
(P- 32) n-Butyl Acrylate-Phenyl Methacrylate-Diacetoneacrylamide Copolymer (70/20/10)
(P- 33) N-tert-Butyl Methacrylamide-Methyl Methacrylate-Acrylic Acid Copolymer (60/30/10)
(P- 34) Methyl Methacrylate-Styrene-Vinylsulfonamide Copolymer (70/20/10)
(P- 35) Methyl Methacrylate-Phenyl Vinyl Ketone Copolymer (70/30)
(P- 36) n-Butyl Acrylate-Methyl Methacrylate-n-Butyl Methacrylate Copolymer (35/35/30)
(P- 37) n-Butyl Methacrylate-Pentyl Methacrylate-N-Vinyl-2-pyrrolidone Copolymer (38/38/24)
(P- 38) Methyl Methacrylate-n-Butyl Methacrylate-Isobutyl Methacrylate-Acrylic Acid Copolymer (37/29/25/9)
(P- 39) n-Butyl Methacrylate-Acrylic Acid Copolymer (95/5)
(P- 40) Methyl Methacrylate-Acrylic Acid Copolymer (95/5)
(P- 41) Benzyl Methacrylate-Acrylic Acid Copolymer (90/10)
(P- 42) n-Butyl Methacrylate-Methyl Methacrylate-Benzyl Methacrylate-Acrylic Acid Copolymer (35/35/25/5)
(P- 43) n-Butyl Methacrylate-Methyl Methacrylate-Benzyl Methacrylate Copolymer (35/35/30)
(P- 44) Poly-3-pentyl Acrylate
(P- 45) Cyclohexyl Methacrylate-Methyl Methacrylate-n-Propyl Methacrylate Copolymer (37/29/34)
(P- 46) Polypentyl Methacrylate
(P- 47) Methyl Methacrylate-n-Butyl Methacrylate Copolymer (65/35)
Vinyl Acetate-Vinyl Propionate Copolymer (75/25)
(P- 49) n-Butyl Methacrylate-Sodium 3-Acryloxybutane-1-sulfonate Copolymer (97/3)
(P- 50) n-Butyl Methacrylate-Methyl Methacrylate-Acrylamide Copolymer (35/35/30)
(P- 51) n-Butyl Methacrylate-Methyl Methacrylate-Vinyl Chloride Copolymer (37/36/27)
(P- 52) n-Butyl Methacrylate-Styrene Copolymer (90/10)
(P- 53) Methyl Methacrylate-N-Vinyl-2-pyrrolidone Copolymer (90/10)
(P- 54) n-Butyl Methacrylate-Vinyl Chloride Copolymer (90/10)
(P- 55) n-Butyl Methacrylate-Styrene Copolymer (70/30)
(P- 56) Poly(N-sec-butylacrylamide)
(P- 57) Poly(N-tert-butylacrylamide)
(P- 58) Diacetoneacrylamide-Methyl Methacrylate Copolymer (62/38)
(P- 59) Polycyclohexyl Methacrylate-Methyl Methacrylate Copolymer (60/40)
(P- 60) N-tert-Butylacrylamide-Methyl Methacrylate Copolymer (40/60)
(P- 61) Poly(N-n-butylacrylamide)
(P- 62) Poly(tert-butyl Methacrylate)-N-tert-butylacrylamide Copolymer (50/50)
(P- 63) tert-Butyl Methacrylate-Methyl Methacrylate Copolymer (70/30)
(P- 64) Poly(N-tert-butyl Methacrylamide)
(P- 65) N-tert-Butylacrylamide-Methyl Methacrylate Copolymer (60/40)
(P- 66) Methyl Methacrylate-Acrylonitrile Copolymer (70/30)
(P- 67) Methyl Methacrylate-Vinyl Methyl Ketone Copolymer (38/62)
(P- 68) Methyl Methacrylate-Styrene Copolymer (75/25)
(P- 69) Methyl Methacrylate-Hexyl Methacrylate Copolymer (70/30)
(P- 70) Poly(benzyl Acrylate)
(P- 71) Poly(4-biphenyl Acrylate)
(P- 72) Poly(4-butoxycarbonylphenyl Acrylate)
(P- 73) Poly(sec-butyl Acrylate)
(P- 74) Poly(tert-butyl Acrylate)
(P- 75) Poly[3-chloro-2,2-bis(chloromethyl)propyl Acrylate]
(P- 76) Poly(2-chlorophenyl Acrylate)
(P- 77) Poly(4-chlorophenyl Acrylate)
(P- 78) Poly(pentachlorophenyl Acrylate)
(P- 79) Poly(4-cyanobenzyl Acrylate)
(P- 80) Poly(cyanoethyl Acrylate)
(P- 81) Poly(4-cyanophenyl Acrylate)
(P- 82) Poly(4-cyano-3-thiabutyl Acrylate)
(P- 83) Poly(cyclohexyl Acrylate)
(P- 84) Poly(2-ethoxycarbonylphenyl Acrylate)
(P- 85) Poly(3-ethoxycarbonylphenyl Acrylate)
(P- 86) Poly(4-ethoxycarbonylphenyl Acrylate)
(P- 87) Poly(2-ethoxyethyl Acrylate)
(P- 88) Poly(3-ethoxypropyl Acrylate)
(P- 89) Poly(1H,1H,5H-octafluoropentyl Acrylate)
(P- 90) Poly(heptyl Acrylate)
(P- 91) Poly(hexadecyl Acrylate)
(P- 92) Poly(hexyl Acrylate)
(P- 93) Poly(isobutyl Acrylate)
(P- 94) Poly(isopropyl Acrylate)
(P- 95) Poly(3-methoxybutyl Acrylate)
(P- 96) Poly(2-methoxycarbonylphenyl Acrylate)
(P- 97) Poly(3-methoxycarbonylphenyl Acrylate)
(P- 98) Poly(4-methoxycarbonylphenyl Acrylate)
(P- 99) Poly(2-methoxyethyl Acrylate)
(P-100) Poly(4-methoxyphenyl Acrylate)
(P-101) Poly(3-methoxypropyl Acrylate)
(P-102) Poly(3,5-dimethyladamantyl Acrylate)
(P-103) Poly(3-dimethylaminophenyl Acrylate)
(P-104) Polyvinyl tert-Butyrate
(P-105) Poly(2-methylbutyl Acrylate)
(P-106) Poly(3-methylbutyl Acrylate)
(P-107) Poly(1,3-dimethylbutyl Acrylate)
(P-108) Poly(2-methylpentyl Acrylate)
(P-109) Poly(2-naphthyl Acrylate)
(P-110) Poly(phenyl Methacrylate)
(P-111) Poly(propyl Acrylate)
(P-112) Poly(m-tolyl Acrylate)
(P-113) Poly(o-tolyl Acrylate)
(P-114) Poly(p-tolyl Acrylate)
(P-115) Poly(N,N-dibutylacrylamide)
(P-116) Poly(isohexylacrylamide)
(P-117) Poly(isooctylacrylamide)
(P-118) Poly(N-methyl-N-phenylacrylamide)
(P-119) Poly(adamantyl Methacrylate)
(P-120) Poly(benzyl Methacrylate)
(P-121) Poly(2-bromoethyl Methacrylate)

(P-122) Poly(2-N-tert-butylaminoethyl Methacrylate)
(P-123) Poly(sec-butyl Methacrylate)
(P-124) Poly(tert-butyl Methacrylate)
(P-125) Poly(2-chloroethyl Methacrylate)
(P-126) Poly(2-cyanoethyl Methacrylate)
(P-127) Poly(2-cyanomethylphenyl Methacrylate)
(P-128) Poly(4-cyanophenyl Methacrylate)
(P-129) Poly(cyclohexyl Methacrylate)
(P-130) Poly(dodecyl Methacrylate)
(P-131) Poly(diethylaminoethyl Methacrylate)
(P-132) Poly(2-ethylsulfinylethyl Methacrylate)
(P-133) Poly(hexadecyl Methacrylate)
(P-134) Poly(hexyl Methacrylate)
(P-135) Poly(2-hyiroxypropyl Methacrylate)
(P-136) Poly(4-methoxycarbonylphenyl Methacrylate)
(P-137) Poly(3,5-dimethyladamantyl Methacrylate)
(P-138) Poly(dimethylaminoethyl Methacrylate)
(P-139) Poly(3,3-dimethylbutyl Methacrylate)
(P-140) Poly(3,3-dimethyl-2-butyl Methacrylate)
(P-141) Poly(3,5,5 TM trimethylhexyl Methacrylate)
(P-142) Poly(octadecyl Methacrylate)
(P-143) Poly(tetradecyl Methacrylate)
(P-144) Poly(4-butoxycarbonylphenylmethacrylamide)
(P-145) Poly(4-carboxyphenylmethacrylamide)
(P-146) Poly(4-ethoxycarbonylphenylmethacrylamide)
(P-147) Poly(4-methoxycarbonylphenylmethacrylamide)
(P-148) Poly(butylbutoxycarbonyl Methacrylate)
(P-149) Poly(butyl Chloroacrylate)
(P-150) Poly(butyl Cyanoacrylate)
(P-151) Poly(cyclohexyl Chloroacrylate)
(P-152) Poly(ethyl Chloroacrylate)
(P-153) Poly(ethylethoxycarbonyl Methacrylate)
(P-154) Poly(ethyl Ethacrylate)
(P-155) Poly(ethyl Fluoronethacrylate)
(P-156) Poly(hexyl Hexyloxycarbonyl Methacrylate)
(P-157) Poly(isobutyl Chloroacrylate)
(P-158) Poly(isopropyl Chloroacrylate)
(P-159) Trimethylenediamine Glutaric Acid Polyamide
(P-160) Hexamethylenediamine Adipic Acid Polyamide
(P-161) Poly(α-pyrrolidone)
(P-162) Poly(ε-caprolactam)
(P-163) Hexamethylenediisocyanate-1,4-Butanediol Polyurethane
(P-164) p-Phenylenediisocyanate-Ethylene Glycol Polyurethane The polymers for use in the present invention may be prepared, for example, as mentioned below.

PRODUCTION EXAMPLE 1

Production of Polymethyl Methacrylate (P-3)

50.0 g of methyl methacrylate, 0.5 g of sodium polyacrylate and 200 ml of distilled water were put in a 500 ml three-neck flask and heated to 80° C with stirring in nitrogen stream. 500 mg of dimethyl azobisisobutyrate was added as a polymerization initiator and polymerization was started.

After polymerization for 2 hours, the polymer liquid was cooled and 48.7 g of.(P-3) (polymer beads) was obtained by filtering and washing with water.

PRODUCTION EXAMPLE 2

Production of Poly(N-tert-butylacrylamide) (P-57)

A mixture of 50.0 g of N-tert-butylacrylamide and 250 ml of toluene was put in a 500 ml three-neck flask and heated to 80° C with stirring in nitrogen stream. 10 ml of a toluene solution containing 500 mg of azobisisobutyronitrile as a polymerization initiator was added to the mixture and polymerization was started.

After polymerization for 3 hours, the polymer liquid was cooled and poured into 1 liter of hexane. The solid precipitated was filtered out and washed with hexane. This was heated under reduced pressure and dried to obtain 47.9 g of (P-57).

The amount of the polymer to be added in accordance with the present invention is suitably from 5 to 250% by weight, and more preferably from 20 to 150% by weight, with respect to the coupler.

The compounds of the formula (III) for use in the present invention will be mentioned in detail hereunder.

In the formula (III), $R_1$ and $R_2$ each represents $-COOR_5$ or

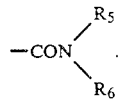

$R_3$ and $R_4$ each represents a hydrogen atom or an alkyl group (e.g., methyl, ethyl). $R_5$ and $R_6$ each represents a hydrogen atom, an alkyl group (e.g., methyl, ethyl, isopropyl, butyl), a substituted alkyl group (where the substituent(s) is(are) selected from a sulfo group(s) (e.g., sulfomethyl, sulfoethyl), a carboxyl group(s) (e.g., carboxymethyl, carboxyethyl), a hydroxyl group(s) (e.g., hydroxyethyl, 1,2-dihydroxypropyl), an alkoxy group(s) (e.g., methoxyethyl, ethoxyethyl), a halogen atom(s) (for example, fluorine, chlorine, bromine; e.g., 2-chloroethyl, 2-bromoethyl, 2,2,2-trifluoroethyl), a cyano group(s) (e.g., cyanoethyl), a sulfonyl group(s) (e.g., methanesulfonylethyl), a nitro group(s) (e.g., 2-nitrobutyl, 2-nitro-2-methylpropyl), an amino group(s) (e.g., dimethylaminoethyl, diethylaminopropyl), an aryl group(s) (e.g., benzyl, p-chlorobenzyl)), a phenyl group, or a substituted phenyl group (where the substituent(s) is(are) selected from a sulfo group(s) (e.g., p-sulfophenyl, o-, m-disulfophenyl), a carboxyl group(s) (e.g., p-carboxyphenyl m-carboxyphenyl), a hydroxyl-group(s) (e.g., p-hydroxyphenyl, m-hydroxyphenyl), an alkoxy group(s) (e.g., p-methoxyphenyl, m-ethoxyphenyl), a halogen atom(s) (e.g., p-chlorophenyl, p-bromophenyl, p-fluorophenyl), a cyano group(s) (e.g., p-cyanophenyl, o-cyanophenyl), a nitro group(s) (e.g., p-nitrophenyl, m-nitrophenyl), an amino group(s) (e.9., p-dimethylaninophenyl, p-diethylaminophenyl), an alkyl group(s) (e.g., p-methylphenyl, o-methylphenyl)). $R_4$ and $R_5$ may together form a 5-membered or 6-membered ring (e.g., morpholino, piperidino). $Q_1$ and $Q_2$ each represents an aryl group (e.g., phenyl, naphthyl) or a substituted phenyl group (where the substituent(s) is(are) selected from an alkyl group(s) each having from 1 to 4 carbon atoms, an alkoxy group(s) each having from 1 to 4 carbon atoms, a halogen atom(s) (e.g., chlorine, bromine, fluorine), a carbamoyl group(s) (e.g., ethylcarbamoyl), a sulfamoyl group(s) (e.g., ethylsulfamoyl), a cyano group(s), a nitro group(s), an alkylsulfonyl group(s) (e.g., methanesulfonyl), an arylsulfonyl group(s) (e.g., benzenesulfonyl), an amino group(s) (e.g., dimethylamino), an acylamino group(s) (e.g., acetylamino), a sulfonamido group(s) (e.g., methanesulfonamido)). $X_1$ and $X_2$ each represents a divalent linking group. More precisely, they each represents $$-O-,\ -\overset{R_7}{\overset{|}{N}}-,\ -\overset{R_7}{\overset{|}{N}}-CO-,\ -SO_2-,\ -\overset{R_7}{\overset{|}{N}}-SO_2-$$

or a bond. $R_7$ represents a hydrogen atom, an alkyl group having 5 or less carbon atoms, a substituted alkyl group where the alkyl moiety has 5 or less carbon atoms (where the substituent(s) is(are) selected from an alkoxy group(s) having 3 or less carbon atoms, a sulfo group(s) (e.g., sulfoethyl, sulfopropyl), a carboxyl group(s) (e.g., carboxyethyl), a cyano group(s), a hydroxyl group(s), an amino group(s) (e.g , hydroxmethyl), a sulfonamido group(s) (e.g., methanesulfonamido), a carbonauaido group(s) (e.g., acetylamino), a carbamoyl group(s) (e.g., ethylaninocarbonyl), and/or a sulfamoyl group(s) (e.g., ethylaminosulfonyl)) $Y_1$ and $Y_2$ each represents a sulfo group or a carboxyl group, which may be in the form of not only a free acid but also a salt (e.g., a sodium salt, a potassium salt, an ammonium salt, a quaternary ammonium salt). $L_1$, $L_2$, and $L_3$ each represents a methine group or a substituted methine group (where the substituent(s) may be selected from methyl, ethyl and phenyl). $m_1$ and $m_2$ each represents 1 or 2; n represents 0, 1, or 2; $p_1$ and $p_2$ each represents 0,1,2, 3, or 4; and $s_1$ and $s_2$ each represents 1 or 2.

Among the compounds of the formula (III), those where $R_3$ and $R_4$ each represents a hydrogen atom or a methyl group, $R_5$ and $R_6$ each represents a hydrogen atom, an alkyl group having 4 or less carbon atoms, a substituted alkyl group having 6 or less carbon atoms (where the substituent(s) is(are) preferably selected from a sulfo group, a carboxyl group, a hydroxyl group, an alkoxy group having 2 or less carbon atoms, a chlorine atom, a cyano group, an amino group, and an alkylamino group having 4 or less carbon atoms), a phenyl group or a substituted phenyl group (where the substituent(s) is(are) preferably selected from a sulfo group, a carboxyl group, an alkoxy group having 4 or less carbon atoms, a chlorine atom, a cyano group, an alkyl group having 4 or less carbon atoms, an amino group and an alkylamino group having 4 or less carbon atoms), or $R_5$ and $R_6$ together form a 5-membered or 6-membered ring (e.g., a morpholino ring, a pyrrolidine ring or a piperidine ring) are preferred.

$Q_1$ and $Q_2$ each is preferably a phenyl group or a substituted phenyl group (where the substituent(s) is(are) preferably selected from an alkyl group having 4 or less carbon atoms, an alkoxy group having 4 or less carbon atoms, a halogen atom (e.g., chlorine, bromine, fluorine) and a dialkylamino group having 4 or less carbon atoms).

$X_1$ and $X_2$ each is preferably —O—, $$-\overset{R_7}{\overset{|}{N}}-$$

or a chemical bond, in which $R_7$ is preferably a hydrogen atom, an alkyl group having 5 or less carbon atoms or a substituted alkyl group where the alkyl moiety has 5 or less carbon atoms (where the substituent(s) is(are) selected from an alkoxy group having 3 or less carbon atoms, a cyano group, a hydroxyl group, and an alkylamino group having 4 or less carbon atoms).

In particular, the dyes of formula (III) wherein $m_1 = m_21$ are especially preferred.

Specific examples of dyes of formula (III) for use in the present invention are set forth below, which, however, are not limitative.

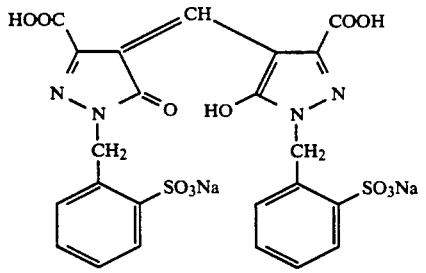

1

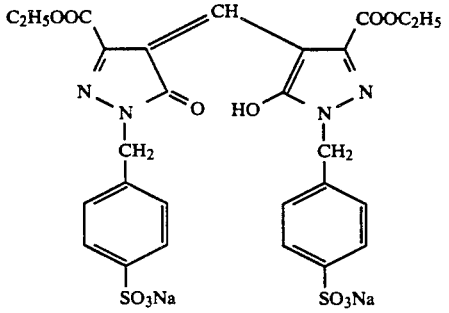

2

-continued
3
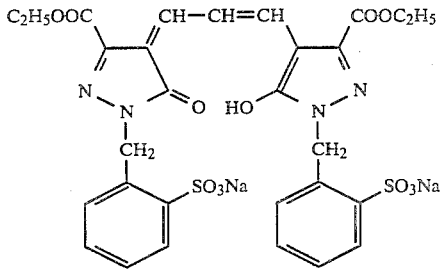
4
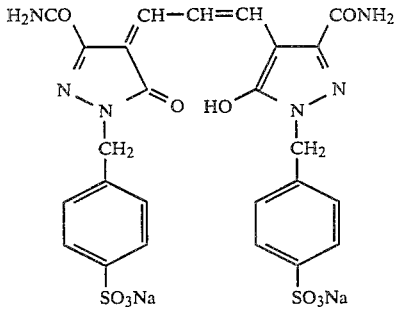
5
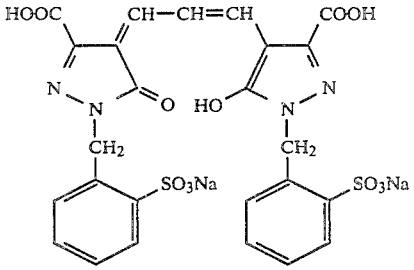
6
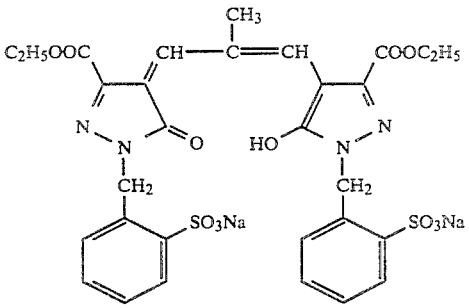
7
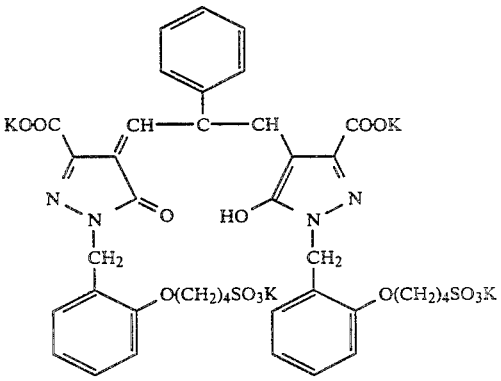

-continued
8
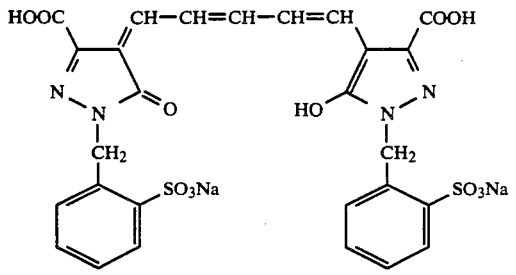
9
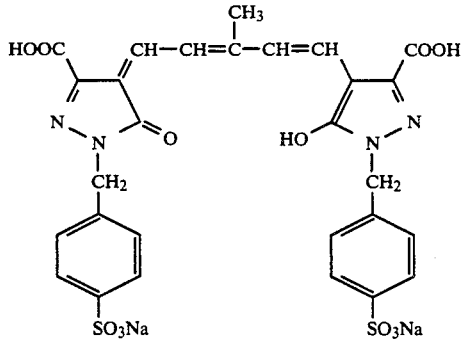
10
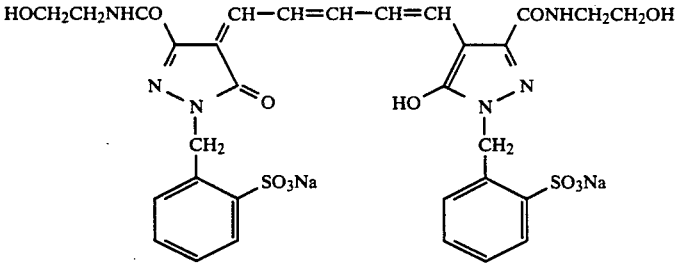
11
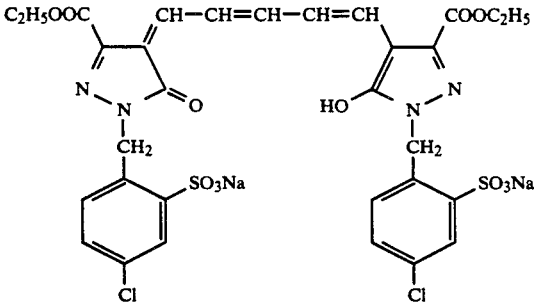
12
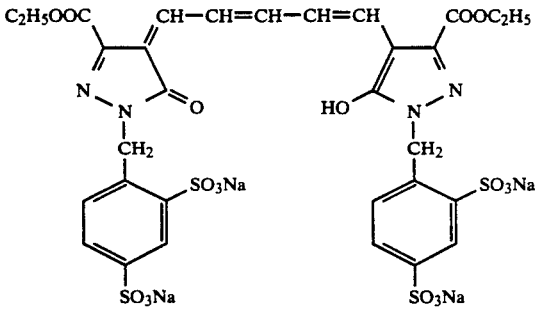

-continued
13
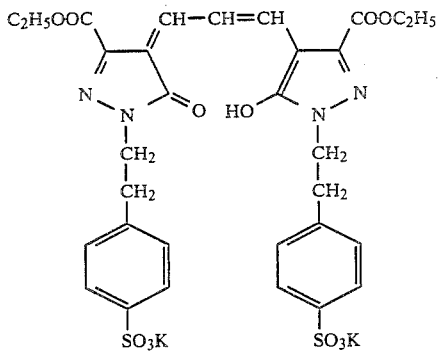
14
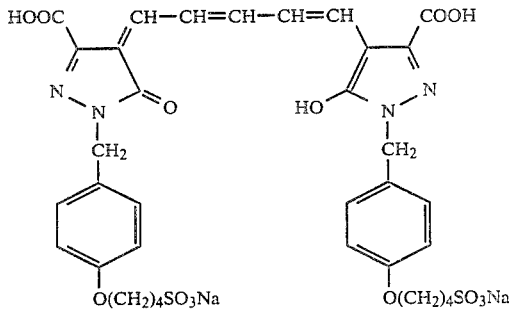
15
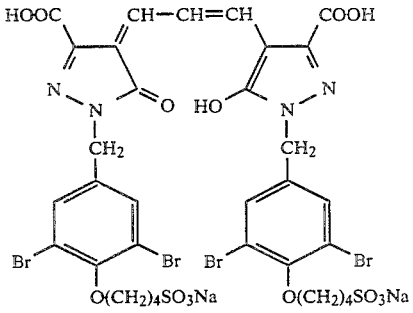
16
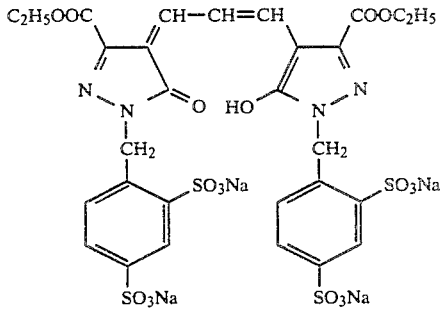
17
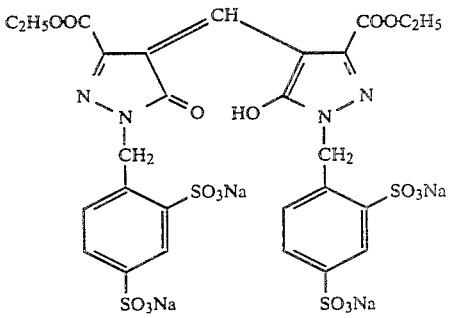

-continued
18
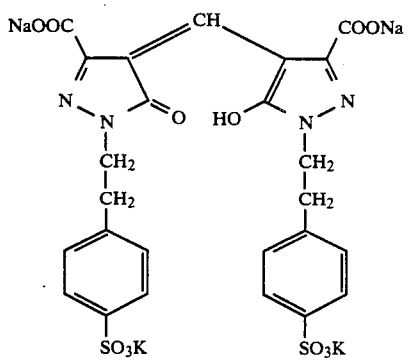
19
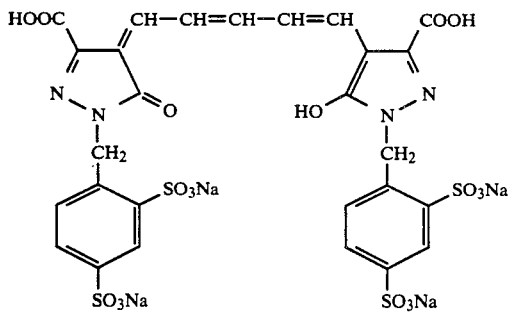
20
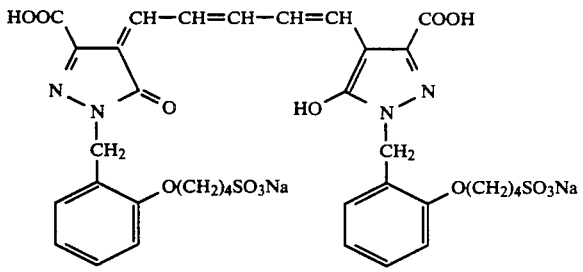
21
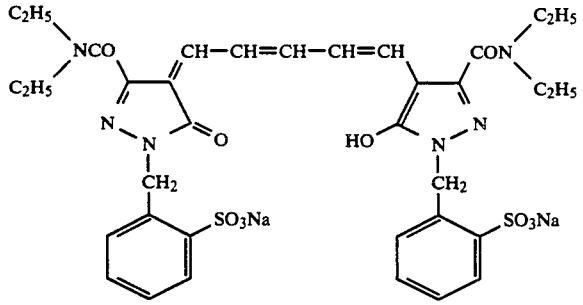
22
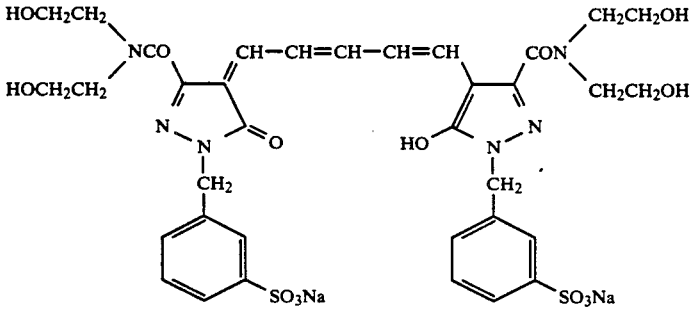

-continued
23
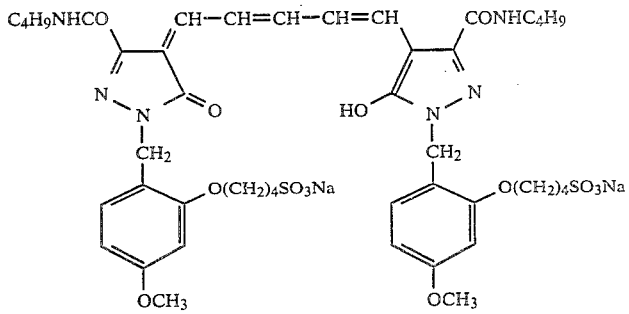
24
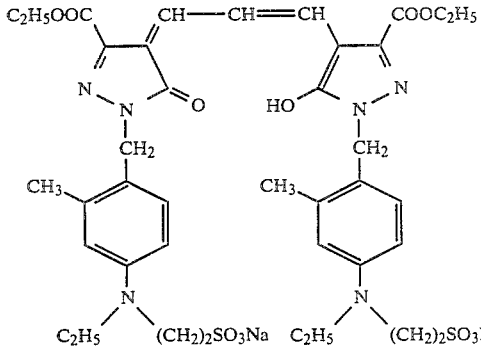
25
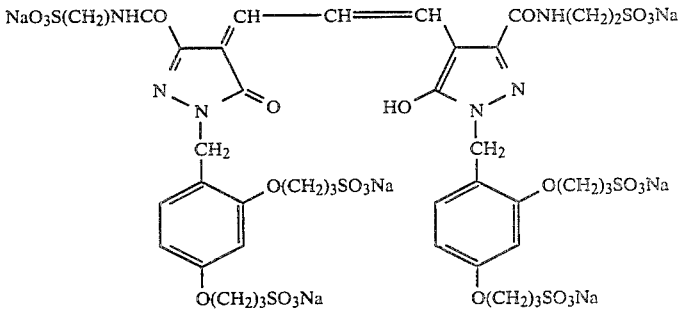
26
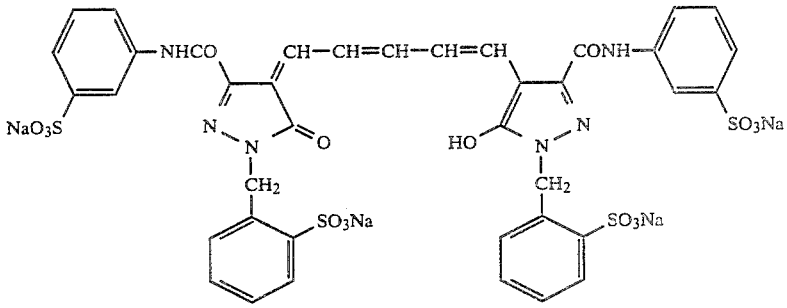
27
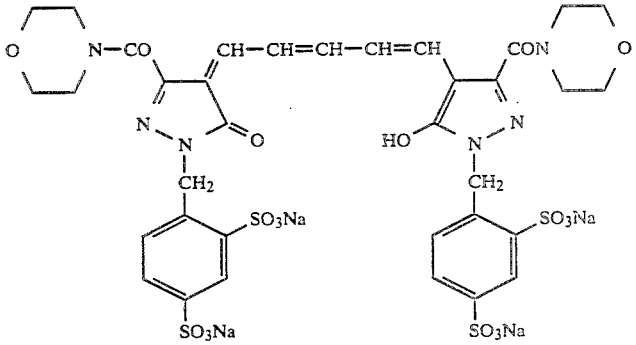

-continued
28
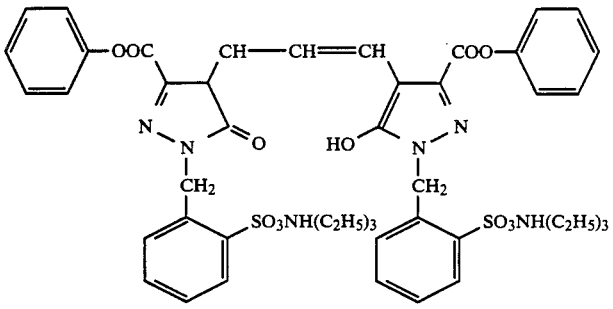
29
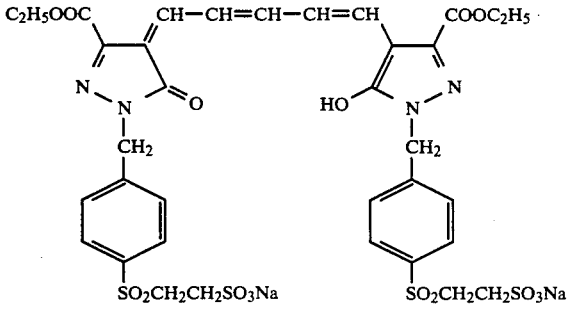
30
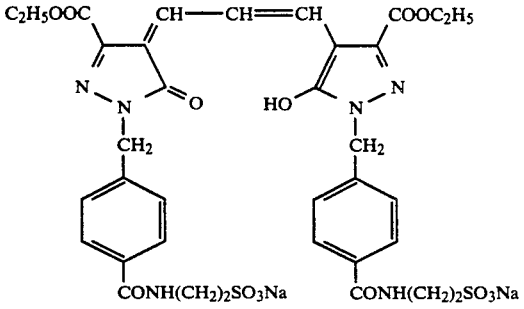
31
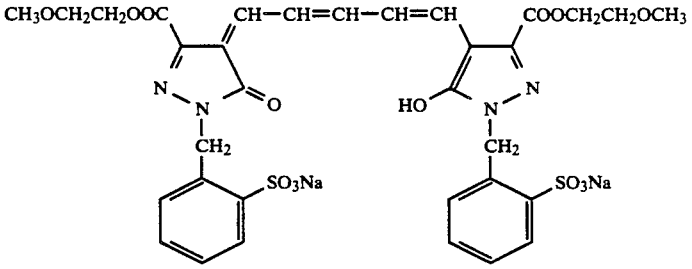
32
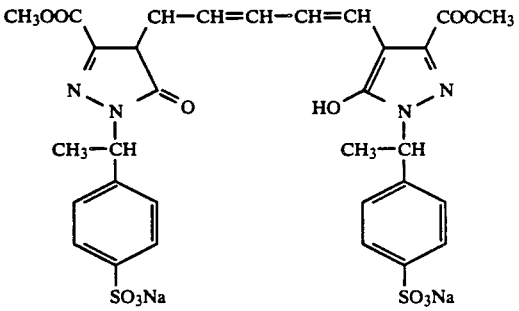

-continued
33
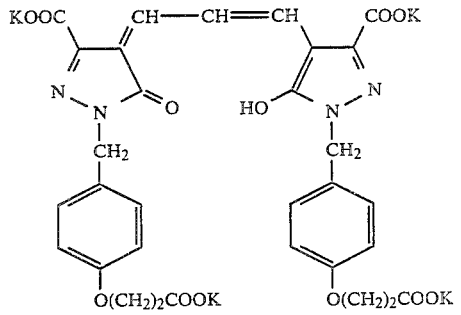
34
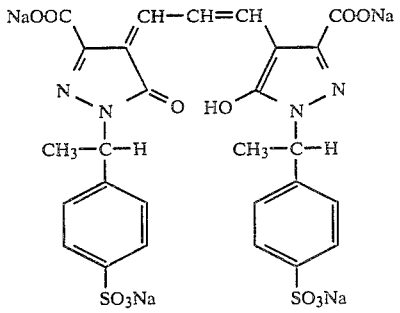
35
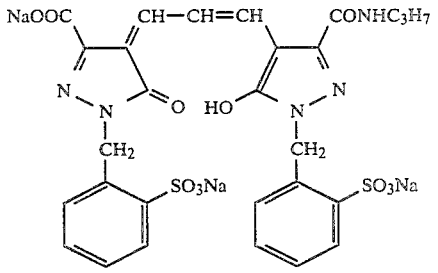
36
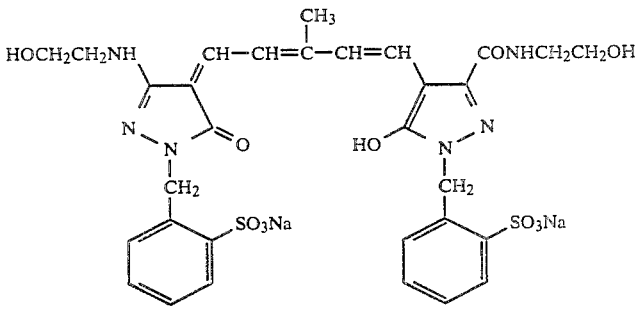
37
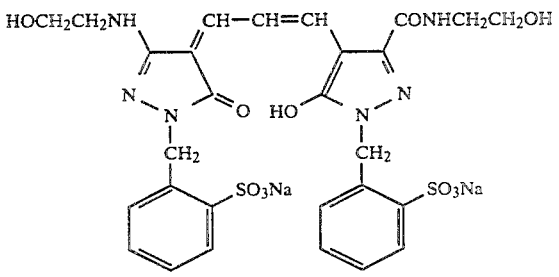

-continued
38
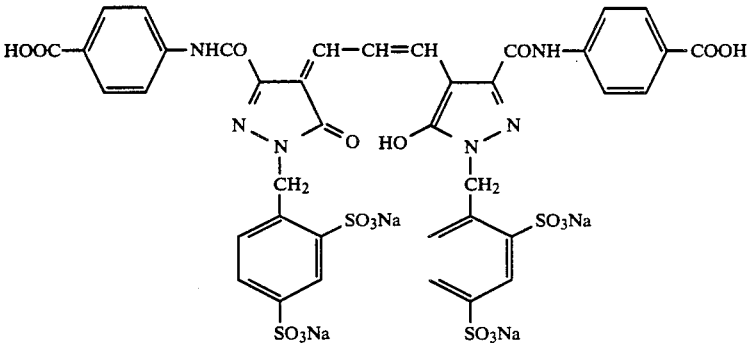
39
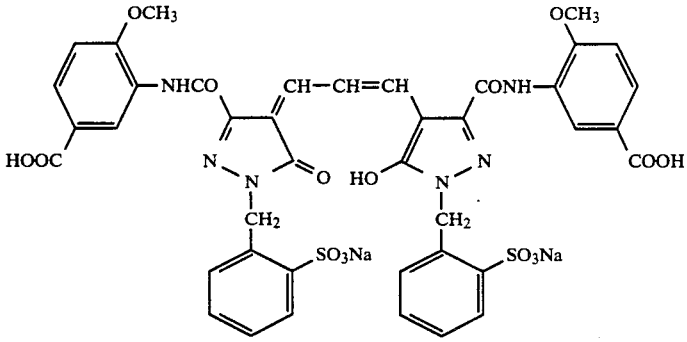
40
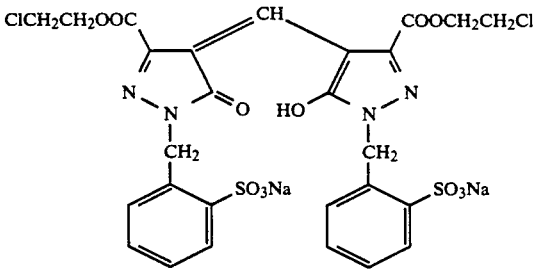
41
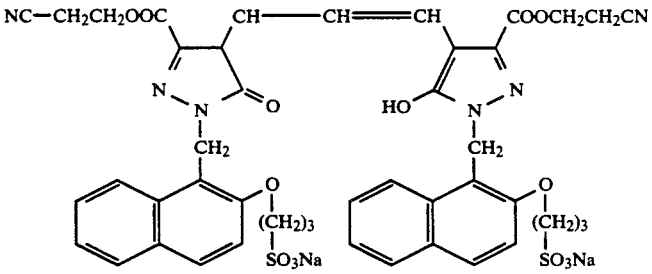
42
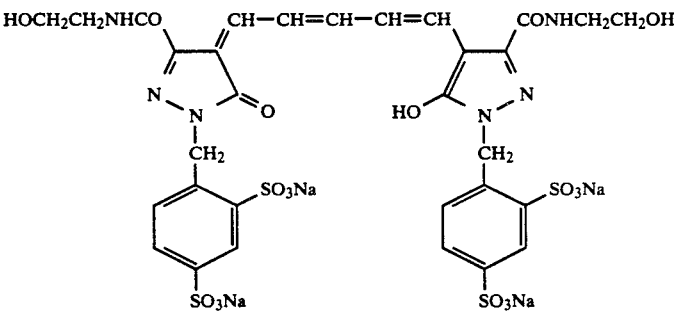

-continued
43
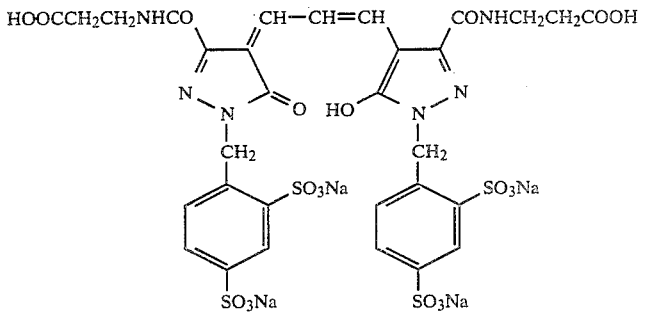
44
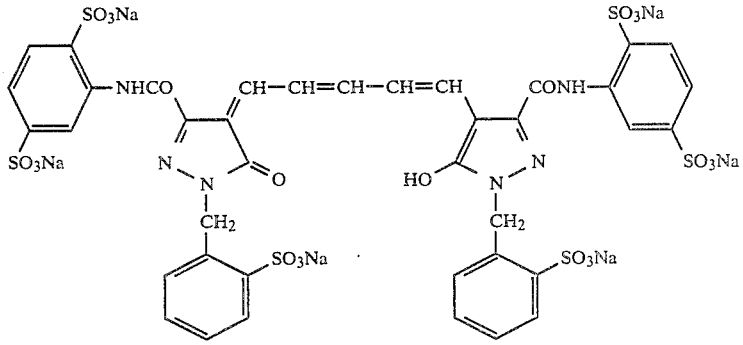
45
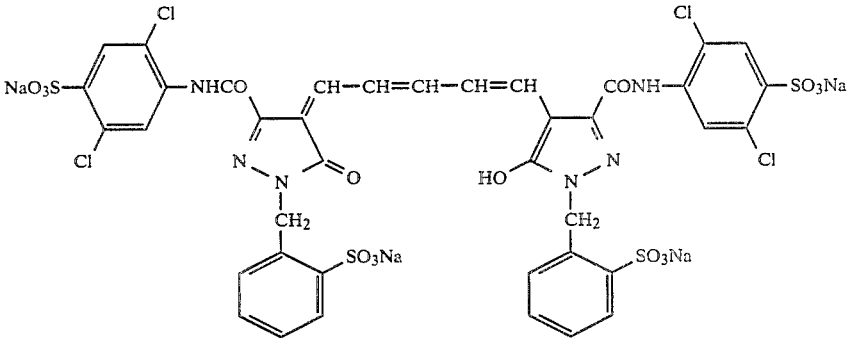
46
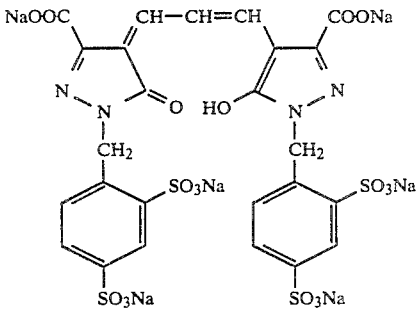
47
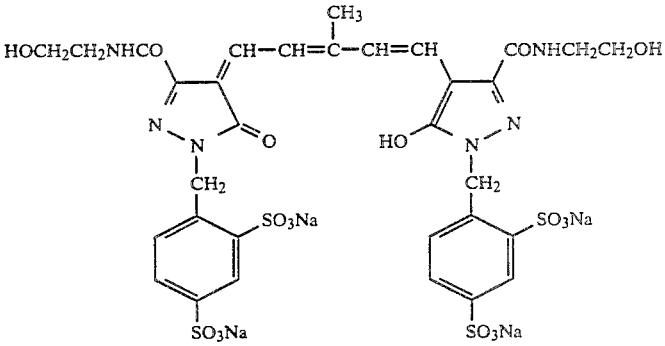

-continued
48
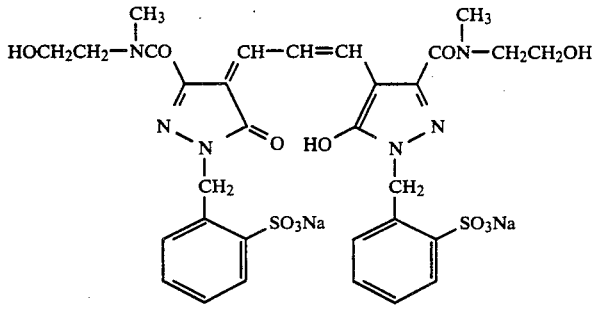
49
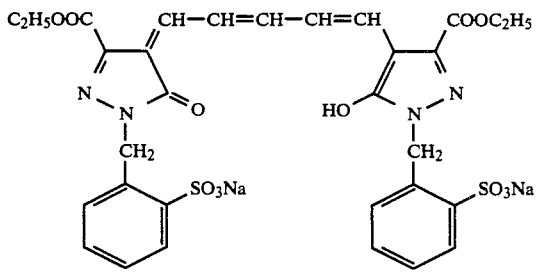
50
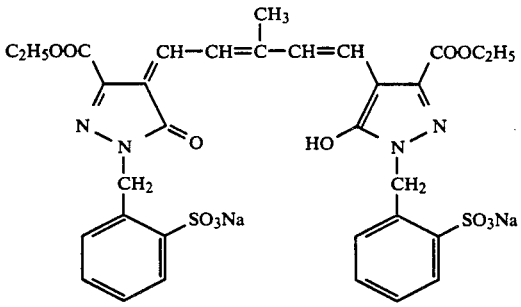
51
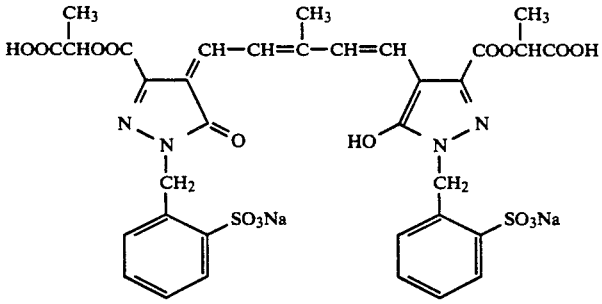
Specific examples of magenta and yellow couplers which may be used in the green-sensitive layer and the blue-sensitive layer in the photographic materials of the present invention are set forth below, which, however, are not limitative.

Magenta Couplers:
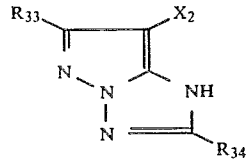
| Compound No. | $R_{33}$ | $R_{34}$ | $X_2$ |
|---|---|---|---|
| M-1 | $CH_3$— | 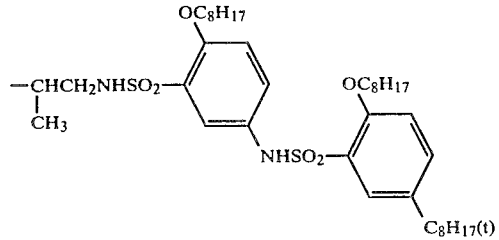 | Cl |
| M-2 | " | 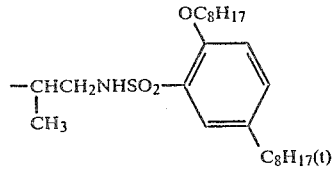 | Cl |
| M-3 | " | 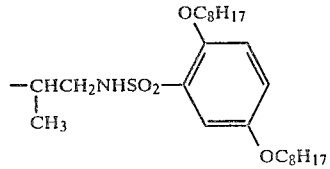 | 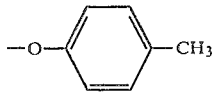 |
| M-4 | 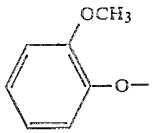 | 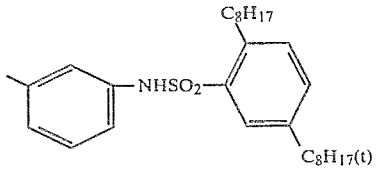 | 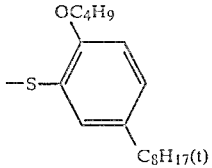 |

-continued
| | | | |
|---|---|---|---|
| M-5 | $CH_3$— | 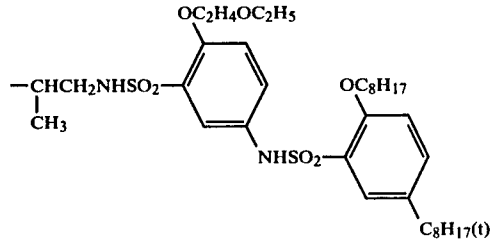 | Cl |
| M-6 | " | 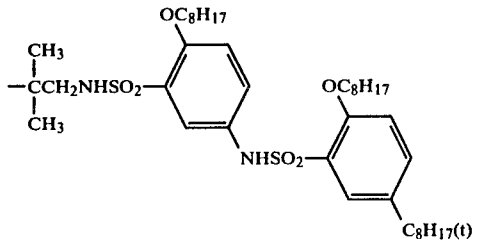 | Cl |
| M-7 | 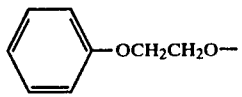 | 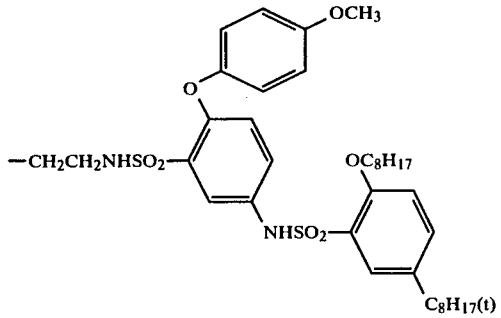 | 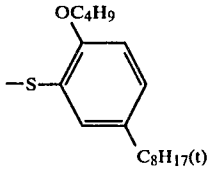 |
| M-8 | $CH_3CH_2O$— | " | " |
| M-9 | 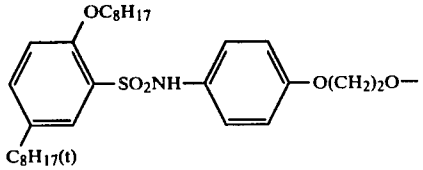 | 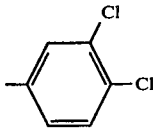 | " |

-continued
| | | | |
|---|---|---|---|
| M-10 | 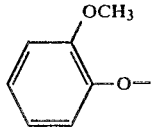 | 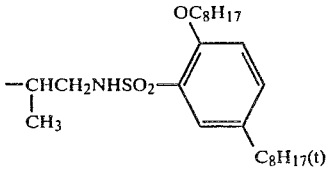 | Cl |
| | | 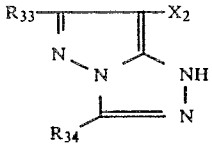 | |
| M-11 | $CH_3$— | 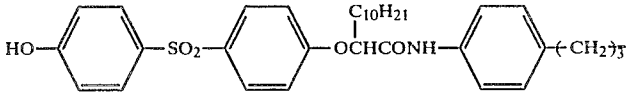 | Cl |
| M-12 | " | 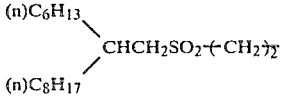 | Cl |
| M-13 | 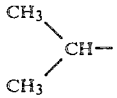 | 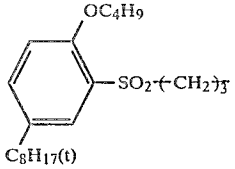 | Cl |
| M-14 | 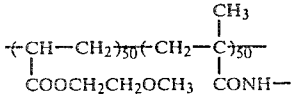 | 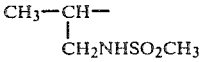 | Cl |
| M-15 | 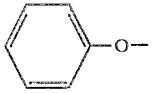 | 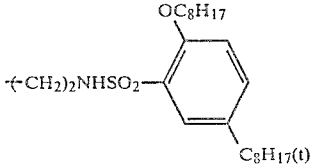 | Cl |

-continued
| | | | |
|---|---|---|---|
| M-16 | 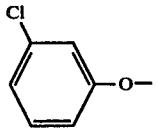 | 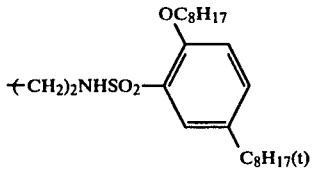 | 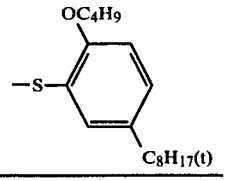 |
(M-17)
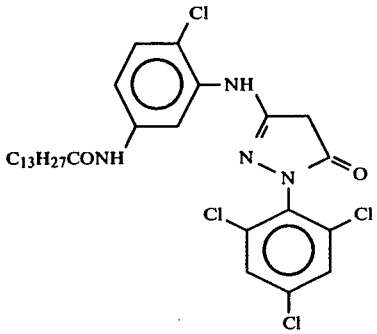
(M-18)
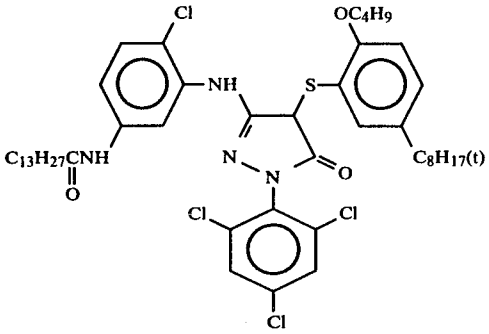

-continued
(M-19)
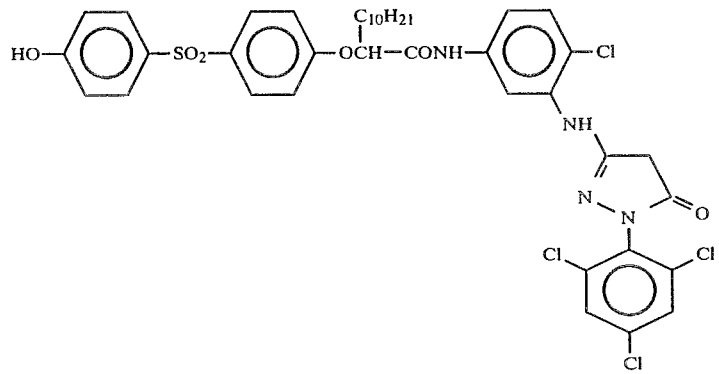
(M-20)
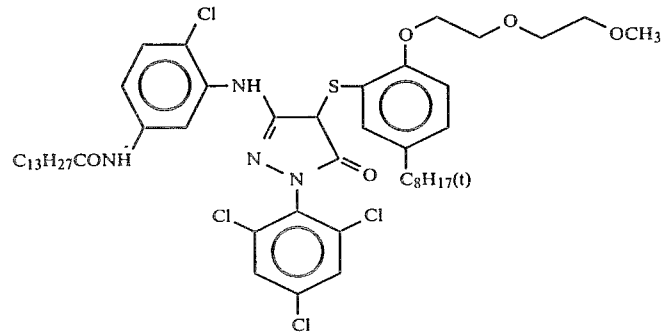
(M-21)
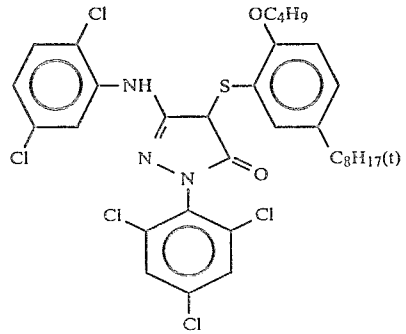

-continued
(M-22)
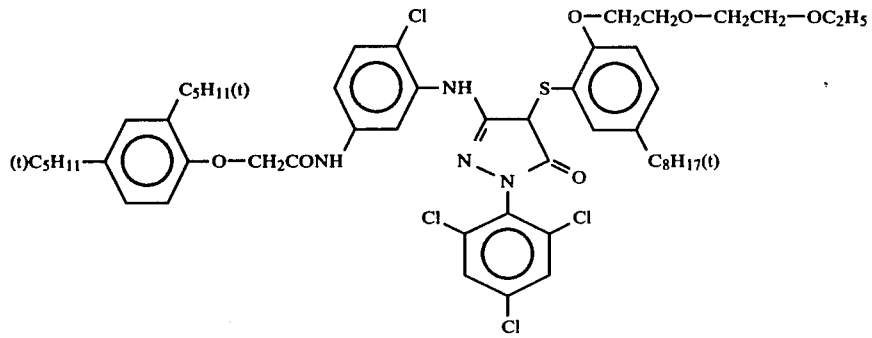
(M-23)
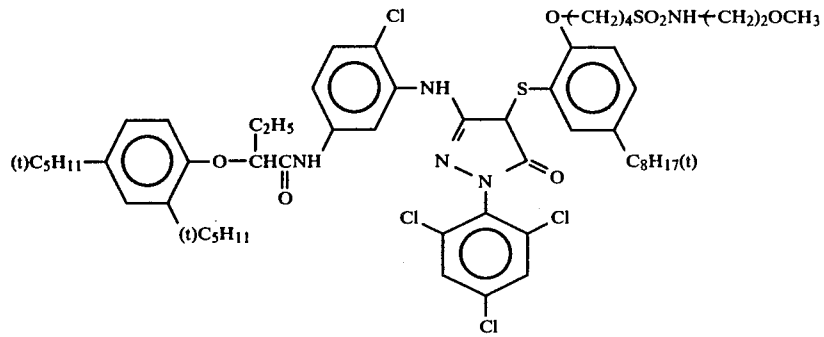
(M-24)
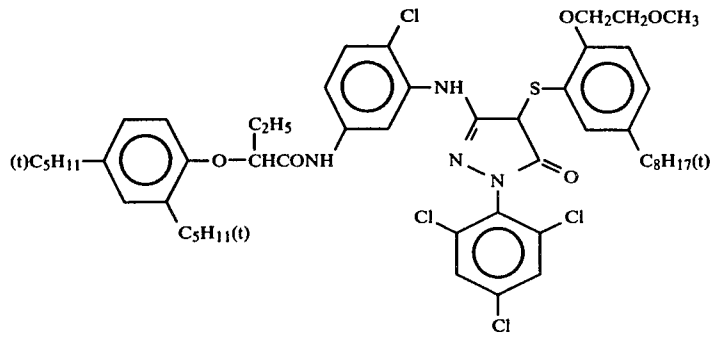

-continued
(M-25)
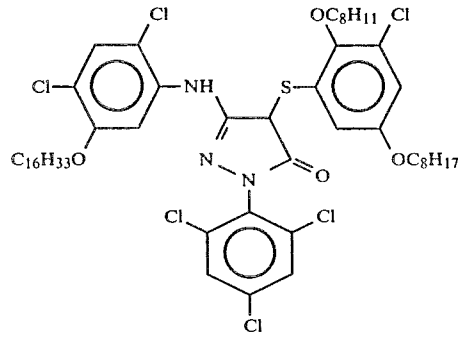
(M-26)
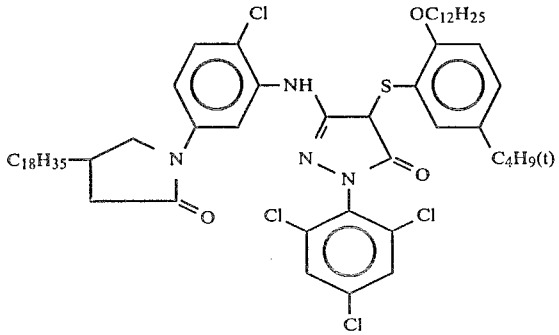
(M-27)
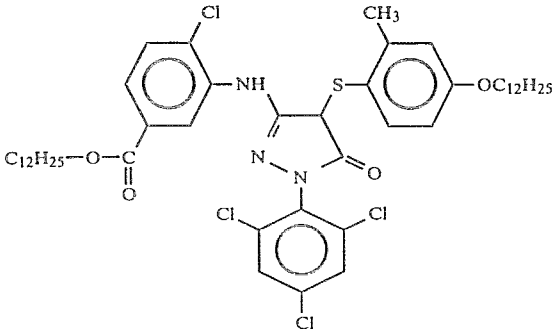

-continued
(M-28)
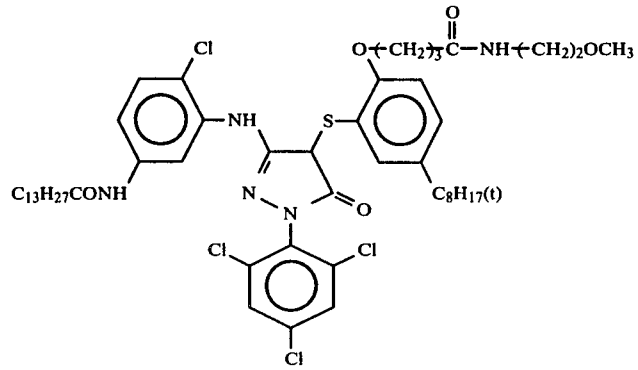
(M-29)
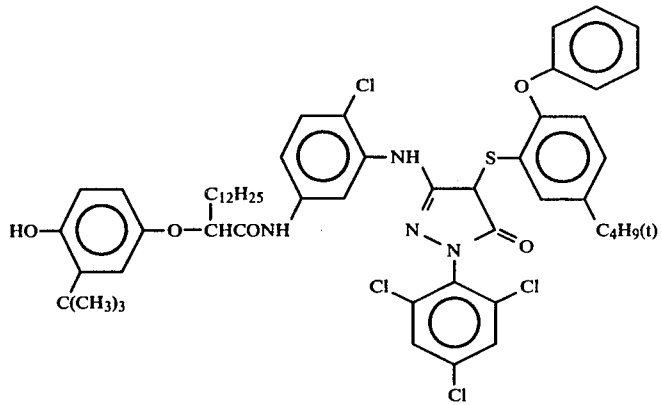
(M-30)
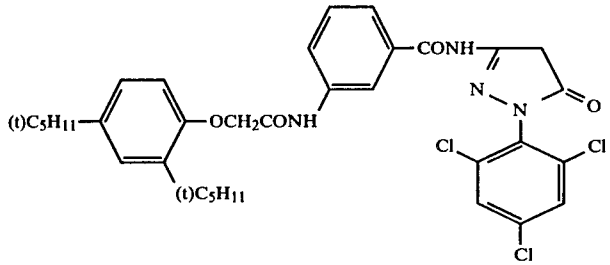

-continued
(M-31)
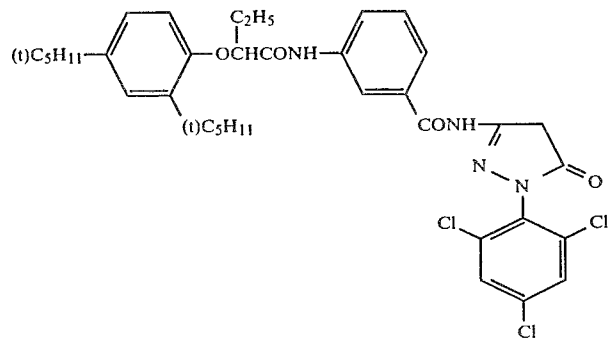
(M-32)
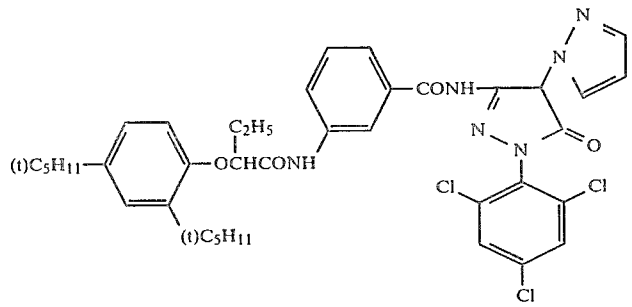
Yellow Couplers:
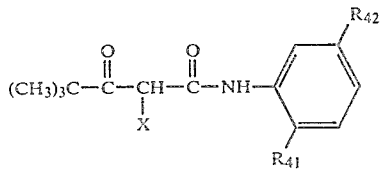
| Compound No. | $R_{42}$ | X | $R_{41}$ |
|---|---|---|---|

-continued
| | | | |
|---|---|---|---|
| Y-1 | $-COOCH(CH_3)COOC_{12}H_{25}$ | 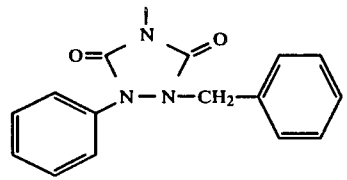 | Cl |
| Y-2 | $-COOCH(C_4H_9)COOC_{12}H_{25}$ | " | Cl |
| Y-3 | 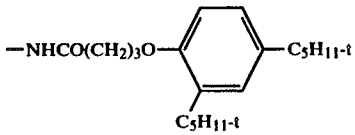 | 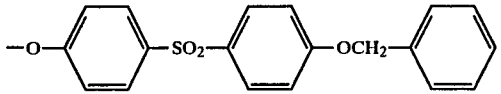 | Cl |
| Y-4 | 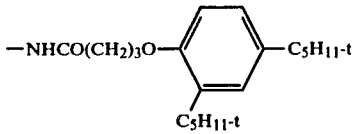 | 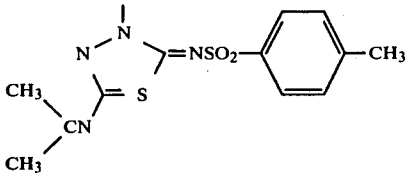 | Cl |
| Y-5 | " | 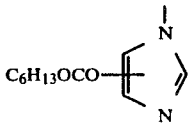 | Cl |
| Y-6 | $-NHSO_2C_{12}H_{25}$ | 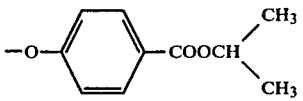 | Cl |

-continued
| | | | |
|---|---|---|---|
| Y-7 | $-NHSO_2C_{16}H_{33}$ | 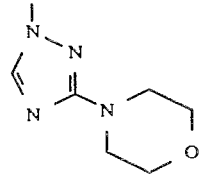 | Cl |
| Y-8 | $-COOC_{12}H_{25}(n)$ | 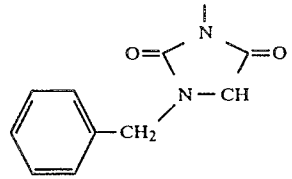 | Cl |
| Y-9 | 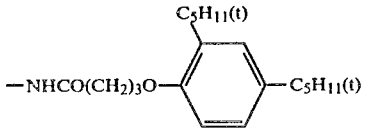 | 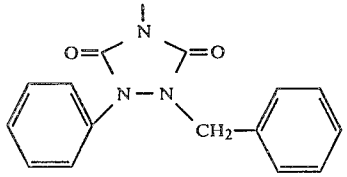 | Cl |
| Y-10 | 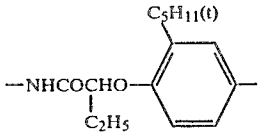 | 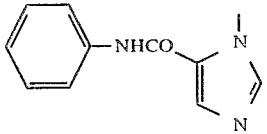 | $OCH_3$ |
| Y-11 | 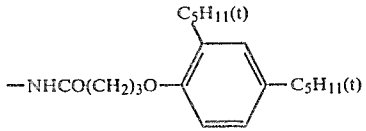 | 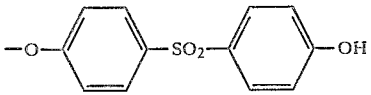 | Cl |
| Y-12 | 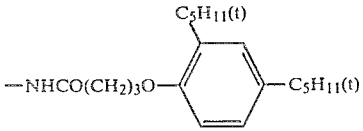 | 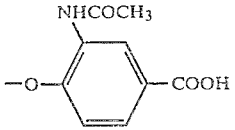 | Cl |

-continued
| | | | |
|---|---|---|---|
| Y-13 | 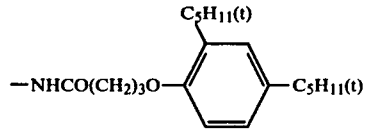 | 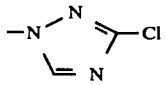 | Cl |
| Y-14 | 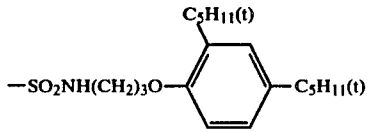 | 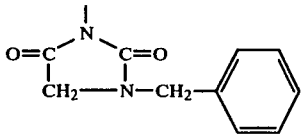 | Cl |
| Y-15 | 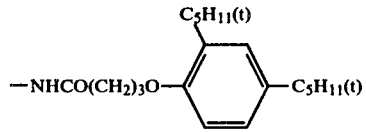 | 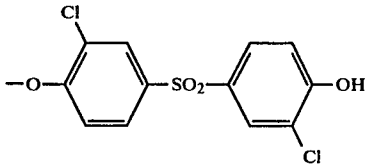 | Cl |
| Y-16 | 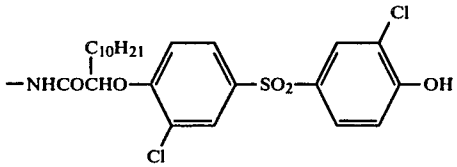 | 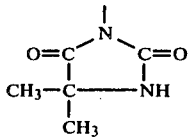 | Cl |
| Y-17 | 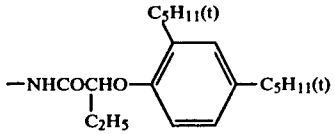 | 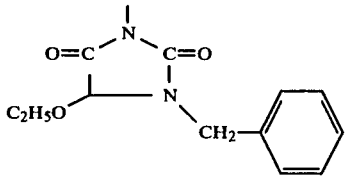 | Cl |
| Y-18 | 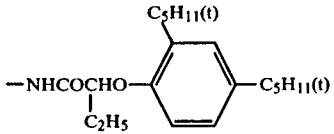 | 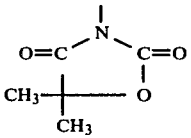 | Cl |

-continued
| | | | |
|---|---|---|---|
| Y-19 | $-NHSO_2C_{16}H_{33}$ | 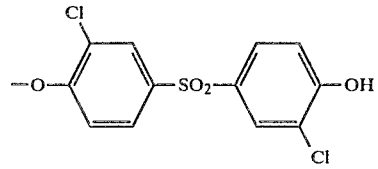 | Cl |
| Y-20 | 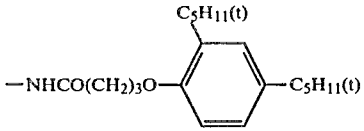 | 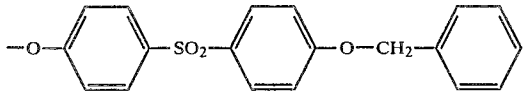 | Cl |
| Y-21 | 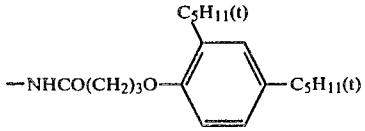 | 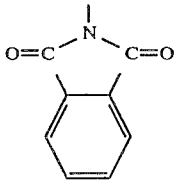 | Cl |
| Y-22 | 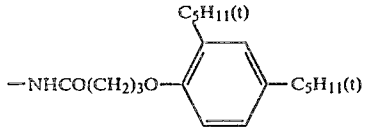 | 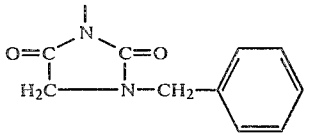 | Cl |
| Y-23 | 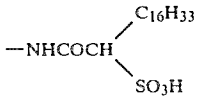 | 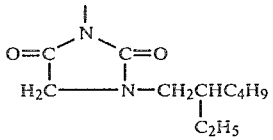 | Cl |
| Y-24 | 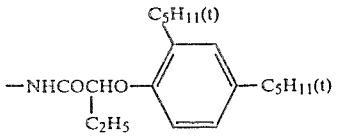 | 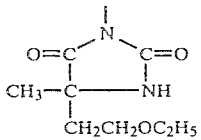 | Cl |

-continued
| | | | |
|---|---|---|---|
| Y-25 | $-NHCO\underset{\underset{CH_3}{\vert}}{C}HCH_2SO_2C_{12}H_{25}(n)$ | 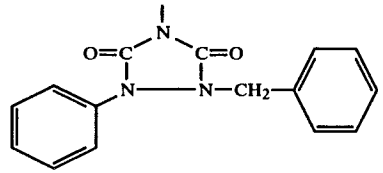 | Cl |
| Y-26 | $-NHSO_2C_{16}H_{33}(n)$ | 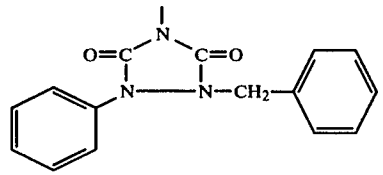 | Cl |
| Y-27 | 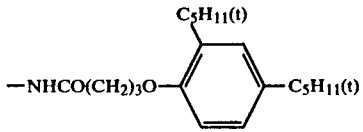 | 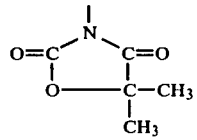 | Cl |
| Y-28 | " | 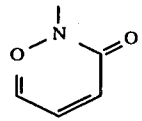 | Cl |
| Y-29 | " | 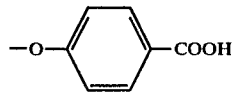 | Cl |
| Y-30 | $-NHSO_2-C_{16}H_{33}(n)$ | 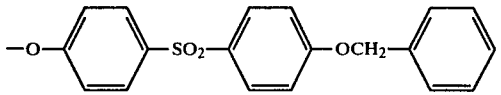 | Cl |
| Y-31 | " | 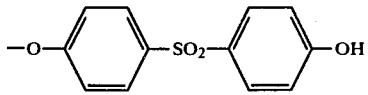 | Cl |

-continued
| | | | |
|---|---|---|---|
| Y-32 | $-SO_2-NHCH_3$ | 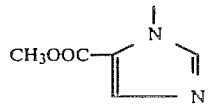 | $-OC_{16}H_{33}$ |
| Y-33 | 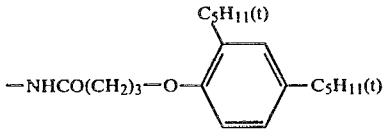 | 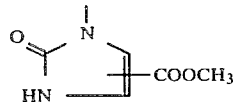 | Cl |
| Y-34 | 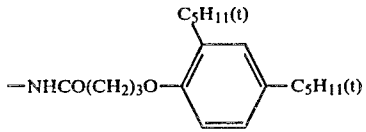 | 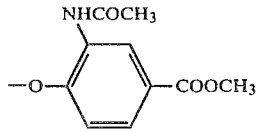 | Cl |
| (Y-35) | 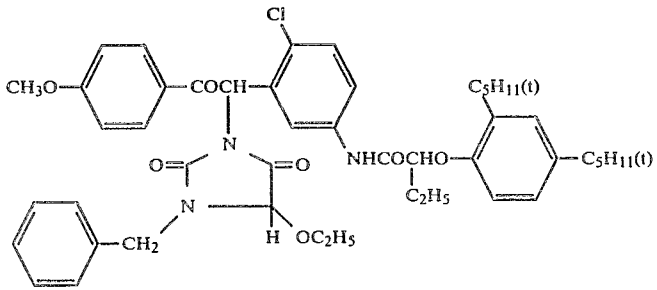 | | |

The amount of each of the cyan, magenta, and yellow couplers to be used in accordance with the present invention is individually preferably from 0.1 to 1 mol, and more preferably from 0.2 to 0.5 mol, per mol of silver halide.

The dispersion of fine oleophilic grains containing the coupler and the polymer which are characteristically used in the present invention can be prepared typically as mentioned below.

The polymer of the present invention, which is a so-called linear polymer as prepared by solution polymerization, emulsion polymerization or suspension polymerization and is not crosslinked, and high boiling point coupler solvent and coupler are all completely dissolved in an auxiliary organic solvent, and then the resulting solution is dispersed in water, preferably in an aqueous hydrophilic colloid solution, more preferably in an aqueous gelatin solution, by the aid of a dispersing agent, ultrasonically or by means of a colloid mill, in the form of fine grains as dispersed, and the resulting dispersion is incorporated into a silver halide emulsion. Alternatively, water or an aqueous hydrophilic colloid solution such as an aqueous gelatin solution may be added to an auxiliary organic solvent containing a dispersing agent such as a surfactant and the polymer, high boiling point coupler solvent and coupler of the invention to form an oil-in-water dispersion by phase inversion. From the thus-prepared dispersion, the auxiliary organic solvent may be removed by distillation, noodle washing or ultrafiltration, and then the resulting dispersion may be blended with a photographic emulsion. The auxiliary organic solvent as used herein in accordance with the present invention is an organic solvent which is useful in emulsification and dispersion and is to be substantially finally removed from the photographic material in the drying step after coating or by the above-mentioned means, and this is a low boiling point organic solvent or a solvent which is soluble in water in some degree and which may be removed by washing with water. Examples of such auxiliary organic solvent include lower alkyl acetates such as ethyl acetate or butyl acetate, as well as ethyl propionate, secondary butyl alcohol, methyl ethyl ketone, methyl isobutyl ketone, β-ethoxyethyl acetate, methyl cellosolve acetate and cyclohexanone.

In addition, an organic solvent which is completely miscible with water, for example, methyl alcohol, ethyl alcohol, acetone or tetrahydrofuran, may be used together with said solvent, if desired.

These organic solvents may be used in combination of two or more kinds thereof, if desired.

The fine oleophilic grains thus-obtained preferably have a mean grain size of from 0.04 μm to 2 m, and more preferably from 0.06 μm to 0.4 μm. The grain size of the fine oleophilic grains may be measured by a measuring apparatus of, for example, Nanonizer (by Coal Tar Co., England).

As the aforesaid high boiling point coupler solvent, compounds represented by the following formulae can be used in the present invention.

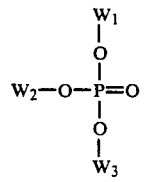
(XXIII)

$W_1-COOW_2$ (XXIV)

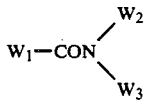
(XXV)

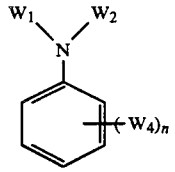
(XXVI)

$W_1-O-W_2$ (XXVII)

$HO-W_6$ (XXVIII)

In these formulae, $W_1$, $W_2$ and $W_3$ each represents a substituted or unsubstituted alkyl, cycloalkyl, alkenyl, aryl or heterocyclic group; $W_4$ represents $O-W_1$ or $S-W_1$; and n represents an integer of from 1 to 5, and when n is 2 or more, plural $W_4$s may be the same or different. In the formula (VII), $W_1$and $W_2$ may be bonded to each other to form a condensed ring.

$W_6$ represents a substituted or unsubstituted alkyl or aryl group, and the total number of carbon atoms for constituting $W_6$ is 12 or more.

Apart from the compounds of the aforesaid formulae (XXIII) to (XXVIII), compounds which have a melting point of 100° C. or lower and a boiling point of 140° C. or higher and which are immiscible in water can also be used as the high boiling point coupler solvent for the present invention, provided that these are good solvents for the couplers for use in the invention. The melting point of the high boiling point coupler solvents for use in the present invention is preferably 80° C. or lower. The boiling point of the high boiling point coupler solvents is preferably 160° C. or higher, more preferably 170° C. or higher.

If the melting point of the coupler solvents exceeds about 100° C., they would cause crystallization of the coupler as dissolved therein so that the effect of improving the coloring capacity of the coupler would thereby become decreased.

As the surfactant, anionic surfactants (e.g., alkylbenzenesulfonic acids, alkylnaphthalenesulfonic acids) and/or nonionic surfactants (e.g., sorbitan sesqui-oleic acid ester, sorbitan monolauric acid ester) are preferred.

In accordance with the present invention, any one of silver bromide, silver iodobromide, silver iodochlorobromide, silver chlorobromide and silver chloride may be used as silver halides. In particular, when rapid processing is desired, silver chlorobromide containing 90 mol% or more, and preferably 98 mol% or more, silver chloride is preferred. The silver chlorobromide may contain a slight amount of silver iodide, but it is preferred to contain no silver iodide.

The mean grain size of the silver halide grains in the photographic emulsion of the photographic material of the present invention (the mean grain size is the mean value based on the project area using the diameter of the grain as the grain size when the grain is spherical or resembles spherical, or using the edge length as the grain size when the grain is a cubic grain) is not specifically limitative but is preferably 2 μm or less, and more preferably from 0.2 to 1.5 μm.

The silver halide grains in the photographic emulsion may have a regular crystal form such as a cubic, tetradecahedral or octahedral crystal form (that is, normal crystal emulsion), or may have an irregular crystal form such as a spherical or tabular form, or may also have a composite form of these crystal forms. A mixture comprising grains of various crystal forms may also be used. Among them, the regular crystal emulsion is especially preferably used in the present invention.

In addition, a tabular grain silver halide emulsion wherein tabular silver halide grains having an aspect ratio (diameter/thickness) of 5 or more account for 50% or more of the total project area of the silver halide grains also be used.

The silver halide emulsion to be incorporated into at least one light-sensitive layer of the photographic material of the present invention is preferably a monodispersed emulsion having a variation coefficient (obtained by dividing the statistical standard deviation by the mean grain size and represented by percentage) of 15% or less, more preferably 10% or less.

The monodispersed emulsion may have the above-mentioned variation coefficient by itself, but two or more monodispersed emulsions each having a different mean grain size, which have been separately prepared and which have a variation coefficient of 15% or less, preferably 10% or less, may be blended to prepare an emulsion for use in the present invention.. The difference in the grain size as well as the proportion of the plural emulsions to be blended may freely be selected, but preferably, the difference in the mean grain size of the emulsions to be blended is selected from the range of from 0.2 μm to 1.0 μm. The grain size distribution of the polydispersed emulsion may be either the statistical normal distribution or the distribution having two or more peaks.

For the definition of the said variation coefficient and the method of measurement of the same, the description in T. H. James, *The Theory of the Photographic Process* (published by The Macmillan Company), 3rd Ed. (1966), page 39 may be referred to.

The silver halide grains may differ in composition or phase between the inside and the surface layer thereof. In addition, the grains may be those which form a latent image mainly on the surface thereof, or those which form a latent image mainly in the inside thereof. The latter grains are especially useful as a direct positive emulsion.

The silver halide grains may be formed or physically ripened in the presence of a cadmium salt, a zinc salt, a thallium salt, a lead salt, an iridium salt or a complex salt thereof, a rhodium salt or a complex salt thereof, or an iron salt or a complex salt thereof.

The silver halide emulsions are generally chemically ripened. For chemical ripening, conventional means can be employed. Details of chemical ripening are described, e.g., in JP-A-62-215272, from page 12, left lower column, line 18 to the same page, right lower column, line 16.

The silver halide emulsions are generally spectrally sensitized. For spectral sensitization, conventional methine dyes can be used. Details of spectral sensitization described in JP-A-62-215272, from page 22, right upper column, line 3 from bottom to page 38 and its amendment filed on Mar. 16, 1987, sheet-B.

The photographic emulsions for use in the present invention can contain various compounds for the purpose of preventing fog during preparation, storage and photographic processing of photographic materials and for the purpose of stabilizing the photographic property of the materials. For example, various compounds which are known as an antifoggant or stabilizer can be added for said purposes, which compounds include azoles, such as benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles (especially, 1-phenyl-5-mercaptotetrazole), mercaptopyrimidines, mercaptotriazines, etc.; thioketo compounds, such as oxazolinethione; azaindenes, such as triazaindenes, tetraazaindenes (especially, 4-hydroxy-substituted (1,3,3a,7)tetraazaindene), pentaazaindenes, etc.; as well as benzenethiosulfonic acids, benzenesulfinic acids and benzenesulfonic acid amides.

The photographic materials of the present invention can contain, as a color fogging preventing agent or a color mixing preventing agent, hydroquinone derivatives, aminophenol derivatives, amines, gallic acid derivatives, catechol derivatives, ascorbic acid derivatives, colorless couplers, sulfonamidophenol derivatives, and so on.

The photographic materials of the present invention can contain various antifading agents. For example, as organic antifading agents for cyan, magenta and/or yellow color images which may be used in the present invention, there may be typically mentioned hindered phenols such as hydroquinones, 6-hydroxychromans, 5-hydroxycoumarans, spirochromans, p-alkoxyphenols and bisphenols, as well as gallic acid derivatives, methylenedioxybenzenes, aminophenols and hindered amines and ether or ester derivatives thereof obtained by silylating or alkylating the phenolic hydroxyl group of said compounds. In addition, metal complexes such as (bissalicylaldoximato)nickel complexes and (bis-N,N-dialkyldithiocarbamato)nickel complexes may also be used.

Specific examples of organic antifading agents which may be used in the present invention are mentioned in various patent publications, for example, as follows.

The hydroquinones are described in U.S. Pat. Nos. 2,360,290, 2,418,613, 2,700,453, 2,701,197, 2,728,659, 2,732,300 2,735,765, 3,982,944 and 4,430,425, British Patent 1,363,921, and U.S. Pat. Nos. 2,710,801 and 2,816,028; the 6-hydroxychromans, 5-hydroxycoumarans and spirochromans are described in U.S. Pat. Nos. 3,432,300, 3,573,050, 3,574,627, 3,698,909 and 3,764,337 and JP-A-52-152225; the spiroindanes are described in U.S. Pat. No. 4,360,589; the p-alkoxyphenols are described in U.S. Pat. No. 2,735,765, British Patent 2,066,975, JP-A-59-10539 and JP-B-57-19764; the hindered phenols are described in U.S. Pat. No. 3,700,455, JP-A-52-72225, U.S. Pat. No. 4,225,235 and JP-B-52-6623; the gallic acid derivatives, methylenedioxybenzenes and aminophenols are described in U.S. Pat. Nos. 3,457,079 and 4,332,886 and JP-B-56-21144, respectively; the hindered amines are described in U.S. Pat. Nos. 3,336,135 and 4,268,593, British Patents 1,326,889, 1,354,313 and 1,410,846, JP-B-51-1420, and JP-A-58-

114036, JP-A-59-53846 and JP-A-59-78344; the phenolic hydroxyl group-etherified or esterified derivatives are described in U.S. Pat. Nos. 4,155,765, 4,174,220, 4,254,216 and 4,264,720, JP-A-54-145530, JP-A-55-6321, JP-A-58-105147 and JP-A-59-10539, JP-B-57-37856, U.S. Pat. No. 4,279,990 and JP-B-53-3263; and the metal complexes are described in U.S. Pat. Nos. 4,050,938 and 4,241,155 and British Patent 2,027,731A. These compounds may be added to light-sensitive layers, as emulsified together with the corresponding color coupler generally in an amount of from 5 to 100% by weight to the coupler, whereby the intended object can be attained. In order to prevent the deterioration of cyan color images against heat and especially light, introduction of an ultraviolet absorber to both layers adjacent to the cyan coloring layer is more effective.

Among the aforesaid antifading agents, the spiroindanes and hindered amines are especially preferred.

In accordance with the present invention, the compounds mentioned below are preferably used together with the aforesaid couplers, especially pyrazoloazole couplers.

Precisely, compounds (A) capable of being chemically bonded to the aromatic amine developing agent as remaining after color development to form a compound which is chemically inactive and which is substantially colorless and/or compounds (B) capable of being chemically bonded to the oxidation product of the aromatic amine color developing agent as remaining after color development, to form a compound which is chemically inactive and which is substantially colorless, are used singly or in combination. Use of such compounds is preferred, for example, for the purpose of preventing generation of stains caused by formation of coloring dyes by reaction of the color developing agent or the oxidation product thereof as remaining in the film and the coupler therein, during storage after processing, as well as any other adverse effects.

As the compounds (A), those having a secondary reaction velocity constant (k2) with p-anisidine (in trioctyl phosphate at 80° C.) of from 1.0 liter/mol sec to $1\times10^{-5}$ liter/mol sec are preferred.

If k2 is larger than said range, the compounds themselves would be unstable so that they would often react with water to be decomposed. On the other hand, if k2 is smaller than said range, the reaction speed of the compounds with the remaining aromatic amine developing agent would be too slow, so that the intended object of the invention to prevent the side-effect of the remaining aromatic amine developing agent could not be attained.

More preferred examples of such compounds (A) may be represented by formula (AI) or (AII).

$$R_1-(A)_n-X \quad \text{(AI)}$$

$$R_2-\underset{\underset{B}{|}}{C}=Y \quad \text{(AII)}$$

In these formulae, $R_1$ and $R_2$ each represents an aliphatic group, an aromatic group or a heterocyclic group; n represents 1 or 0; B represents a hydrogen atom, an aliphatic group, an aromatic group, a heterocyclic group, an acyl group or a sulfonyl group; Y represents a group capable of accelerating addition of an aromatic amine developing agent to the compound of the formula (AII). $R_1$ and X, and Y and $R_2$ or B may be bonded to each other to form a cyclic structure.

The system of chemical bonding of the remaining aromatic amine developing agent and the said compound typically includes substitution reaction and addition reaction.

Specific examples of the compounds of the formulae (AI) and (AII) are described in Japanese patent Application Nos. 62-158342, 62-158643, 62-212258, 62-214681, 62-228034 and 62-279843.

The photographic materials of the present invention may contain an ultraviolet absorber in the hydrophilic colloid layer. For example, aryl group-substituted benzotriazole compounds (for example, those described in U.S. Pat. No. 3,533,794), 4-thiazolidone compounds (for example, those described in U.S. Pat. Nos. 3,314,794 and 3,352,681), benzophenone compounds (for example, those described in JP-A-46-2784), cinnamic acid esters (for example, those described in U.S. Pat. Nos. 3,705,805 and 3,707,375), butadiene compounds (for example, those described in U.S. Pat. No. 4,045,229) and benzoxazole compounds (for example, those described in U.S. Pat. No. 3,700,455) may be used for the purpose. Ultraviolet absorbing couplers (for example, α-naphthol cyan dye-forming couplers) as well as ultraviolet absorbing polymers may also be used. The said ultraviolet absorbers may be mordanted in a particular layer.

As the binder or protective colloid to be used in the emulsion layers of the photographic materials of the present invention, gelatin is advantageously used, but other hydrophilic colloids may also be used singly or in combination with gelatin.

The gelatin for use in the present invention may be either a lime-processed gelatin or an acid-processed gelatin. The details of preparation of gelatins are described in Arther Vais, *The Macromolecular Chemistry of Gelatin* (published by Academic Press, 1964).

As the supports for the photographic materials of the present invention, any conventional ones which are generally used for conventional photographic materials may be used. For example, there are a cellulose nitrate film, a cellulose acetate film, a cellulose acetate butyrate film, a cellulose acetate propionate film, a polystyrene film, a polyethylene terephthalate film or a polycarbonate film, and laminates thereof as well as a thin glass film, a paper and so on. Further, a paper coated or laminated with baryta or an α-olefin polymer, especially a polymer of an α-olefin having 2 to 10 carbon atoms, such as polyethylene, polypropylene or ethylenebutene copolymer; a vinyl chloride resin containing a reflective material such as $TiO_2$; or a plastic film whose surface has been coarsened so as to enhance the adhesiveness with other polymer substances, as described in JP-B-47-19068 may also be used as a support, whereby a good effect can be obtained. In addition, an ultraviolet ray-hardening resin may also be used as a support.

The support may be selected to be a transparent or opaque one in accordance with the object of the photographic materials. In addition, a dye or a pigment may be added to the support so as to color the same.

The opaque support includes a paper which is naturally opaque and additionally an opaque film formed by adding a dye or a pigment such as titanium oxide to a transparent film, and a plastic film whose surface has been treated by the method described in JP-B-47-19068. The support generally has a subbing layer. In order to further improve the adhesion, the surface of the support may be pretreated by corona discharge, ultraviolet irradiation or flame treatment.

The present invention may be applied generally to color photographic materials, for example, including color negative films, color papers, color reversal papers, color reversal films, and so on, and especially preferably to printing color photographic materials.

For development of the photographic materials of the present invention, black-and-white developers and/or color developers can be employed. The color developer for us in the present invention is preferably an aqueous alkaline solution consisting essentially of an aromatic primary amine color developing agent. As the color developing agent for the developer, p-phenylenediamine compounds are preferably used, although aminophenol compounds are useful. Specific examples of the compounds include 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-N-β-methoxyethylaniline and sulfates, hydrochlorides and p-toluenesulfonates thereof. Two or more of these compounds may be used in combination, in accordance with the object thereof.

The color developer generally contains a pH buffer such as alkali metal carbonates, borates or phosphates, and a development inhibitor or an antifoggant such as bromides, iodides, benzimidazoles, benzothiazoles or mercapto compounds. In addition, this may further contain, if desired, various kinds of preservatives, such as hydroxylamine, diethylhydroxylamine, sulfates, hydrazines, phenylsemicarbazides, triethanolamine, catechol sulfonic acids, triethylenediamine(1,4-diazabicyclo[2,2,2]octanes); an organic solvent such as ethylene glycol or diethylene glycol; a development accelerator such as benzyl alcohol, polyethylene glycol, quaternary ammonium salts or amines; a dye-forming coupler; a competing coupler; a foggant such as sodium boronhydride; an auxiliary developing agent such as 1-phenyl-3-pyrazolidone; a viscosity imparting agent; as well as various kinds of chelating agents such as aminopolycarboxylic acids, aminopolyphosphonic acids, alkylphosphonic acids or phosphonocarboxylic acids, e.g., ethylenediaminetetraacetic acid, nitrilotriacetic acid, diethyle-netriaminepentaacetic acid, cyclohexanediaminetetraacetic acid, hydroxyathyliminodiacetic acid, 1-hydroxyethylidene-1,1-diphosphonic acid, nitrilo-N,N,N-trimethylenephosphonic acid, ethylenediamine-N,N,N',N'-tetramethylenephosphonic acid, ethylenediaminedi(o-hydroxyphenylacetic acid) and salts thereof.

When reversal processing is carried out, the photographic materials are first subjected to black-and-white development and then to color development. The black-and-white developer to be used in the black-and-white development may contain known black-and-white developing agents, for example, hydroxybenzenes such as hydroquinone, 3-pyrazolidones such as 1-phenyl-3-pyrazolidone or aminophenols such as N-methyl-p-aminophenol, singly or in combination thereof.

The color developer and black-and-white developer generally have a pH value of from 9 to 12. The amount of the replenisher to the developer is, although depending upon the color photographic materials to be processed, generally 3 liters or less per $m^2$ of the material. By lowering the bromide ion concentration in the replenisher, the amount may be 500 ml or lower. When the amount of the replenisher to be added is lowered, it is desired to prevent the evaporation and air oxidation of the processing solution by reducing the contact surface area of the processing tank with air. In addition, the amount of the replenisher to be added may also be reduced by means of suppressing accumulation of bromide ion in the developer.

After color developing, the photographic emulsion layer is generally bleached. Bleaching may be carried on simultaneously with fixation (bleach-fixation) or separately from the latter. In order to accelerate the photographic processing, bleaching may be followed by bleach-fixation. In addition, bleach-fixation in continuous two processing tanks, fixation prior to bleach-fixation or bleach-fixation followed by bleaching may also be applied to the photographic materials of the present invention in accordance with the object thereof. As the bleaching agent can be used, for example, compounds of polyvalent metals such as iron(III), cobalt(III), chromium(VI) or copper(II), as well as peracids, quinones, and nitro compounds. Specific examples of the bleaching agent include ferricyanides bichromates; organic complexes of iron(III) or cobalt(III), for example, complexes with aminopolycarboxylic acids such as ethylenediaminetetraacetic acid, diethylenetriaminepentaacetic acid, cyclohexanediaminetetraacetic acid, methyliminodiacetic acid, 1,3-diaminopropanetetraacetic acid or glycol ether diaminetetraacetic acid, as well as with citric acid, tartaric acid or malic acid; persulfates; bromates; permanganates; and nitrobenzenes. Among them, aminopolycarboxylic acid/iron(III) complexes such as ethylenediaminetetraacetic acid/iron(III) complex as well as persulfates are preferred, in view of the rapid processability thereof, and from the viewpoint of prevention of environmental pollution. The aminopolycarboxylic acid/iron(III) complexes are especially useful both in a bleaching solution and in a bleach-fixing solution. The bleaching solution or bleach-fixing solution containing such aminopolycarboxylic acid/iron(III) complexes generally has a pH value of from 5.5 to 8, but the solution may have a lower pH value for rapid processing.

In the bleaching solution, bleach-fixing solution and the previous bath may contain a bleaching accelerating agent, if desired. Various bleaching accelerating agents are known, and examples of the agents which are advantageously used in the present invention include the mercapto group or disulfide group-containing compounds described in U.S. Pat. No. 3,893,858, West German Patents 1,290,812 and 2,059,988, JP-A-53-32736, JP-A-53-57831, JP-A-53-37418, JP-A-53-72623, JP-A-53-95630, JP-A-53-95631, JP-A-53-104232, JP-A-53-124424, JP-A-53-141623 and JP-A-53-28426 and Research Disclosure, Item No. 17129 (July, 1978); the thiazolidine derivatives described in JP-A-50-140129; the thiourea derivatives described in JP-B-45-8506, JP-A-52-20832 and JP-A-53-32735 and U.S. Pat. No. 3,706,561; the iodides described in West German Patent 1,127,715 and JP-A-58-16235; the polyoxyethylene compounds described in West German Patents 966,410 and 2,748,430; the polyamine compounds described in JP-B-45-8836; the compounds described in JP-A-49-42434, JP-A-49- 59644, JP-A-53-94927, JP-A-54-35727, JP-A-55-26506 and JP-A-58-163940; and bromide ion. Among them, the mercapto group or disulfide group-having compounds are preferred because of the high accelerating effect thereof and, in particular, the compounds described in U.S. Pat. No. 3,893,858, West German Patent 1,290,812 and JP-A-53-95630 are especially preferred. In addition, the compounds described in U.S. Pat. No. 4,552,834 are also preferred. These bleaching accelerating agents may also be added to photographic materials. When picture-taking color photographic materials are bleach-fixed, the bleaching accelerating agents are especially effective.

Examples of the fixing agent include thiosulfates, thiocyanates, thioether compounds, thioureas and a large amount of iodide. Among them, thiosulfates are generally used, and, in particular, ammonium thiosulfate is most widely used. As the preservative for the bleach-fixing solution, sulfites, bisulfites and carbonyl-bisulfite adducts are preferred.

The silver halide color photographic materials are generally rinsed in water and/or stabilized, after being desilvered. The amount of the water to be used in the rinsing step can be set within a broad range, in accordance with the characteristic of the photographic material being processed (for example, depending upon the raw material components, such as coupler and so on) or the use of the material, as well as the temperature of the rinsing water, the number of rinsing tanks (the number of the rinsing stages), the replenishment system of cocurrent or countercurrent and other various kinds of conditions. Among the conditions, the relation between the number of the rinsing tanks and the amount of the rinsing water in a multistage countercurrent rinsing system can be obtained by the method described in *Journal of the Society of Motion Picture and Television Engineers,* Vol. 64, pages 248 to 253 (May, 1955).

According to the multistage countercurrent system described in said literature, the amount of the rinsing water to be used can be reduced noticeably, but because of the prolongation of the residence time of the water in the rinsing tank, bacteria propagate in the tank so that suspended matters generated by the propagation of bacteria adhere to the surface of the photographic material as being processed. Accordingly, such a system would often have a problem. In the practice of processing the photographic materials of the present invention, the method of reducing calcium and magnesium ions, which is described in JP-A-62-288838, can be extremely effectively used for overcoming this problem. In addition, the isothiazolone compounds and thiabendazoles described in JP-A-57-8542; chlorine-containing bactericides such as chlorinated sodium isocyanurates; and benzotriazoles and other bactericides described in H. Horiguchi, *Chemistry of Bactericidal and Fungicidal Agents,* and *Bactericidal and Fungicidal Techniques to Microorganisms,* edited by Association of Sanitary Technique, Japan, and *Encyclopedia of Bactericidal and Fungicidal Agents.,* edited by Nippon Bactericide and fungicide Association can also be used.

The pH value of the rinsing water to be used for processing the photographic materials of the present invention is generally from 4 to 9, preferably from 5 to 8. The temperature of the rinsing water and the rinsing time can also be set variously in accordance with the characteristics o the photographic material being processed as well as the use thereof, and, in general, the temperature is from 15° to 45° C. and the time is from 20 seconds to 10 minutes, and preferably the temperature is from 25° to 40° C. and the time is from 30 seconds to 5 minutes. Alternatively, the photographic materials of the present invention may also be processed directly with a stabilizing solution in place of being rinsed with water. For the stabilization, any known methods, for example, as described in JP-A-57-8543, JP-A-58-14834 and JP-A-60-220345, can be employed.

In addition, after the rinsing step, a stabilization treatment can also be effected. As one example thereof there may be mentioned a stabilizing bath containing formalin and a surfactant, which is used as a final bath for picture-taking color photographic materials. The stabilizing bath may also contain various chelating agents and fungicides.

The overflow from the rinsing and/or stabilizing solutions due to addition of replenishers thereto ma be reused in the other steps such as the previous desilvering step.

The silver halide photographic materials of the present invention ca contain a color developing agent for the purpose of simplifying and accelerating the processing of the materials. For incorporating color developing agents into the photographic materials, various precursors of the agents are preferably used. For example, there are mentioned the indoaniline compounds described in U.S. Pat. No. 3,342,597, the Schiff's base compounds described in U.S. Pat. No. 3,342,599 and *Research Disclosure,* Item Nos. 14850 and 15159, the aldol compounds described in *Research Disclosure,* Item No. 13924, the metal complexes described in U.S. Pat. No. 3,719,492 and the urethane compounds described in JP-A-53-135628, as the precursors.

The silver halide color photographic materials of the present invention can contain various kinds of 1-phenyl-3-pyrazolidones, if desired, for the purpose of accelerating the color developability thereof. Specific examples of the compounds are described, e.g., in JP-A-56-64339, JP-A-57-144547 and JP-A-58-115438.

The processing solutions for the photographic materials of the invention are used at 10° C. to 50° C. In general, a processing temperature of from 33° C. to 38° C. is standard, but the temperature may be made higher so as to accelerate the processing or to shorten the processing time, or on the contrary, the temperature may be made lower so as to improve the quality of images formed and to improve the stability of the processing solutions used. For the purpose of economization of silver in the photographic materials, cobalt intensification or hydrogen peroxide intensification as described in West German Patent 2,226,770 and U.S. Pat. No. 3,674,499 may be employed in processing the photographic materials of the invention.

The following examples are intended to illustrate the present invention in more detail but should not be construed as limiting it in any way.

EXAMPLE 1

A multilayer color printing photographic material [Sample (1)] was prepared by forming the layers having the compositions mentioned below on a paper support both surfaces of which were coated with polyethylene.

Constitution of Layers

The compositions of the respective constitutional layers are set forth below. The numeral for each component means the amount coated ($g/m^2$). The amount of silver halide coated is represented by the amount of silver therein.

Support

Polyethylene laminate paper (containing ($TiO_2$) and bluish dye in polyethylene in the side of the first layer)

| | |
|---|---|
| First Layer: Blue-Sensitive Silver Halide Emulsion Layer | |
| Monodispersed Silver Chlorobromide Emulsion (EM-1) (to which spectral sensitizer (Sen-1) was added) | 0.16 |
| Monodispersed Silver Chlorobromide Emulsion (EM-2) (to which spectral sensitizer (Sen-1) was added) | 0.10 |
| Antifoggant (Cpd-1) | 0.004 |
| Gelatin | 1.83 |
| Yellow Coupler (Y-17) | 0.83 |
| Color Image Stabilizer (Cpd-2) | 0.03 |
| Polymer (Cpd-3) | 0.08 |
| Solvent (Solv-1/Solv-2 of 1/1 by volume) | 0.35 |
| Hardening Agent (Hd) | 0.02 |
| Second Layer: Color Mixing Preventing Layer | |
| Gelatin | 1.25 |
| Color Mixing Preventing Agent (Cpd-4) | 0.04 |
| Solvent (Solv-3/Solv-4 of 1/1 by volume) | 0.20 |
| Hardening Agent (Hd) | 0.02 |
| Third Layer: Green-Sensitive Silver Halide Emulsion Layer | |
| Monodispersed Silver Chlorobromide Emulsion (EM-3) (to which spectral sensitizer (Sen-2, Sen-3) was added) | 0.05 |
| Monodispersed Silver Chlorobromide Emulsion EM-4) (to which spectral sensitizer (Sen-2, Sen-3) was added) | 0.11 |
| Antifoggant (Cpd-5) | 0.001 |
| Gelatin | 1.79 |
| Magenta Coupler (M-5) | 0.32 |
| Color Image Stabilizer (Cpd-6) | 0.20 |
| Color Image Stabilizer (Cpd-7) | 0.03 |
| Color Image Stabilizer (Cpd-8) | 0.03 |
| Solvent (Solv-3/Solv-5 of 1/2 by volume) | 0.65 |
| Hardening Agent (Hd) | 0.01 |
| Fourth Layer: Ultraviolet Absorbing Layer | |
| Gelatin | 1.58 |
| Ultraviolet Absorber (UV-1/UV-2/UV-3 of 1/4/4 by mol) | 0.62 |
| Color Mixing Preventing Agent (Cpd-4) | 0.05 |
| Solvent (Solv-6) | 0.34 |
| Dye (Dy-1) | 0.005 |
| Dye (Dy-2) | 0.015 |
| Hardening Agent (Hd) | 0.01 |
| Fifth Layer: Red-Sensitive Silver Halide Emulsion Layer | |
| Monodispersed Silver Chlorobromide Emulsion (EM-5) (to which spectral sensitizer (Sen-4, Sen-5) was added) | 0.07 |
| Monodispersed Silver Chlorobromide Emulsion (EM-6) (to which spectral sensitizer (Sen-4, Sen-5) was added) | 0.15 |
| Antifoggant (Cpd-9) | 0.0002 |
| Gelatin | 1.34 |
| Cyan Coupler (C-1) | 0.33 |
| Ultraviolet Absorber (UV-1/UV-3/UV-4 of 1/3/3 by mol) | 0.17 |
| Solvent (Solv-1) | 0.23 |
| Hardening Agent (Hd) | 0.01 |
| Sixth Layer: Ultraviolet Absorbing Layer | |
| Gelatin | 0.53 |
| Ultraviolet Absorber (UV-1/UV-2/UV-3 of 1/4/4) | 0.21 |
| Solvent (Solv-6) | 0.08 |
| Hardening Agent (Hd) | 0.01 |
| Seventh Layer: Protective Layer | |
| Gelatin | 1.33 |
| Acryl-Modified Copolymer of Polyvinyl Alcohol (modification degree 17%) | 0.17 |
| Liquid Paraffin | 0.03 |

The details of the silver halide emulsions used in Sample (1) are shown in Table 1 below.

TABLE 1

| Emulsion | Shape | Mean Grain Size (μm) | Br Content (mol %) | Variation Coefficient |
|---|---|---|---|---|
| EM-1 | Cubic | 0.96 | 80 | 0.06 |
| EM-2 | Cubic | 0.64 | 80 | 0.07 |
| EM-3 | Cubic | 0.52 | 95 | 0.08 |
| EM-4 | Cubic | 0.40 | 95 | 0.09 |
| EM-5 | Cubic | 0.44 | 70 | 0.09 |
| EM-6 | Cubic | 0.36 | 70 | 0.08 |

$$\text{Variation Coefficient} = \frac{\text{Standard Deviation}}{\text{Mean Grain Size}}$$

The compounds used in Sample (1) were as follows.

$6 \times 10^{-4}$ mol/Ag mol (Sen-1)

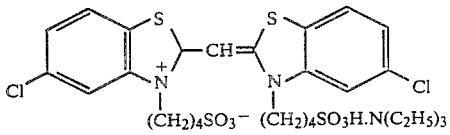

$4 \times 10^{-4}$mol/Ag mol (Sen-2)

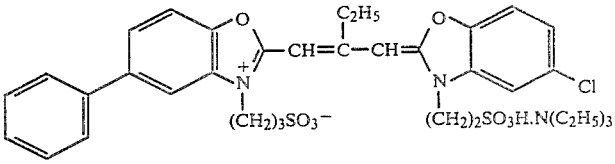

$8 \times 10^{-5}$ mol/Ag mol (Sen-3)

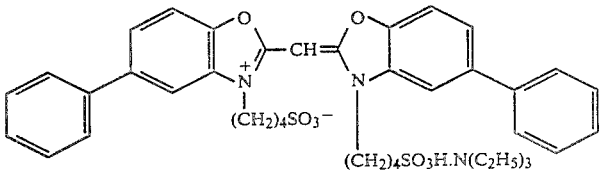

-continued
$1.8 \times 10^{-4}$ mol/Ag mol (Sen-4)
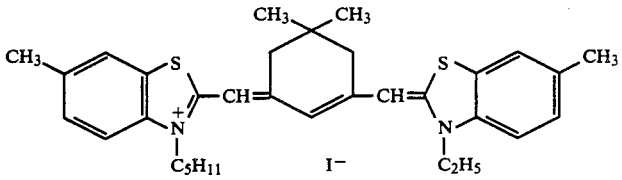
$3 \times 10^{-3}$ mol/Ag mol (Sen-5)
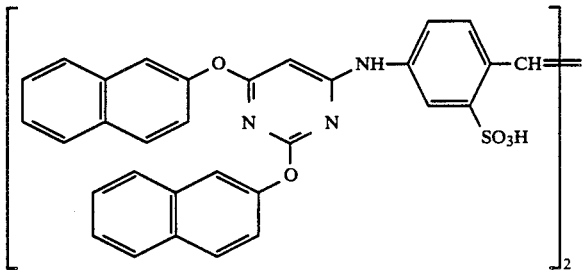
(Hd)
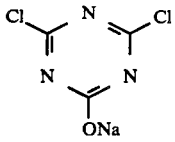
(Cpd-1)
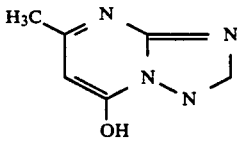
(Cpd-2)
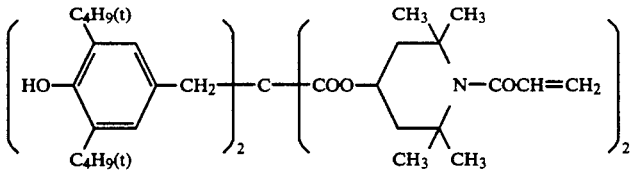
(Cpd-3)
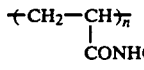
Molecular Weight: about 60,000
(Cpd-4)
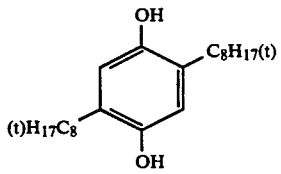
(Cpd-5)
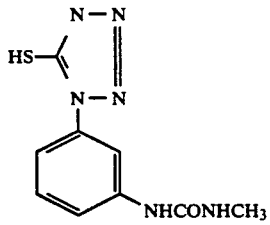

-continued
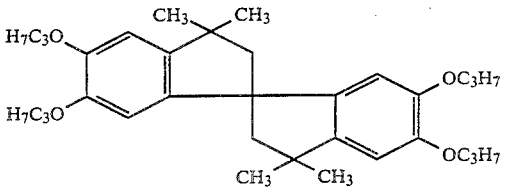
(Cpd-6)
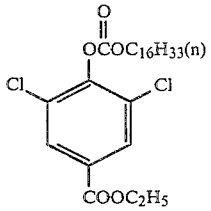
(Cpd-7)
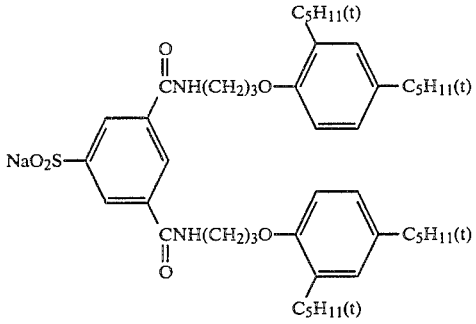
(Cpd-8)
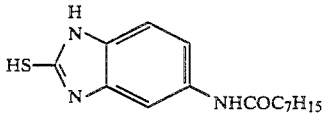
(Cpd-9)
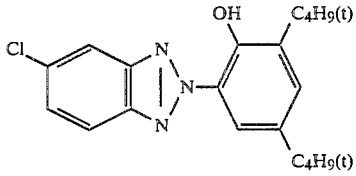
(UV-1)
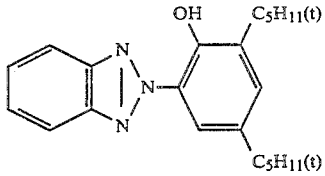
(UV-2)
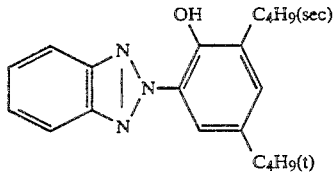
(UV-3)
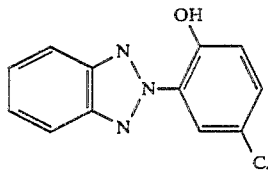
(UV-4)
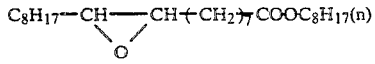
(Solv-1)

-continued $O{=}P{+}OC_9H_{19}(iso))_3$ (Solv-2)

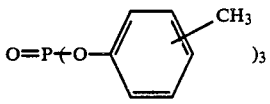
(Solv-3)

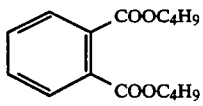
(Solv-4)

$O{=}P{+}OCH_2CH(C_2H_5)C_4H_9)_3$ (Solv-5)

$COOCH_2CH(C_2H_5)C_4H_9$
$(CH_2)_8$
$COOCH_2CH(C_2H_5)C_4H_9$ (Solv-6)

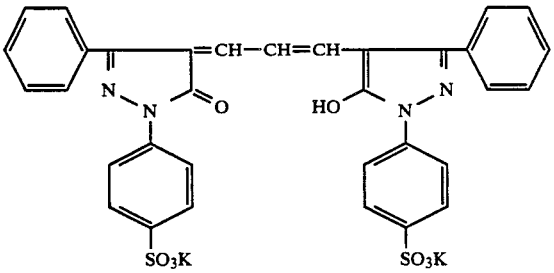
(Dy-1)

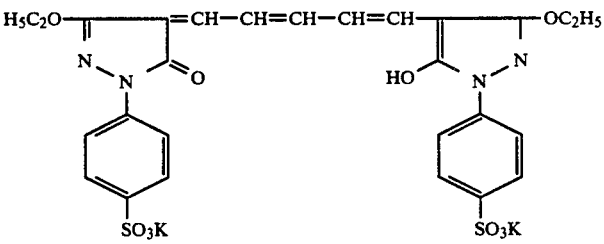
(Dy-2)

Samples (2) to (12) were prepared in the same manner as for Sample (1), except that the dye in the fourth layer and the coupler and polymer in the fifth layer were changed as indicated in Table 2 below.

TABLE 2

| Sample | Fourth Layer Dye(*1) | Fifth Layer Coupler(*2) | Fifth Layer Polymer(*3) |
|---|---|---|---|
| (1) (Comparison) | Dy-1, 2 | C-1 | No |
| (2) (Comparison) | Dy-1, 2 | C-11 | No |
| (3) (Comparison) | Dy-1, 2 | C-66 | No |
| (4) (Comparison) | Dy-1, 2 | C-11 | P-57 |
| (5) (Invention) | 5, 10 | C-11 | P-57 |
| (6) (Comparison) | Dy-1, 2 | C-13 | P-64 |
| (7) (Invention) | 5, 10 | C-13 | P-64 |
| (8) (Invention) | 34, 21 | C-13 | P-3 |
| (9) (Comparison) | Dy-1, 2 | C-66 | P-57 |
| (10) (Invention) | 5, 10 | C-66 | P-57 |
| (11) (Invention) | 5, 10 | C-11/C-13 = 1/1 | P-57 |
| (12) (Invention) | 37, 10 | C-1/C-14 = 1/1 | P-74 |

Notes:
(*1), (*2)Equimolar amount as in Sample (1).
(*3)100% by weight to coupler.

Using a sensitometer (FWH Type, manufactured by Fuji Photo Film Co., Ltd., with light source color temperature of 3,200° K.), Samples (1) to (12) were sensitometrically stepwise exposed through filters of blue, green, and red. After exposure, the samples were processed in accordance with the procedure mentioned below. These were subjected to color fading test with xenon light, and then the color image retention and the degree of stain were evaluated. Regarding the raw film stability, the samples were stored, prior to exposure, for 2 weeks under 35° C., 80% RH, and then these were exposed in the same manner as mentioned above. The sensitivity of the thus exposed samples was measured. The results obtained were shown in Table 3 below.

| Processing Step | Temperature (°C.) | Time |
|---|---|---|
| Color Development | 33 | 3 min 30 sec |
| Bleach-Fixation | 33 | 1 min 30 sec |
| Rinsing in Water | 24–34 | 3 min |
| Drying | 70–80 | 1 min |

The compositions of the respective processing solutions used were as follows.

| | |
|---|---|
| Color Developer: | |
| Water | 800 ml |
| Diethylenetriaminepentaacetic Acid | 1.0 g |
| Nitrilotriacetic Acid | 1.5 g |
| Benzyl Alcohol | 15 ml |
| Diethylene Glycol | 10 ml |
| Sodium Sulfite | 2.0 g |
| Potassium Bromide | 0.5 g |
| Potassium Carbonate | 30 g |
| N-Ethyl-N-(β-methanesulfonamidoethyl)-3-methyl-4-aminoaniline Sulfate | 5.0 g |
| Hydroxylamine Sulfate | 4.0 g |
| Brightening Agent (WHITEX 4B, by Sumitomo Chemical) | 1.0 g |
| Water to make | 1,000 ml |
| pH (25° C.) | 10.20 |
| Bleach-Fixer: | |
| Water | 400 ml |
| Ammonium Thiosulfate (70 wt %) | 150 ml |
| Sodium Sulfite | 18 g |
| Ethylenediaminetetraacetic Acid/Iron(III) Ammonium Complex | 55 g |
| Ethylenediaminetetraacetic Acid Disodium Salt | 5 g |
| Water to make | 1,000 ml |
| pH (25° C.) | 6.70 |

TABLE 3

| Sample | Color Image Fastness (*1) Y | M | C | Stain Y | M | C | Raw Film Stability(*2) Red-Sensitive Layer |
|---|---|---|---|---|---|---|---|
| (1) (Comparison) | 85 | 79 | 59 | 0.10 | 0.14 | 0.16 | 70 |
| (2) (Comparison) | 83 | 76 | 63 | 0.11 | 0.13 | 0.16 | 72 |
| (3) (Comparison) | 86 | 77 | 45 | 0.10 | 0.13 | 0.16 | 68 |
| (4) (Comparison) | 86 | 78 | 74 | 0.08 | 0.12 | 0.13 | 70 |
| (5) (Invention) | 85 | 79 | 75 | 0.07 | 0.09 | 0.10 | 90 |
| (6) (Comparison) | 84 | 77 | 76 | 0.09 | 0.10 | 0.13 | 72 |
| (7) (Invention) | 86 | 80 | 77 | 0.07 | 0.09 | 0.09 | 93 |
| (8) (Invention) | 87 | 79 | 75 | 0.07 | 0.08 | 0.09 | 95 |
| (9) (Comparison) | 85 | 78 | 70 | 0.11 | 0.11 | 0.14 | 66 |
| (10) (Invention) | 86 | 78 | 71 | 0.07 | 0.09 | 0.10 | 88 |
| (11) (Invention) | 86 | 80 | 80 | 0.07 | 0.08 | 0.09 | 95 |
| (12) (Invention) | 86 | 79 | 78 | 0.07 | 0.08 | 0.10 | 90 |

Notes:
(*1)Color image retention (%) after intermittent irradiation for 2 weeks of 3 hour irradiation with 100,000 lux xenon light plus 1 hour stopping.
(*2)Relative sensitivity based on fresh sample having sensitivity of 100.

As is obvious from the results in Table 3, cyan color fading was less in Samples (5), (7), (8), (10), (11) and (12) of the invention, and the color balance was also good in these samples. In addition, stain was also less and the color reproducibility was also excellent in these samples. Further, reduction of sensitivity in the raw film stability test was small with these samples.

EXAMPLE 2

In the same manner as in Example 1, Sample (13) was prepared having the layers set forth below.

| | |
|---|---|
| First Layer: Blue-Sensitive Silver Halide Emulsion Layer | |
| Monodispersed Silver Chlorobromide Emulsion (EM-7) (to which spectral sensitizer (Sen-6) was added) | 0.27 |

-continued

| | |
|---|---|
| Gelatin | 1.86 |
| Yellow Coupler (Y-17) | 0.82 |
| Polymer (Cpd-3) | 0.08 |
| Solvent (Solv-4) | 0.35 |
| Hardening Agent (Hd) | 0.02 |
| Second Layer: Color Mixing Preventing Layer | |
| Gelatin | 0.99 |
| Color Mixing Preventing Agent (Cpd-4) | 0.06 |
| Solvent (Solv-3/Solv-4 of 1/1 by volume) | 0.12 |
| Hardening Agent (Hd) | 0.02 |
| Third Layer: Green-Sensitive Silver Halide Emulsion Layer | |
| Monodispersed Silver Chlorobromide Emulsion (EM-8) (to which spectral sensitizer (Sen-7, Sen-3) was added) | 0.45 |
| Gelatin | 1.24 |
| Magenta Coupler (M-5) | 0.35 |
| Color Image Stabilizer (Cpd-6) | 0.20 |
| Color Image Stabilizer (Cpd-7) | 0.03 |
| Color Image Stabilizer (Cpd-8) | 0.03 |
| Solvent (Solv-3/Solv-5 of 1/2 by volume) | 0.65 |
| Hardening Agent (Hd) | 0.01 |
| Fourth Layer: Ultraviolet Absorbing Layer | |
| Gelatin | 1.58 |
| Ultraviolet Absorber (UV-1/UV-2/UV-3 of 1/4/4 by mol) | 0.62 |
| Color Mixing Preventing Agent (Cpd-4) | 0.05 |
| Solvent (Solv-6) | 0.34 |
| Dye (Dy-1) | 0.005 |
| Dye (Dy-2) | 0.015 |
| Hardening Agent (Hd) | 0.01 |
| Fifth Layer: Red-Sensitive Silver Halide Emulsion Layer | |
| Monodispersed Silver Bromide Emulsion (EM-9) (to which spectral sensitizer (Sen-4, Sen-5) was added) | 0.20 |
| Gelatin | 0.92 |
| Cyan Coupler (C-1) | 0.33 |
| Ultraviolet Absorber (UV-1/UV-3/UV-4 of 1/3/3 by mol) | 0.17 |
| Solvent (Solv-4) | 0.20 |
| Hardening Agent (Hd) | 0.01 |
| Sixth Layer: Ultraviolet Absorbing Layer | |
| Gelatin | 0.53 |
| Ultraviolet Absorber (UV-1/UV-2/UV-3 of 1/4/4 by mol) | 0.21 |
| Solvent (Solv-6) | 0.08 |
| Hardening Agent (Hd) | 0.01 |
| Seventh Layer: Protective Layer | |
| Gelatin | 1.33 |
| Acryl-Modified Copolymer of Polyvinyl Alcohol (modification degree: 17%) | 0.17 |
| Liquid Paraffin | 0.03 |

The details of the silver halide emulsions used in Sample (13) are shown in Table 4 below.

TABLE 4

| Emulsion | Shape | Mean Grain Size (μm) | Br Content (mol %) | Variation Coefficient |
|---|---|---|---|---|
| EM-7 | Cubic | 0.85 | 0.6 | 0.10 |
| EM-8 | Cubic | 0.45 | 1.0 | 0.09 |
| EM-9 | Cubic | 0.34 | 1.8 | 0.10 |

$$\text{Variation Coefficient} = \frac{\text{Standard Deviation}}{\text{Mean Grain Size}}$$

(Cpd-1) and (Cpd-9) used in Example 1 were added to the emulsions (EM-7) to (EM-9).

The compounds used were as follows.

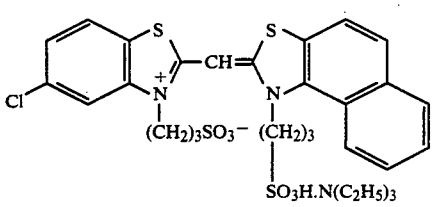

(Sen-6)

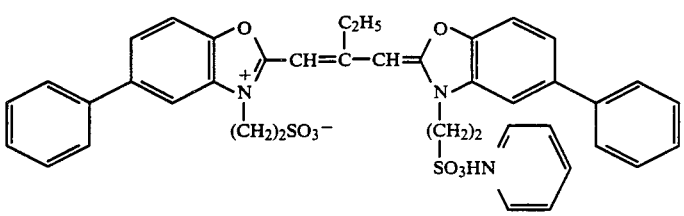

(Sen-7)

Samples (14) to (19) were prepared in the same manner as Sample (13), except that the dye in the fourth layer and the coupler and polymer in the fifth layer were changed as indicated in Table 5 below.

TABLE 5

| Sample | Fourth Layer Dye(*1) | Fifth Layer Coupler(*2) | Fifth Layer Polymer(*3) |
|---|---|---|---|
| (13) (Comparison) | Dy-1, 2 | C-1 | No |
| (14) (Comparison) | Dy-1, 2 | C-13 | No |
| (15) (Comparison) | Dy-1, 2 | C-13 | P-57 |
| (16) (Invention) | 5, 10 | C-1 | P-64 |
| (17) (Invention) | 5, 10 | C-11 | P-3 |
| (18) (Invention) | 34, 21 | C-13 | P-74 |
| (19) (Invention) | 5, 10 | C-1/C-14 = 1/1 | P-57 |

Notes:
(*1), (*2)Equimolar amount as in Sample (13).
(*3)100% by weight to coupler.

Using a sensitometer (FWH Type, manufactured by Fuji Photo Film Co., Ltd., with light source color temperature of 3,200° K), Samples (1) to (12) were sensitometrically stepwise exposed through filters of blue, green and red. After exposure, the samples were processed in accordance with the procedure mentioned below. These were subjected to color fading test with xenon light, and then the color image retentivity and the degree of stain were evaluated. Regarding the raw film stability, the samples were stored, prior to exposure, for 2 weeks under 35° C., 80% RH, and then these were exposed in the same manner as mentioned above. The sensitivity of the thus exposed samples was measured. The results obtained are shown in Table 6 below.

| Processing Step | Temperature (°C.) | Time (sec) |
|---|---|---|
| Color Development | 35 | 45 |
| Bleach-Fixation | 30-36 | 45 |
| Stabilization (1) | 30-37 | 20 |
| Stabilization (2) | 30-37 | 20 |
| Stabilization (3) | 30-37 | 20 |
| Stabilization (4) | 30-37 | 30 |
| Drying | 70-85 | 60 |

(The stabilization was effected by four tank cocurrent system from stabilization tank (4) to stabilization tank (1).)

The processing solutions used in the respective processing steps were as follows.

| | |
|---|---|
| Color Developer: | |
| Water | 800 ml |
| Ethylenediaminetetraacetic Acid | 2.0 g |
| Triethanolamine | 8.0 g |
| Sodium Chloride | 1.4 g |
| Potassium Carbonate | 25 g |
| N-Ethyl-N-(β-methanesulfonamidoethyl)-3-methyl-4-aminoaniline Sulfate | 5.0 g |
| N,N-Diethylhydroxylamine | 4.2 g |
| 5,6-Dihydroxybenzene-1,2,4-trisulfonic Acid | 0.3 g |
| Brightening Agent (4,4'-diaminostilbene type) | 2.0 g |
| Water to make | 1,000 ml |
| pH (25° C.) | 10.10 |
| Bleach-Fixer: | |
| Water | 400 ml |
| Ammonium Thiosulfate (70 wt %) | 100 ml |
| Sodium Sulfite | 18 g |
| Ethylenediaminetetraacetic Acid/Iron(III) Ammonium Complex | 55 g |
| Ethylenediaminetetraacetic Acid Disodium Salt | 3 g |
| Glacial Acetic Acid | 8 g |
| Water to make | 1,000 ml |
| pH (25° C.) | 5.5 |
| Stabilizer: | |
| Formalin (37 wt %) | 0.1 g |
| Formalin-Sulfite Adduct | 0.7 g |
| 5-Chloro-2-methyl-4-isothiazolin-3-one | 0.02 g |
| 2-Methyl-4-isothiazolin-3-one | 0.01 g |
| Copper Sulfate | 0.005 g |
| Water to make | 1,000 ml |
| pH (25° C.) | 4.0 |

TABLE 6

| Sample | Color Image Fastness (*1) Y | M | C | Stain Y | M | C | Raw Film Stability(*2) Red-Sensitive Layer |
|---|---|---|---|---|---|---|---|
| (13) (Comparison) | 84 | 79 | 58 | 0.10 | 0.14 | 0.16 | 64 |
| (14) (Comparison) | 83 | 78 | 62 | 0.10 | 0.13 | 0.15 | 70 |
| (15) (Comparison) | 83 | 78 | 75 | 0.08 | 0.11 | 0.13 | 73 |
| (16) (Invention) | 85 | 79 | 75 | 0.07 | 0.09 | 0.11 | 90 |
| (17) (Invention) | 84 | 80 | 76 | 0.07 | 0.08 | 0.11 | 95 |
| (18) (Invention) | 86 | 78 | 74 | 0.07 | 0.09 | 0.10 | 94 |
| (19) (Invention) | 84 | 80 | 78 | 0.07 | 0.08 | 0.10 | 90 |

Notes:
(*1)Color image retention (%) after intermittent irradiation for 2 weeks of 3 hour irradiation with 100,000 lux xenon light plus 1 hour stopping.
(*2)Relative sensitivity based on fresh sample having sensitivity of 100.

As is obvious from the results in Table 6, cyan color fading was less in Samples (16) to (19) of the invention and the color balance was good in these samples. In addition, stain was also less and the color reproducibility was also excellent in these samples. Further, reduction of sensitivity in the raw film stability test was small with these samples.

EXAMPLE 3

Samples (20) and (21) were prepared in the same manner as for Sample (19) in Example 2, except that the magenta coupler in the third layer was replaced by (M-17) or (M-18) and the density and gradation were adjusted by varying the amount of the silver to be coated. These samples were subjected to the same tests as in Example 2, and as a result, they were found to have the same good photographic characteristics as Sample (19).

In accordance with the present invention, there are provided various advantages in silver halide color photographic materials. First, there is provided a silver halide color photographic material capable of giving a color image with less stain, which is stable for a long period of time. Second, there is provided a silver halide photographic material containing a novel dye, which may easily be discolored or dissolved out by photographic processing without having any adverse influence on the photographic characteristics, especially spectral sensitizability, of photographic emulsions. Third, there is provided a silver halide photographic material which is excellent in storability with time.

While the invention has been described in detail and with reference to specific embodiments thereof, it will be apparent to one skilled in the art that various changes and modifications can be made therein without departing from the spirit and scope thereof.

What is claimed is:

1. A silver halide color photographic material having blue-sensitive, green-sensitive and red-sensitive silver halide emulsion layers on a support, wherein said red-sensitive silver halide emulsion layer contains a dispersion of fine oleophilic grains formed by dispersing by emulsification a solution comprising a water-insoluble and organic solvent-soluble homopolymer or copolymer and at least one coupler represented by formula (I) or formula (II), and a silver halide emulsion layer or a non-light-sensitive layer of the material contains a dye represented by formula (III);

wherein formula (I) is prepresented by

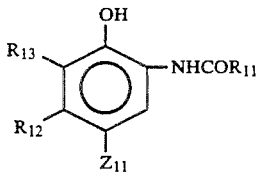

(I)

wherein $R_{11}$ represents an alkyl group, a cycloalkyl group, an aryl group, or a heterocyclic group; $R_{12}$ represents an acylamino group or an alkyl group; $R_{13}$ represents a hydrogen atom, a halogen atom, an alkyl group or an alkoxy group, or $R_{12}$ and $R_{13}$ are bonded together to form a nitrogen-containing heterocyclic ring; $Z_{11}$ represents a hydrogen atom, an alkoxy group, an aryloxy group, an alkylthio group or an arylthio group;

formula (II) is represented by

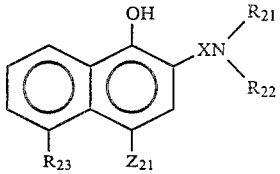

(II)

wherein $R_{21}$ and $R_{22}$ each represents a hydrogen atom, an alkyl group, a cycloalkyl group or an aryl group, provided that at least one of $R_{21}$ and $R_{22}$ is a substituent other than a hydrogen atom; $R_{23}$ represents a hydrogen atom, a carbamoyl group, a sulfamyl group, an alkoxycarbonyl group or an aryloxycarbonyl group; $Z_{21}$ represents a hydrogen atom, an alkoxy group, an aryloxy group, an alkylthio group or an arylthio group; X represents —CO—; and formula (III) is represented by

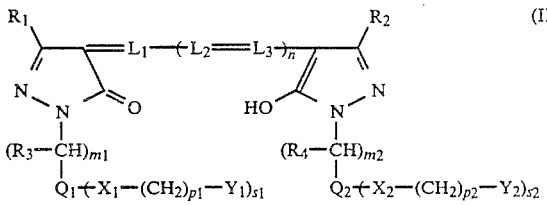

(III)

wherein $R_1$ and $R_2$ each represents —$COOR_5$ or

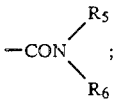

;

$R_3$ and $R_4$ each represents a hydrogen atom or an alkyl group; $R_5$ and $R_6$ each represents a hydrogen atom, an alkyl group or an aryl group; $Q_1$ and $Q_2$ each represents an aryl group; $X_1$ and $X_2$ each represents a divalent linking group; $Y_1$ and $Y_2$ each represents a sulfo group or a carboxyl group; $L_1$, $L_2$, and $L_3$ each represents a methine group; $m_1$ and $m_2$ each represents 1 or 2; n represents 0, 1 or 2; $p_1$ and $p_2$ each represents 0, 1, 2, 3, or 4; and $s_1$ and $s_2$ each represents 1 or 2.

2. A silver halide color photographic material as in claim 1, wherein the polymer for dispersing the coupler is a water-insoluble and organic solvent-soluble homopolymer or copolymer composed of constitutional repeating units having a

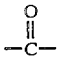

group in the main chain or a side chain thereof.

3. A silver halide color photographic material as in claim 2, wherein the polymer for dispersing the coupler is a water-insoluble and organic solvent-soluble homopolymer or copolymer composed of constitutional repeating units having a

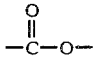

group in the main chain or a side chain thereof.

4. A silver halide color photographic material as in claim 2, wherein the polymer for dispersing the coupler is a water-insoluble and organic solvent-soluble homopolymer or copolymer composed of constitutional repeating units having a

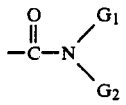

group, (wherein $G_1$ and $G_2$ each represents a hydrogen atom, or a substituted or unsubstituted alkyl or aryl group, provided that at least one of $G_1$ and $G_2$ is other than a hydrogen atom) in the main chain or a side chain thereof.

5. A silver halide color photographic material as in claim 1, wherein the dye represented by formula (III) is selected from those wherein $R_3$ and $R_4$ each is a hydrogen atom or a methyl group, $R_5$ and $R_6$ each is a hydrogen atom, an alkyl group having 4 or less carbon atoms, a substituted alkyl group having 6 or less carbon atoms, a phenyl group or a substituted phenyl group, or $R_5$ and $R_6$ together form a 5-membered or 6-membered ring, $Q_1$ and $Q_2$ each is a phenyl group or a substituted phenyl group, $X_1$ and $X_2$ each is —O—, —$NR_7$— or a chemical bond (wherein $R_7$ is a hydrogen atom, an alkyl group having 5 or less carbon atoms, or a substituted alkyl group in which the alkyl moiety has 5 or less carbon atoms).

6. A silver halide color photographic material as in claim 5, wherein in the dye represented by formula (III), $m_1$ and $m_2$ are both 1.

7. A silver halide color photographic material as in claim 4, wherein one of $G_1$ and $G_2$ is a hydrogen atom and the other is a substituted or unsubstituted alkyl or aryl group having from 3 to 12 carbon atoms.

8. A silver halide color photographic material as in claim 1, wherein said polymer has a molecular weight of 150,000 or less.

9. A silver halide color photographic material as in claim 2, wherein said polymer has a molecular weight of 100,000 or less.

10. A silver halide color photographic material as in claim 1, wherein the red-sensitive silver halide emulsion layer contains a silver chlorobromide emulsion having a silver chloride content of 90 mol% or more.

11. A silver halide color photographic material as in claim 10, wherein the silver chlorobromide emulsion has a silver chloride content of at least 98 to 99.9 mol%.

12. A silver halide color photographic material as in claim 1, wherein the red-sensitive silver halide emulsion layer contains at least one monodispersed silver halide emulsion having a variation coefficient of 15% or less.

13. A silver halide photographic material as in claim 1, wherein $m_1$ and $m_2$ are both 2.

14. A silver halide photographic material as in claim 1, wherein $R_3$ and $R_4$ each represent an alkyl group.

15. A silver halide photographic material as in claim 1, wherein $R_3$ and $R_4$ each represents a methyl group.

16. A silver halide color photographic material having blue-sensitive, green-sensitive and red-sensitive silver halide emulsion layers on a support, wherein said red-sensitive silver halide emulsion layer contains a dispersion of fine oleophilic grains formed by dispersing by emulsification a solution comprising a water-insoluble and organic solvent-soluble homopolymer or copolymer and at least one coupler selected from the group consisting of the following formulas (C-1) to (C-46):

(C-1)

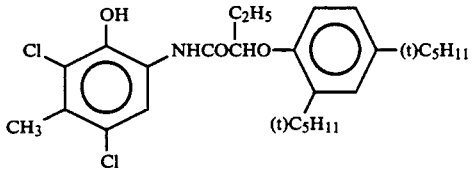

(C-2)

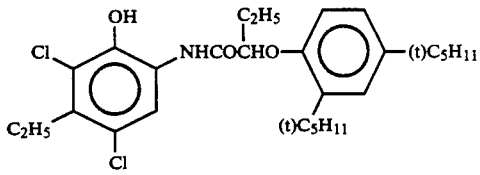

(C-3)

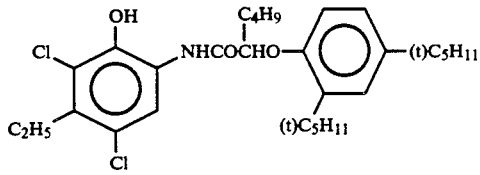

(C-4)

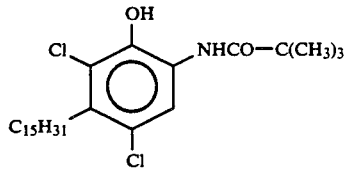

-continued
(C-5)
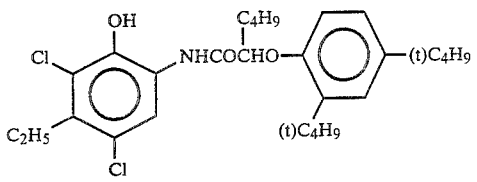
(C-6)
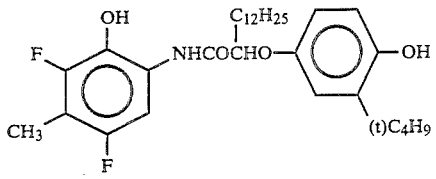
(C-7)
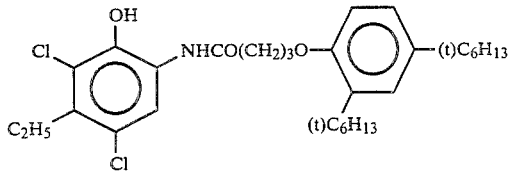
(C-8)
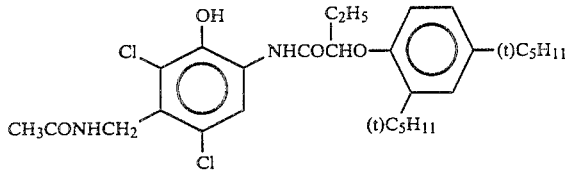
(C-9)
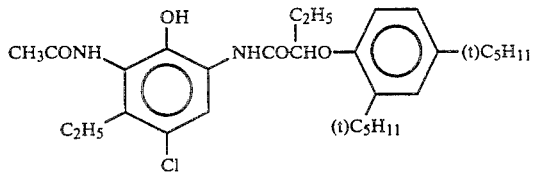
(C-10)
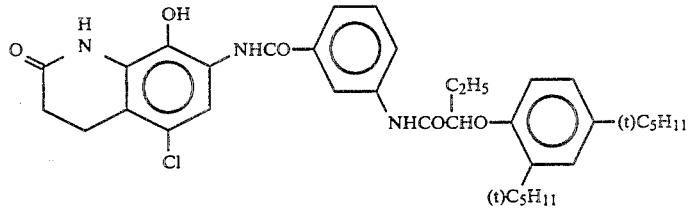
(C-11)
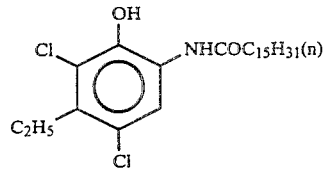
(C-12)
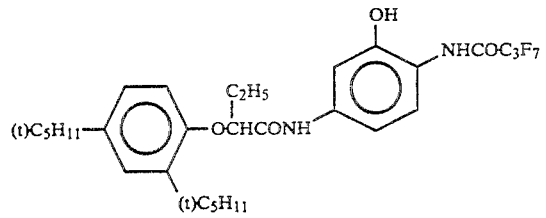

-continued
(C-13)
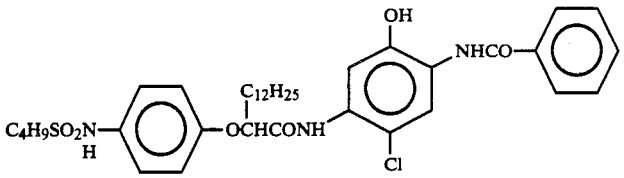
(C-14)
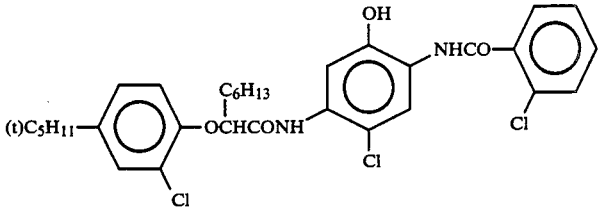
(C-15)
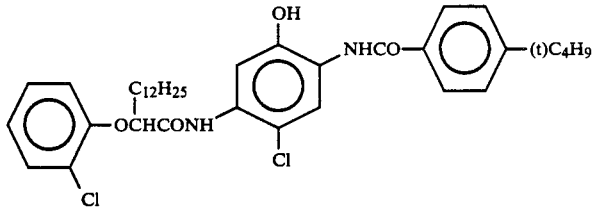
(C-16)
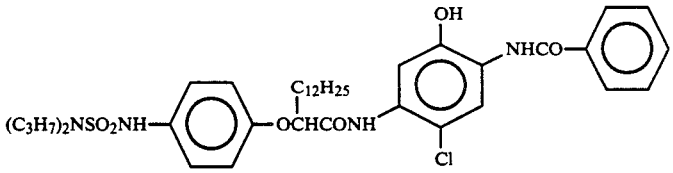
(C-17)
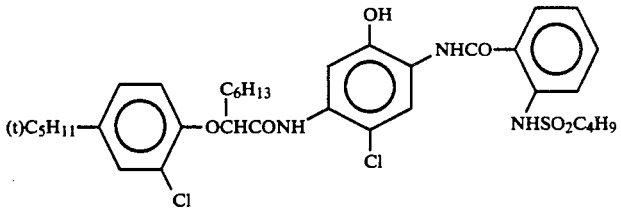
(C-18)
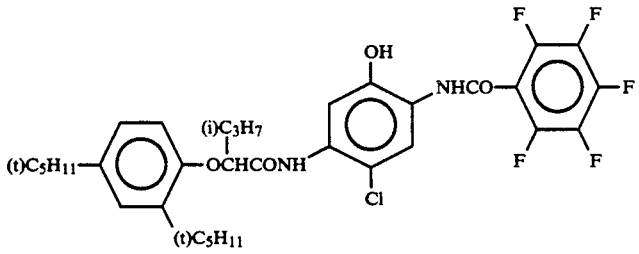
(C-19)
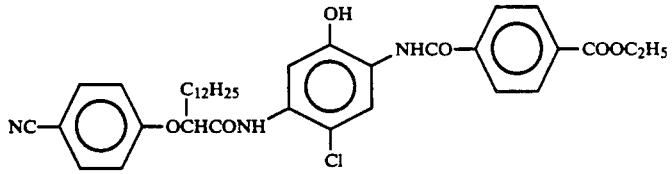

-continued
(C-20)
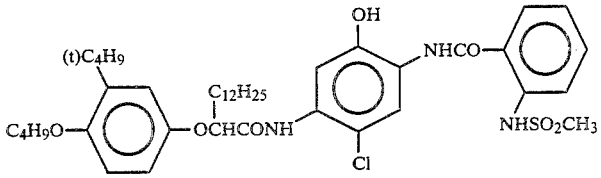
(C-21)
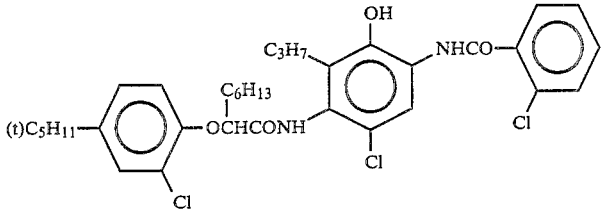
(C-22)
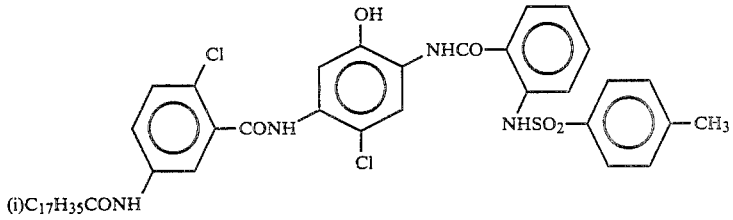
(C-23)
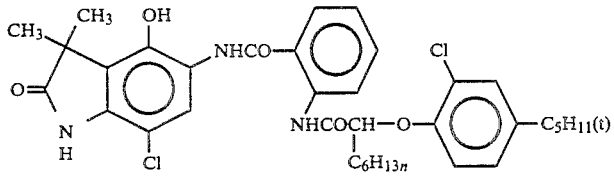
(C-24)
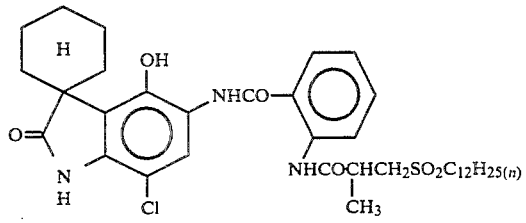
(C-25)
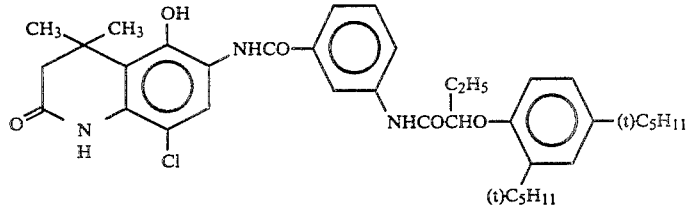
(C-26)
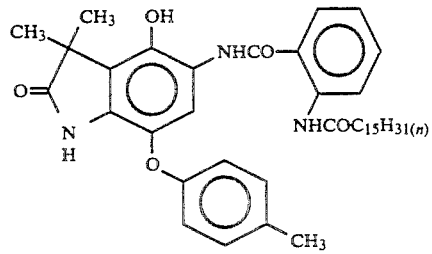

-continued
(C-27)
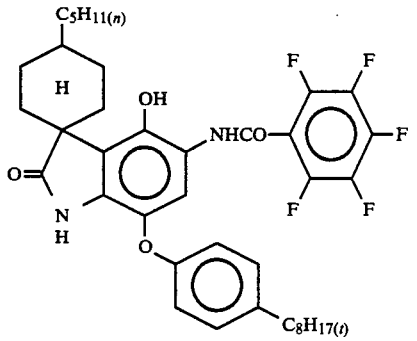
(C-28)
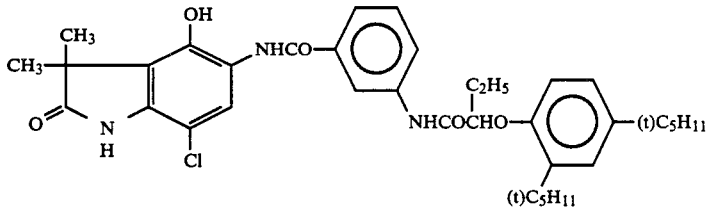
(C-29)
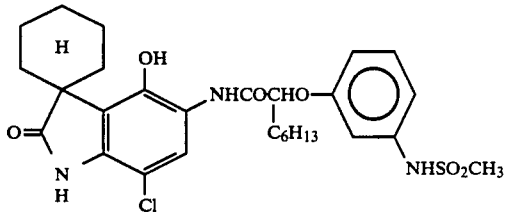
(C-30)
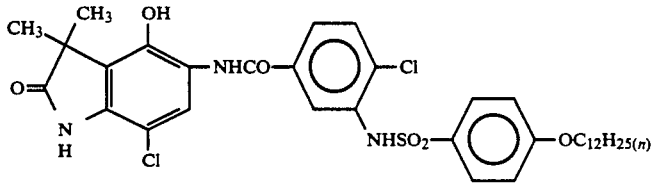
(C-31)
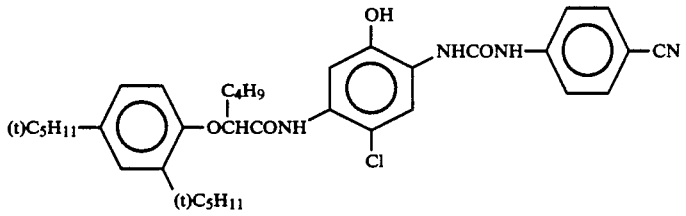
(C-32)
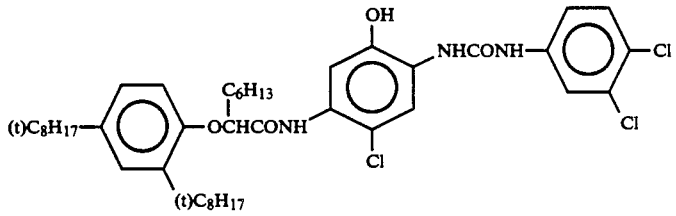
(C-33)
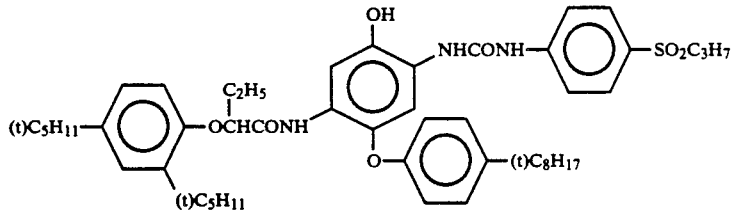

-continued
(C-34)
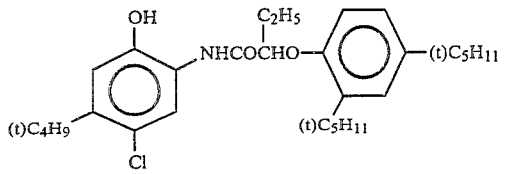
(C-35)
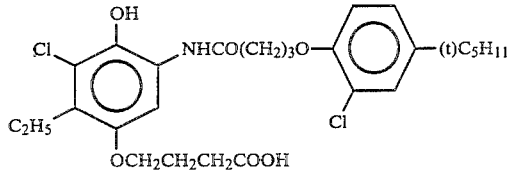
(C-36)
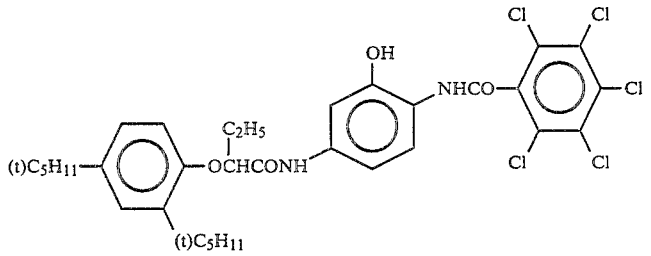
(C-37)
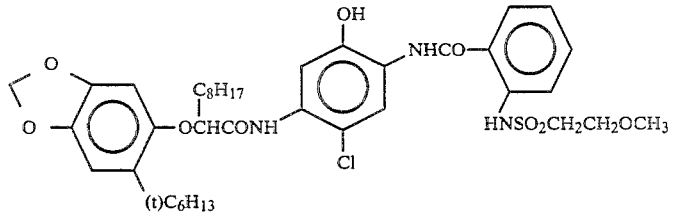
(C-38)
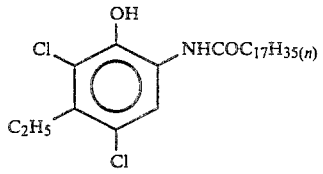
(C-39)
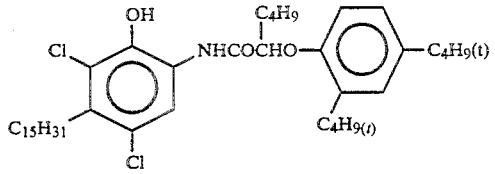
(C-40)
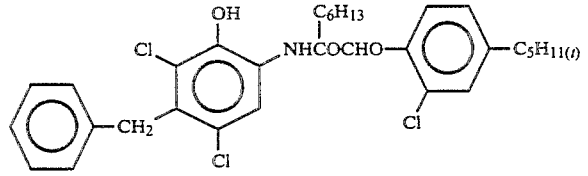
(C-41)
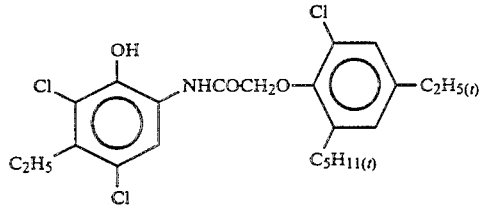

-continued (C-42)

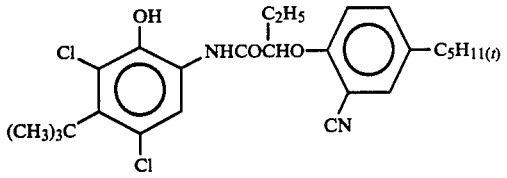

(C-43)

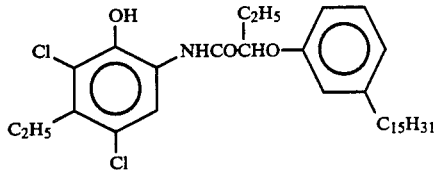

(C-44)

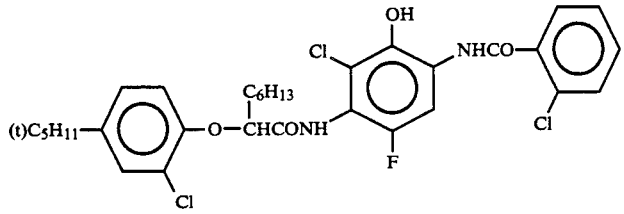

(C-45)

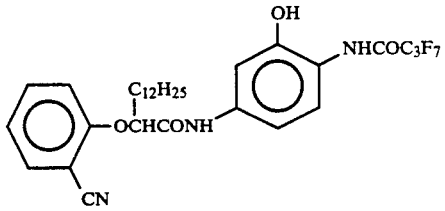

(C-46)

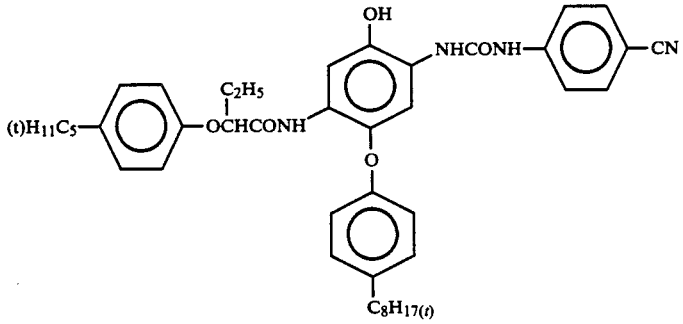

and a silver halide emulsion layer or a non-light-sensitive layer of the material contains a dye represented by formula (III)

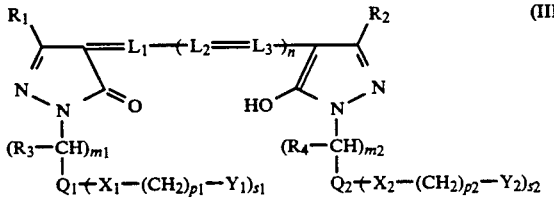

(III)

wherein $R_1$ and $R_2$ each represents —$COOR_5$ or

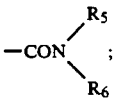

$R_3$ and $R_4$ each represents a hydrogen atom or an alkyl group; $R_5$ and $R_6$ each represents a hydrogen atom, an alkyl group or an aryl group; $Q_1$ and $Q_2$ each represents an aryl group; $X_1$ and $X_2$ each represents a divalent linking group; $Y_1$ and $Y_2$ each represents a sulfo group or a carboxyl group; $L_1$, $L_2$, and $L_3$ each represents a methine group; $m_1$ and $m_2$ each represents 1 or 2; n represents 0, 1 or 2; $p_1$ and $p_2$ each represents 0, 1, 2, 3, or 4; and $s_1$ and $s_2$ each represents 1 or 2.

* * * * *